US011849511B2

(12) United States Patent
Tong et al.

(10) Patent No.: US 11,849,511 B2
(45) Date of Patent: *Dec. 19, 2023

(54) FLEXIBLE HEATING DEVICE AND METHOD OF MAKING SAME

(71) Applicant: Calefact Limited, Hong Kong (CN)

(72) Inventors: Xiao Tong, Chuzhou (CN); Donglei Ma, Zhumadian (CN); Hing Lung Jason Tsang, Hong Kong (CN)

(73) Assignee: Calefact Limited, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/093,662

(22) Filed: Jan. 5, 2023

(65) Prior Publication Data

US 2023/0164887 A1 May 25, 2023

Related U.S. Application Data

(63) Continuation of application No. 17/832,407, filed on Jun. 3, 2022, now Pat. No. 11,558,935.
(Continued)

(30) Foreign Application Priority Data

Jun. 7, 2021 (CN) ..... 202110633495.1
Jun. 7, 2021 (CN) ..... 202110633497.0
(Continued)

(51) Int. Cl.
*H05B 3/14* (2006.01)
*H05B 1/02* (2006.01)

(52) U.S. Cl.
CPC ..... *H05B 3/14* (2013.01); *H05B 1/0272* (2013.01); *H05B 2203/003* (2013.01);
(Continued)

(58) Field of Classification Search
CPC . H05B 3/14; H05B 3/34; H05B 3/345; H05B 3/347; H05B 3/36; H05B 3/145;
(Continued)

(56) References Cited

U.S. PATENT DOCUMENTS 4,777,351 A * 10/1988 Batliwalla ..... H05B 3/342 219/201
6,979,382 B2 12/2005 Szczesuil et al.
(Continued)

FOREIGN PATENT DOCUMENTS

CN 202617386 U 12/2012
CN 109041299 A 12/2018
(Continued)

OTHER PUBLICATIONS

Hitti, "Self-heating smart jacket responds to changes in temperature", dezeen, Feb. 28, 2018, retrieved on Oct. 21, 2021 from <https://www.dezeen.com/2018/02/28/ministry-of-supply-self-heating-smart-jacket-responds-temperature-changes-technology/>.
(Continued)

*Primary Examiner* — Shawntina T Fuqua
(74) *Attorney, Agent, or Firm* — K&L Gates LLP

(57) ABSTRACT

This present disclosure relates to a flexible heating device having a unique layered assembly structure including a flexible heat generating layer. The present disclosure also relates to a method of manufacturing the flexible heating device and method of use of the flexible heating device in various applications.

20 Claims, 33 Drawing Sheets

Related U.S. Application Data

(60) Provisional application No. 63/309,880, filed on Feb. 14, 2022.

(30) Foreign Application Priority Data

| | | |
|---|---|---|
| Jun. 7, 2021 | (CN) | 202110635470.5 |
| Jun. 15, 2021 | (CN) | 202121329184.8 |
| Aug. 9, 2021 | (CN) | 202110907273.4 |
| Aug. 9, 2021 | (CN) | 202110907275.3 |
| Aug. 9, 2021 | (CN) | 202110907713.6 |

(52) U.S. Cl.
CPC .. *H05B 2203/005* (2013.01); *H05B 2203/013* (2013.01); *H05B 2203/036* (2013.01)

(58) Field of Classification Search
CPC ..... H05B 1/0272; H05B 1/0294; H05B 2203/003; H05B 2203/005; H05B 2203/013; H05B 2203/036; H05B 2203/015; H05B 2203/016; H05B 2203/017; H05B 2203/029; H05B 2214/04
See application file for complete search history.

(56) References Cited

U.S. PATENT DOCUMENTS

| | | | | |
|---|---|---|---|---|
| 7,173,223 | B2 | 2/2007 | Kuo et al. | |
| 10,433,369 | B2 | 10/2019 | Huang | |
| 10,455,643 | B2 | 10/2019 | Huang | |
| 10,701,763 | B2 | 6/2020 | Huang | |
| 10,709,384 | B2 | 7/2020 | Sun et al. | |
| 10,925,119 | B2 | 2/2021 | Sajic et al. | |
| 11,558,935 | B2 * | 1/2023 | Tong | H05B 1/0272 |
| 2006/0113296 | A1 | 6/2006 | Liang | |
| 2007/0277806 | A1 * | 12/2007 | Dodo | C09K 5/18 126/263.02 |
| 2009/0152257 | A1 | 6/2009 | Cheng et al. | |
| 2018/0192473 | A1 | 7/2018 | Huang | |
| 2019/0365113 | A1 | 12/2019 | Augustine et al. | |
| 2020/0121497 | A1 | 4/2020 | Shr et al. | |
| 2020/0163161 | A1 | 5/2020 | Pizzi et al. | |

FOREIGN PATENT DOCUMENTS

| | | | | | |
|---|---|---|---|---|---|
| CN | 210469766 | U | | 5/2020 | |
| CN | 111246604 | A | | 6/2020 | |
| CN | 211683864 | U | | 10/2020 | |
| DE | 112012005238 | T5 | | 10/2014 | |
| JP | H09500481 | A | * | 1/1997 | |
| JP | H09500481 | A | | 1/1997 | |
| JP | 2004065291 | A | | 3/2004 | |
| KR | 102075544 | B1 | | 2/2020 | |
| TW | 200937595 | A | * | 9/2009 | G01N 25/18 |
| WO | 2014131807 | A1 | | 9/2014 | |

OTHER PUBLICATIONS

"3 Reasons Why This is the Only Jacket You'll Ever Need", Hart, Jan. 1, 2021, retrieved on Apr. 6, 2022 from <https://www.harttools.com/doitwithhart/blog/buying-guides/3-reasons-why-this-is-the-only-jacket-you-ll-ever-need>.

"Quanzc Heated Vest USB Charging Lightweight Winter Warm Waistcoat for Walking Camping Ice Fishing Snowboarding Skiing", Amazon, retrieved on Apr. 6, 2022 from https://www.amazon.com/Quanzc-Charging-Lightweight-Waistcoat-Snowboarding/dp/BO8L4LLSRH? th=1&psc=1.

International Search Report dated Aug. 19, 2022 in International Application No. PCT/US22/32332.

Written Opinion dated Aug. 19, 2022 in International Application No. PCT/US22/32332.

Shandong Cringyal Nano Technology Co., LTD., Instruction for use, Jul. 2019.

Cringyal, Intelligent temperature control of flexible heating system, Jul. 2019.

Cringyal, Soft series nanocarbon heating cloth, Jul. 2019.

Sino-Textile, screenshots of a video, May 2020.

Extended European Search Report dated Nov. 4, 2022 in European Application No. 22177026.6.

* cited by examiner

FLEXIBLE HEATING DEVICE AND METHOD OF MAKING SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure relates to flexible heating devices including flexible heating pads comprising a flexible substrate layer and an electroconductive heat module formed over the flexible substrate layer; and methods of manufacture and use of the same.

Discussion of the Related Technology

Electrical surface heating fabrics or pads are used to provide heat to people, articles, or spaces in many industries such as textile, automotive and healthcare industries. Conventional electrical surface heating pads typically utilize resistance heating elements such as copper wires, carbon fiber wires, in various configurations to generate thermal energy on a surface. Some of these electrical surface heating pads are thick and inflexible, and further have a small heating area relative to the size of the surface. A high level of interest exists in many industries for improving the technologies of formulating the compositions of, designing the structures of, and manufacturing and applying electrical surface heating pads.

SUMMARY

One aspect of the present disclosure provides a flexible heating device may comprise one or more flexible heating pad. The flexible heating pad comprises a flexible substrate layer; and an electroconductive heat module formed over the flexible substrate layer and may comprise a first electrode, a second electrode, a flexible heat generating layer, a conductivity layer and a lateral heat transferring layer. The first electrode extends along a first axis; the second electrode extending generally along the first axis with a distance to the first electrode in a second axis perpendicular to the first axis; the flexible heat generating layer interposed between the first and second electrodes and electrically connected to the first and second electrodes. The flexible heat generating layer is made of an electrically conductive material having a surface resistance sufficient to generate two-dimensional electroconductive heating when an electric current flows between the first and second electrodes. The flexible heat generating layer may comprise a number of perforations formed through a thickness thereof and distributed generally throughout a two-dimensional area of the flexible heat generating layer.

In the foregoing device, the conductivity layer may be formed on the flexible heat generating layer and may comprise a number of locally continuous and electrically conductive areas that are discontinuous from one another such that the conductivity layer alone does not provide an electrical conductivity through the distance formed between the first and second electrodes along the second axis while providing electric conductivity within at least part of the number of locally continuous and electrically conductive areas. The lateral heat transfer layer may be interposed between the flexible substrate layer and the flexible heat generating layer for laterally transferring heat from the flexible heat generating layer. The lateral heat transfer layer may comprise a number of thermally conductive pouches overlaying at least one of the perforations to reduce a temperature gradient between inside and around the at least one perforation.

In the foregoing device, the flexible heat generating layer and the conductivity layer in combination has a surface resistance a range between about 2 ohms/square and about 15 ohms/square. The flexible heat generating layer with the perforations has a surface resistance that is substantially the same as that of the electrically conductive material without the perforations. The flexible heat generating layer with the perforations has a resistance ranging between about 2 and about 50 per unit area of 10 cm2. The flexible heat generating layer with the perforations has a surface resistance that is substantially higher than that of the electrically conductive material without the perforations. The electrically conductive material may comprise carbon black particles, carbon nanotubes, graphene and a binder, wherein the carbon black nanoparticles are dispersed in the electrically conductive material, wherein at least part of the carbon nanotubes electrically bridge between carbon black particles, wherein at least part of the graphene electrically bridge among at least part of the carbon black particles, at least part of the carbon nanotubes and other graphene.

Still in the foregoing device, the thickness of the flexible heat generating layer may be in a range between about 40 μm and about 80 The lateral heat transfer layer has a thickness ranging between about 0.1 μm and about 100 μm. The electroconductive heat module may have a power density in a range between about 1 w/m2 and about 1000 w/m2. The perforations have a diameter in a range between about 0.1 cm and about 1 cm. The thermally conductive pouches may contain a liquid metal therein and are liquid-tightly sealed. The liquid metal may be a eutectic metal alloy may comprise gallium, indium and tin.

Still in the foregoing device, the flexible substrate layer is referred to as a first flexible substrate layer, wherein the flexible heating device further may comprise a second flexible substrate layer formed over the electroconductive heat module such that the electroconductive heat module is interposed between the first flexible substrate layer and the second flexible substrate layer. Each of the first and second flexible substrate layers may be made of water-proof flexible substrate, wherein the first and second flexible substrate layers may be water-tightly bonded such that the electroconductive heat module is enclosed in a space defined between the first and second water-proof flexible substrate layers.

Another aspect of the present disclosure provides a garment comprising a garment body and the foregoing flexible heating device, wherein the flexible heating device is attached to a surface of the garment body.

Another aspect of the present disclosure provides method of making the foregoing flexible heating device. The method comprises: providing a film of the electrically conductive material; printing a metal paste on a surface of the film to form a conductive layer; forming perforations through the thickness of the film and the printed conductive layer to provide a perforated flexible heat generating layer; electrically connecting the perforated flexible heat generating layer to the first and second electrodes such that the first and second electrodes are apart from each other with the distance, which provides an intermediate device; laminating the intermediate device with the lateral heat transfer layer to provide the electroconductive heat module; and placing the electroconductive heat module over the flexible substrate layer.

In the foregoing method, the flexible heat generating layer and the conductivity layer in combination has a surface resistance a range between about 2 ohms/square and about 15 ohms/square. The flexible heat generating layer with the perforations has a surface resistance that is substantially the same as that of the electrically conductive material without the perforations, wherein the flexible heat generating layer with the perforations has a resistance ranging between about 2 and about 50 per unit area of 10 cm2. The flexible heat generating layer with the perforations has a surface resistance that is substantially higher than that of the electrically conductive material without the perforations. The electrically conductive material may comprise carbon black particles, carbon nanotubes, graphene and a binder, wherein the carbon black nanoparticles are dispersed in the electrically conductive material, wherein at least part of the carbon nanotubes electrically bridge between carbon black particles, wherein at least part of the graphene electrically bridge among at least part of the carbon black particles, at least part of the carbon nanotubes and other graphene. The thermally conductive pouches may contain a liquid metal therein and may be liquid-tightly sealed.

In embodiments, the flexible substrate layer comprises or is one of a fabric layer, a flexible silica gel, and a heat storage material. In embodiments, the flexible substrate layer is a fabric layer. In embodiments, the electrically conductive material has a surface resistance in a range between about 2 ohms/square and about 15 ohms/square. In embodiments, the flexible heat generating layer with the perforations has a resistance ranging between about 2 and about 50 ohms per unit area of 10 $cm^2$. In embodiments, the flexible heat generating layer with the perforations has a surface resistance that is substantially the same as that of the electrically conductive material without the perforations. In embodiments, the flexible heat generating layer with the perforations has a surface resistance that is substantially higher than that of the electrically conductive material without the perforations.

In embodiments, the electrically conductive material comprises a binder; and multi-dimensional carbon-based materials or fillers, such as carbon black particles including carbon black nanoparticles, carbon nanotubes including single-wall carbon nanotubes (SWCNTs) and multi-wall carbon nanotubes (MWCNTs), carbon nanofibers, reduced graphite oxide, expanded graphite, and graphene. In embodiments, the electrically conductive material comprises a binder, carbon black particles, carbon nanotubes and graphene. The carbon black particles may include or be carbon black nanoparticles and are dispersed in the electrically conductive material. At least part of the carbon nanotubes electrically bridge between carbon black particles, and at least part of the graphene electrically bridge among at least part of the carbon black particles, at least part of the carbon nanotubes and other graphene.

In embodiments, a sheet resistivity of the electrically conductive material thin film is about 0.1-200 milliohms (mΩ), about 1-20 milliohms, or about 4-10 milliohms, preferably about 4-10 milliohms; and a thickness of the electrically conductive material thin film is about 1-1000 μm, about 10-100 μm, or about 40-80 μm, preferably about 40-80 μm. In embodiments, the amount of the carbon-based fillers relative to the electrically conductive material by weight is in a range of about 30%-95%, about 40%-85%, about 50%-80%, about 55%-75%, about 55%-65%, about 80%, or about 60%. In embodiments, the weight ratio of the multi-dimensional carbon-based materials to the binder in the electrically conductive material is in a range of about 30:70-95:5, about 40:60-90:10, about 50:50-85:15, about 55:45-80:20, about 55:45-65:35, about 80:20, or about 60:40.

In embodiments, the electrically conductive material comprises carbon black nanoparticles, multi-wall carbon nanotubes and graphene. In embodiments, a ratio of the carbon black nanoparticles to the multi-wall carbon nanotubes to the graphene is about 0.5-3:1.5-4:0.5-3, or about 1:2.5:1.5. In embodiments, the flexible heating device further comprises a lateral heat transfer layer formed over the fabric layer such that the lateral heat transfer layer is interposed between the fabric layer and the flexible heat generating layer of the electroconductive heat module, wherein the lateral heat transfer layer is in a thickness ranging between about 0.1 μm and about 100 μm, and preferably about 0.5 to about 10 μm.

In embodiments, the lateral heat transfer layer has a two dimensional area that is substantially larger than the flexible heat generating layer of the electroconductive heat module, wherein the lateral heat transfer layer is configured to receive heat from the flexible heat transfer layer and to laterally transfer heat to an area of the fabric layer over which the flexible heat transfer layer does not extend. In embodiments, the flexible heating device further comprises a vertical heat transfer layer interposed between the flexible heat generating layer and the lateral heat transfer layer.

In embodiments, the electroconductive heat module has a power density in a range between about 1 $w/m^2$ and about 1000 $w/m^2$. Depending on the products this flexible heating device is used, the power density can be adjusted to fit the need. In embodiments, the thickness of the flexible heat generating layer is in a range between about 40 μm and about 80 μm. In embodiments, the perforations is cut by at least one of laser perforating, die cutting and punching. In embodiments, the perforations have a diameter in a range between about 0.1 cm and about 1 cm, wherein the flexible heating device further comprises a liquid metal which is to lessen a temperature gradient between inside and around the one of the perforation when compared to without the liquid metal.

In embodiments, the liquid metal is a paste spread or painted inside or around the perforations and/or on at least part of surfaces of the flexible heat generating layer and/or the flexible substrate layer and/or the lateral heat transfer layer. In embodiments, the liquid metal is sealed in a liquid-tight thin film package enclosing the liquid metal or in a number of liquid-tight pouches enclosing the liquid metal. In embodiments, the liquid metal is a paste sealed in a number of liquid-tight pouches containing the liquid metal, and at least one of the liquid-tight pouches is placed in one of the perforations, which is to lessen a temperature gradient between inside and around the one of the perforation when compared to without the at least one of the liquid-tight pouches. In embodiments, the liquid metal is a liquid metal alloy. In embodiments, the liquid metal is a liquid metal alloy of gallium, indium and tin. In embodiments, the liquid metal alloy is composed of 68.5 wt. % gallium (Ga), 21.5 wt. % indium (In) and 10.0 wt. % tin (Sn) and melts at −19° C. (−2° F.).

In embodiments, the fabric layer is referred to as a first fabric layer, wherein the flexible heating device further comprises a second fabric layer formed over the electroconductive heat module such that the electroconductive heat module is interposed between the first fabric layer and the second fabric layer. In embodiments, each of the first and second fabric layers is made of water-proof fabric, wherein the first and second fabric layers are water-tightly bonded such that the electroconductive heat module is enclosed in a space defined between the first and second water-proof fabric layers.

Another aspect of the present disclosure provides a garment comprising a garment body and the flexible heating device disclosed herein above, wherein the flexible heating device is sewed or attached to a surface of the garment body.

Another aspect of the present disclosure provides a method of making the flexible heating device discussed herein above. The method comprises: providing a film of the electrically conductive material; forming a plurality of perforations through the thickness of the film to provide a perforated film of the electrically conductive material; electrically connecting the perforated film to the first and second electrodes such that the first and second electrodes are apart from each other with the distance, which provides the electroconductive heat module; and placing the electroconductive heat module over the fabric layer.

In embodiments, the method further comprises printing silver composition or paste on a surface of the film to form an electrically conductive silver composition or paste layer prior to forming perforations; and prior to placing over the fabric layer, laminating the electroconductive heat module over a lateral heat transfer layer to provide a laminated electroconductive heat module, wherein placing the electroconductive heat module comprises placing the laminated electroconductive heat module over the fabric layer.

In embodiments, the conductive silver composition or paste layer is about 0.1-10.0 μm, or preferably about 4.0-5.0 μm. In embodiments, the electrically conductive silver paste layer has a sheet resistivity of about 1.0-20.0 milliohms (mΩ), or about 6.0-8.0 milliohms. In embodiments, the plurality of perforations are in a shape of a cycle, a square, a rectangle, a triangle, an oval, a trapezoid, or other polygons. In embodiments, the perforations are in a circular shape and have a diameter in a range between about 0.01 cm and about 10 cm, between about 0.05 cm and about 5 cm, between about 0.1 cm and about 2 cm, between about 0.1 cm and about 1 cm, between about 0.1 cm and about 0.8 cm, between about 0.2 cm and about 0.4 cm, or about 0.3 cm.

In embodiments, the perforations are evenly distributed over the film of the electrically conductive material. In embodiments, the perforations are in the same shape and size. In embodiments, the plurality are in different shapes. In embodiments, the plurality of perforations are unevenly distributed over the film of the electrically conductive material. In embodiments, the plurality of perforations are in a shape of a circle and in the same size, and a separation distance between the centers of two adjacent circular perforations is in a range of 0.05 cm to 10 cm, 0.1 cm to 5 cm, 0.1 cm to 2 cm, 0.1 cm to 1 cm, 0.3 cm to 0.8 cm, or 0.6 cm.

Another aspect of the present disclosure provides a flexible heating device comprising one or more flexible heating pads. The flexible heating pad comprises: a fabric layer; and an electroconductive heat module formed over the fabric layer and comprising a first electrode, a second electrode, and a flexible heat generating layer, the first electrode extending along a first axis; the second electrode extending generally along a second axis parallel to the first axis with a distance to the first electrode, the flexible heat generating layer interposed between the first and second electrodes and electrically connected to the first and second electrodes such that the flexible heat generating layer generates electroconductive heating when an electric current flows between the first and second electrodes; a lateral heat transfer layer formed over the fabric layer such that the lateral heat transfer layer is interposed between the fabric layer and the flexible heat generating layer of the electroconductive heat module, the lateral heat transfer layer having a thickness ranging between about 0.1 μm and about 100 μm; a vertical heat transfer layer interposed between the flexible heat generating layer and the lateral heat transfer layer; and a liquid metal paste, wherein the flexible heat generating layer is made of an electrically conductive material having a surface resistance in a range between about 2 ohms/square and about 15 ohms/square, wherein the thickness of the flexible heat generating layer is in a range between about 40 μm and about 80 μm, wherein the electrically conductive material comprises carbon black nanoparticles, carbon nanotubes, graphene and a binder, the carbon black nanoparticles are dispersed in the electrically conductive material, at least part of the carbon nanotubes electrically bridge between carbon black particles, at least part of the graphene electrically bridge among at least part of the carbon black particles, and at least part of the carbon nanotubes and other graphene, wherein the flexible heat generating layer comprises a number of perforations formed through a thickness thereof substantially throughout a two-dimensional area of the flexible heat generating layer over the fabric layer such that the flexible heat generating layer with the perforations has a resistance ranging between about 2 and about 50 per unit area of 10 cm', wherein the perforations have a diameter in a range between about 0.1 cm and about 1 cm, wherein at least one of the liquid-tight pouches is placed in one of the perforations, which is to lessen a temperature gradient between inside and around the one of the perforation when compared to without the at least one of the liquid-tight pouches.

BRIEF DESCRIPTION OF THE DRAWINGS

The present disclosure contains drawings executed in color. Copies of this patent or patent application publication with color drawings will be provided by the Office upon request and payment of the necessary fee.

FIG. 4F is drawn to show the concept of the morphology and the electrical conductive pathways of the carbon-based composite comprising carbon black particles, carbon nanotubes and graphene. The particle size, diameter, lateral dimensional size, thickness, or size ratio of the carbon black particles, the carbon nanotubes and graphene are not drawn to reflect those parameters in reality. The graphene may have different shapes and orientations in the carbon-based composite.

DETAILED DESCRIPTION OF EMBODIMENTS

Figure 1A:
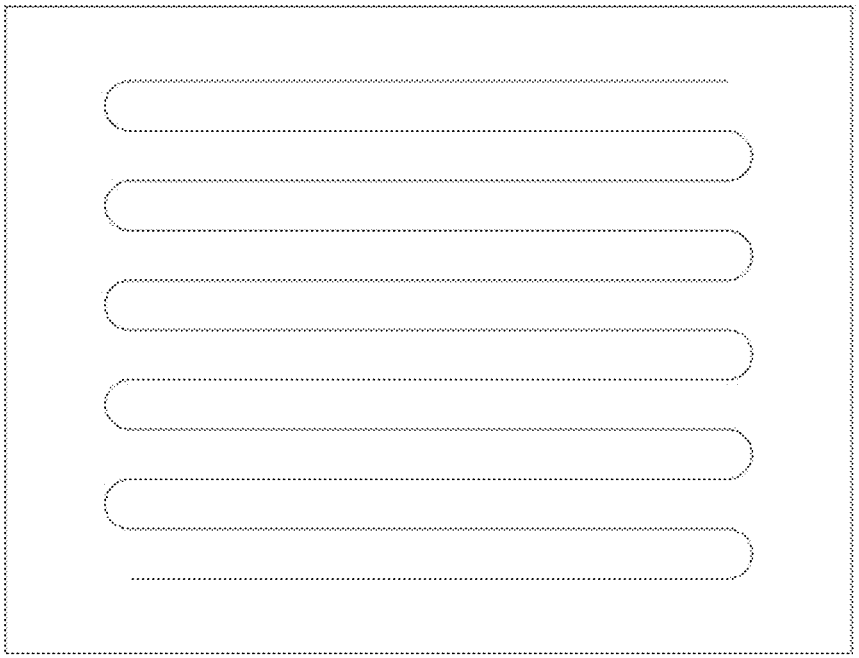
FIGS. 1A and 1B illustrate a conventional surface heating pad having a long copper wire as the resistance heating element and its effective heating area respectively.

The presently disclosed subject matter now will be described and discussed in more detail in terms of some specific embodiments and examples with reference to the accompanying drawings, in which some, but not all embodiments of the present disclosure are shown. Like numbers refer to like elements or parts throughout. The presently disclosed subject matter may be embodied in many different forms and should not be construed as limited to the specific embodiments set forth herein. Rather, these embodiments are provided so that this disclosure will satisfy applicable legal requirements. Indeed, many modifications and other embodiments of the presently disclosed subject matter will come to the mind of one skilled in the art to which the presently disclosed subject matter pertains. Therefore, it is to be understood that the presently disclosed subject matter is not to be limited to the specific embodiments disclosed and that modifications and other embodiments are intended to be included within the scope of the appended claims.

Definitions

Unless otherwise defined, all terms of art, notations and other scientific terminology used herein are intended to have the meanings commonly understood by those of skill in the art to which this disclosure pertains. In some cases, terms with commonly understood meanings are defined herein for clarity and/or for ready reference, and the inclusion of such definitions herein should not necessarily be construed to represent a difference over what is generally understood in the art. As appropriate, procedures involving the use of commercially available kits and reagents are generally carried out in accordance with manufacturer defined protocols and/or parameters unless otherwise noted.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Before explaining various aspects of the articulated manipulator in detail, it should be noted that the illustrative examples are not limited in application or use to the details of disclosed in the accompanying drawings and description. It shall be appreciated that the illustrative examples may be implemented or incorporated in other aspects, variations, and modifications, and may be practiced or carried out in various ways. Further, unless otherwise indicated, the terms and expressions employed herein have been chosen for describing the illustrative examples for the convenience of the reader and are not for the purpose of limitation thereof.

Additionally, it shall be appreciated that the apparatuses and methods disclosed herein can be implemented as components of any number of systems and/or subsystems associated with a nuclear reactor and/or plant. As such, the present disclosure shall not be construed as limited to apparatuses, devices and/or methods.

As used herein, the singular forms "a," "an," and "the" include the plural referents unless the context clearly indicates otherwise.

As used herein, the terms "about" or "approximately" or "near" or "around", unless otherwise specified, indicates and encompasses an indicated value and a range above and below that value. In certain embodiments, the terms "about" or "approximately" indicates the designated value ±10%, ±9%, ±8%, ±7%, ±6%, ±5%, ±4%, ±3%, ±2%, ±1%, ±1%, ±0.5%, or ±0.05%. In certain embodiments, the term "about" indicates the designated value ±1, 2, 3, or 4 standard deviations of that value.

In this specification, unless otherwise indicated, all numerical parameters are to be understood as being prefaced and modified in all instances by the term "about," in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described herein should at least be construed in light of the number of reported significant digits and by applying ordinary rounding techniques.

The term "combinations thereof" includes every possible combination of elements to which the term refers.

Those skilled in the art will recognize that, in general, terms used herein, and especially in the appended claims (e.g., bodies of the appended claims) are generally intended as "open" terms. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features. For example, the term "comprising" should be interpreted as "comprising but not limited to;" the term "including" should be interpreted as "including but not limited to;" the term "having" should be interpreted as "having at least;" and the term "includes" should be interpreted as "includes but is not limited to," etc.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Directional phrases used herein, such as, for example and without limitation, top, bottom, left, right, lower, upper, front, back, and variations thereof, shall relate to the orientation of the elements shown in the accompanying drawing and are not limiting upon the claims unless otherwise expressly stated.

Any numerical range recited herein includes all sub-ranges subsumed within the recited range. For example, a range of "1 to 100" includes all sub-ranges between (and including) the recited minimum value of 1 and the recited maximum value of 100, that is, having a minimum value equal to or greater than 1 and a maximum value equal to or less than 100. Further, all ranges recited herein are inclusive of the end points of the recited ranges. For example, a range of "1 to 100" includes the end points 1 and 100. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited. All such ranges are inherently described in this specification.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Flexible Heating Device

Conventional Surface Heating Devices

An electrical surface heating device is a device having a heating element that can become hot and raise the temperature of a surface. As shown in FIGS. 1A-1B and 2A-2B, conventional electrical surface heating devices typically include a linear heating element such as copper wires (FIG. 1A) or carbon fibers (FIG. 2A) to generate thermal energy on a two-dimensional surface.

Linear Heating

Figure 1B:
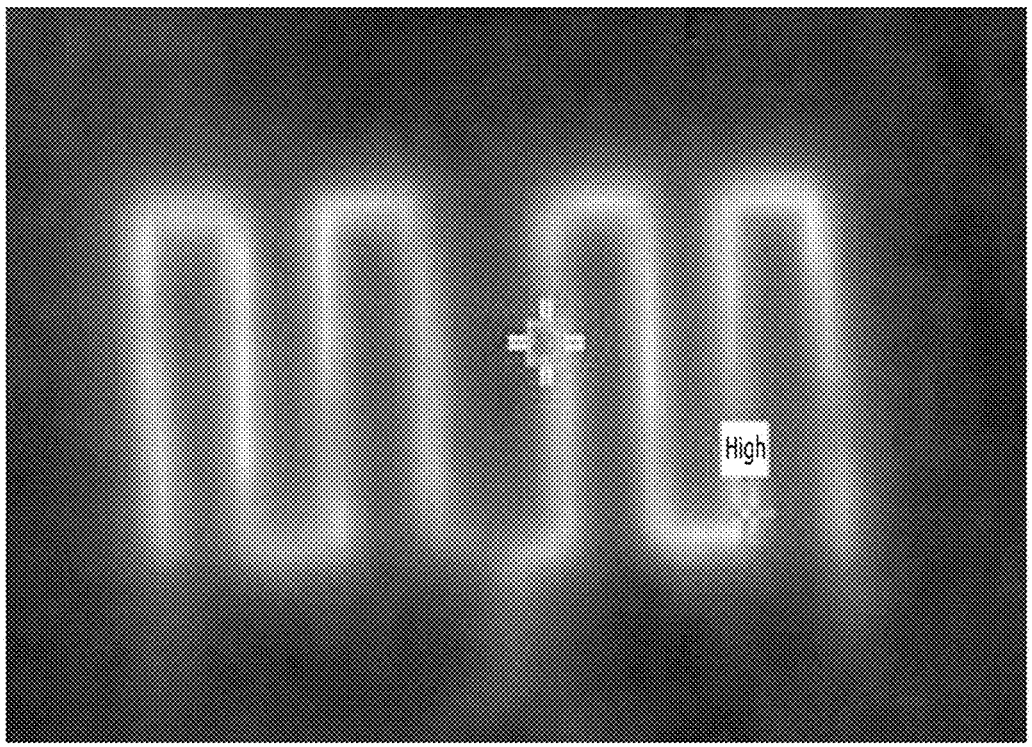
Figure 1C:
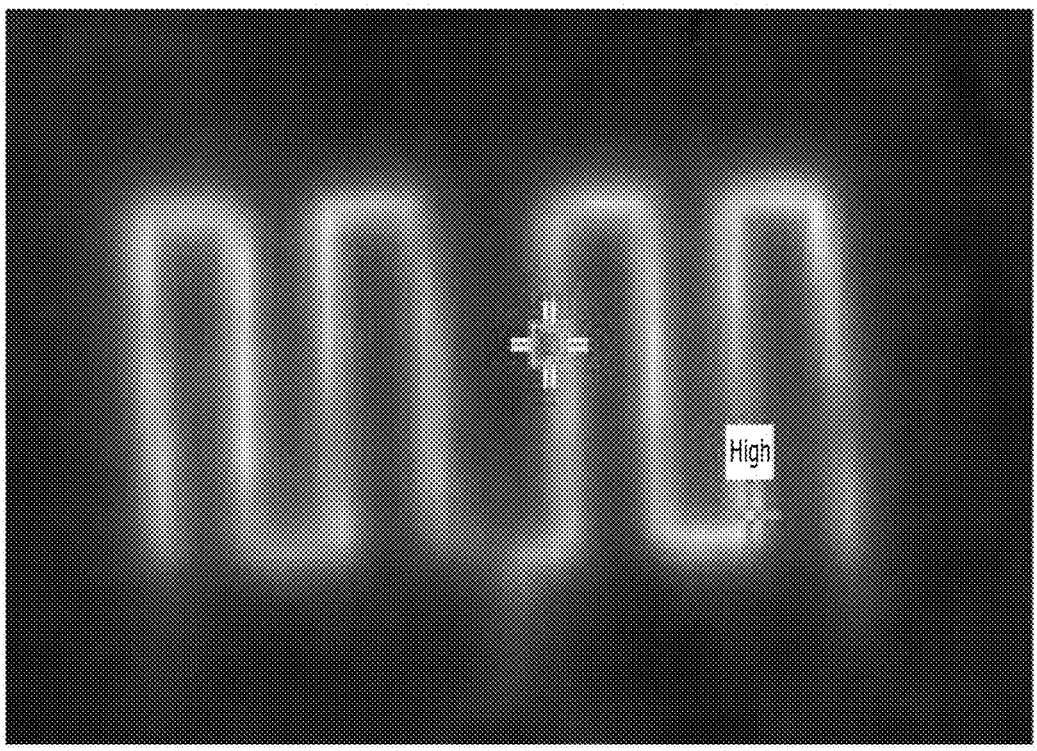
FIG. 1C is a color version of FIG. 1B.

The linear heating source to provide surface heating has limitations and is ineffective. The linear wire heating only generates heat along the wires and thus has very small proportion of the heating surface area relative to the product area. The heat has to travel between wires, resulting in hot and cold spots and thus inhomogeneous heating of the surface heating device. For example, as shown in FIGS. 1B and 2B, the electrical heating systems having long copper wires (FIG. 1B) or carbon fibers (FIG. 2B) have relatively small effective heating surface areas and cannot heat uniformly in a large area and are prone to cooling and heating alternately as a result of relatively small heating areas. The problems have large negative effects to the application environment, field and corresponding product quality of the flexible electrical heating systems. Further when even one part of the wire is broken, the whole surface heating device is broken.

Two Dimensional Heating

The inefficiency of the linear heating discussed above can be addressed by two-dimensional heating. The present disclosure provides two-dimensional heating using an electrically conductive material comprising a carbon-based composite having multiple carbon-based fillers as the electrical heating layer which provides large heating surface area and highly homogeneous and efficient heating with high efficiency.

Surface Heating Devices Using Forced-Air Warming (FAW)

In the health care community and industry, forced-air warming (FAW) devices have become one of the "standard of care" for preventing and treating the hypothermia caused by anesthesia and surgery during the past decades. It is well established that surgical patients under anesthesia become poikilothermic. The patients lose their ability to control their body temperature and will lose heat and become clinically hypothermic if not warmed. Hypothermia has been linked to increased wound infections, increased blood loss, increased cardiac morbidity, prolonged ICU time, prolonged hospital stays, increased cost of surgery and increased death rates. Therapeutic patient warming is especially important for patients during anesthesia and surgery. The FAW devices include a large heater/blower attached by a hose to an inflatable air blanket. The large heater/blower injects warm air through the connecting hose into the blanket having small holes on one surface. The warm air is distributed over the patient within the chambers of the blanket and then is exhausted onto the patient above the blanket through the small holes in the bottom surface of the blanket to provide conductive and convective warming to the patient.

Although FAW is clinically effective, it suffers from several problems including: a relatively high price; air blowing in the operating room, which can be noisy and can potentially contaminate the surgical field; and bulkiness, which, at times, may obscure the view of the surgeon. Moreover, the low specific heat of air and the rapid loss of heat from air require that the temperature of the air, as it leaves the hose, be dangerously high—in some products as high as 45° C. This poses significant dangers for the patient. Second and third degree burns have occurred both because of contact between the hose and the patient's skin, and by blowing hot air directly from the hose onto the skin without connecting a blanket to the hose. This condition is common enough to have its own name—"hosing." The manufacturers of forced air warming devices actively warn their users against hosing and the risks it poses to the patient.

The flexible heating system of the present disclosure solves the problems associated with the FAW discussed above using two-dimensional heating device that provides quiet, uniform and efficient electrical heating with large effective heating surface area and thus is suitable for therapeutic patient warming during anesthesia and surgery discussed above.

Flexible Heating Devices

The present disclosure provides a flexible heating device comprising one or more flexible heating pads. The flexible heating pad comprises: a flexible substrate layer such as a fabric layer; and an electroconductive heat module formed over the fabric layer and comprising a first electrode, a second electrode, and a flexible heat generating layer; the first electrode extending along a first axis; the second electrode extending generally along the first axis with a distance to the first electrode in a second axis perpendicular to the first axis, the flexible heat generating layer interposed between the first and second electrodes and electrically connected to the first and second electrodes such that the flexible heat generating layer generates electroconductive heating when an electric current flows between the first and second electrodes, wherein the flexible heat generating layer is made of an electrically conductive material having a surface resistance in a range between about 2 ohms/square and about 15 ohms/square, wherein the flexible heat generating layer comprises a number of perforations formed through a thickness thereof substantially throughout a two-dimensional area of the flexible heat generating layer over the fabric layer such that the flexible heat generating layer with the perforations has a resistance ranging between about 1 and 100Ω, and preferably 2 and about 20Ω per unit area of 10 $cm^2$.

Here, the electroconductive two-dimensional heating generates heat from substantially throughout the two-dimensional area of the flexible heat generating layer. In embodiments, the flexible heat generating layer with the perforations has a surface resistance that is substantially the same as that of the electrically conductive material without the perforations. In embodiments, the flexible heat generating layer with the perforations has a surface resistance that is substantially higher than that of the electrically conductive material without the perforations.

In embodiments, the electrically conductive material comprises carbon black particles, carbon nanotubes, graphene and a binder, the carbon black nanoparticles are dispersed in the electrically conductive material, at least part of the carbon nanotubes electrically bridge between carbon black particles, and at least part of the graphene electrically bridge among at least part of the carbon black particles, at least part of the carbon nanotubes and other graphene. In embodiments, the flexible heating device further comprises a lateral heat transfer layer formed over the fabric layer such that the lateral heat transfer layer is interposed between the fabric layer and the flexible heat generating layer of the electroconductive heat module, wherein the lateral heat transfer layer is in a thickness ranging between about 0.1 μm and about 200 μm. and preferably between about 0.5 μm and about 10 μm.

In embodiments, the lateral heat transfer layer has a two-dimensional area that is substantially larger than the flexible heat generating layer of the electroconductive heat module, wherein the lateral heat transfer layer is configured to receive heat from the flexible heat transfer layer and to laterally transfer heat to an area of the fabric layer over which the flexible heat transfer layer does not extend. In embodiments, the flexible heating device further comprises a vertical heat transfer layer interposed between the flexible heat generating layer and the lateral heat transfer layer. In embodiments, the electroconductive heat module has a power density in a range between about 1 $w/m^2$ and about 1000 $w/m^2$. Depending on the products this flexible heating device is applied to, the power density is adjusted to fit the need of applications.

In embodiments, the thickness of the flexible heat generating layer is in a range between about 1 μm and about 200 μm, between about 10 μm and about 100 μm, or between about 40 μm and about 80 μm. In embodiments, the perforations have a diameter in a range between about 0.1 cm and about 1 cm. In embodiments, the perforations have a diameter in a range between about 0.1 cm and about 10 cm, or between about 0.1 cm and about 1 cm, wherein the flexible heating device further comprises a liquid metal. In embodiments, the liquid metal is spread and painted inside and/or around the perforations, which is to lessen a temperature gradient between inside and around the one of the perforations when compared to without the liquid metal. In embodiments, the liquid metal is sealed in a number of liquid-tight pouches containing the liquid metal, wherein at least one of the liquid-tight pouches is placed in one of the perforations, which is to lessen a temperature gradient between inside and around the one of the perforation when compared to without the at least one of the liquid-tight pouches.

In embodiments, the fabric layer is referred to as a first fabric layer, wherein the flexible heating device further comprises a second fabric layer formed over the electroconductive heat module such that the electroconductive heat module is interposed between the first fabric layer and the second fabric layer. In embodiments, each of the first and second fabric layers is made of water-proof fabric, wherein the first and second fabric layers are water-tightly bonded such that the electroconductive heat module is enclosed in a space defined between the first and second water-proof fabric layers.

Another aspect of the present disclosure provides a garment comprising a garment body and the flexible heating device disclosed herein above, wherein the flexible heating device is attached to a surface of the garment body.

Another aspect of the present disclosure provides a method of making the flexible heating device discussed herein above. The method comprises: providing a film of the electrically conductive material; forming perforations through the thickness of the film to provide a perforated film of the electrically conductive material; electrically connecting the perforated film to the first and second electrodes such that the first and second electrodes are apart from each other with the distance, which provides the electroconductive heat module; and placing the electroconductive heat module over the fabric layer. In embodiments, the method further comprises printing silver paste on a surface of the film prior to forming perforations; and prior to placing over the fabric layer, laminating the electroconductive heat module over a lateral heat transfer layer to provide a laminated electroconductive heat module, wherein placing the electroconductive heat module comprises placing the laminated electroconductive heat module over the fabric layer.

Another aspect of the present disclosure provides a flexible heating device comprising one or more flexible heating pads. The flexible heating pad comprises: a fabric layer; and an electroconductive heat module formed over the fabric layer and comprising a first electrode, a second electrode, and a flexible heat generating layer, the first electrode extending along a first axis; the second electrode extending generally along a second axis parallel to the first axis with a distance to the first electrode, the flexible heat generating layer interposed between the first and second electrodes and electrically connected to the first and second electrodes such that the flexible heat generating layer generates electroconductive heating when an electric current flows between the first and second electrodes; a lateral heat transfer layer formed over the fabric layer such that the lateral heat transfer layer is interposed between the fabric layer and the flexible heat generating layer of the electroconductive heat module, the lateral heat transfer layer having a thickness ranging between about 0.1 μm and about 100 μm; a vertical heat transfer layer interposed between the flexible heat generating layer and the lateral heat transfer layer; and a number of liquid-tight pouches containing liquid metal, wherein the flexible heat generating layer is made of an electrically conductive material having a surface resistance in a range between about 2 ohms/square and about 15 ohms/square, wherein the thickness of the flexible heat generating layer is in a range between about 40 μm and about 80 wherein the electrically conductive material comprises carbon black nanoparticles, carbon nanotubes, graphene and a binder, the carbon black nanoparticles are dispersed in the electrically conductive material, at least part of the carbon nanotubes electrically bridge between carbon black particles, at least part of the graphene electrically bridge among at least part of the carbon black particles, and at least part of the carbon nanotubes and other graphene, wherein the flexible heat generating layer comprises a number of perforations formed through a thickness thereof substantially throughout a two-dimensional area of the flexible heat generating layer over the fabric layer such that the flexible heat generating layer with the perforations has a resistance ranging between about 2 and about 50Ω per unit area of 10 $cm^2$, wherein the perforations have a diameter in a range between about 0.1 cm and about 1 cm, wherein at least one of the liquid-tight pouches is placed in one of the perforations, which is to lessen a temperature gradient between inside and around the one of the perforation when compared to without the at least one of the liquid-tight pouches.

Figure 3:
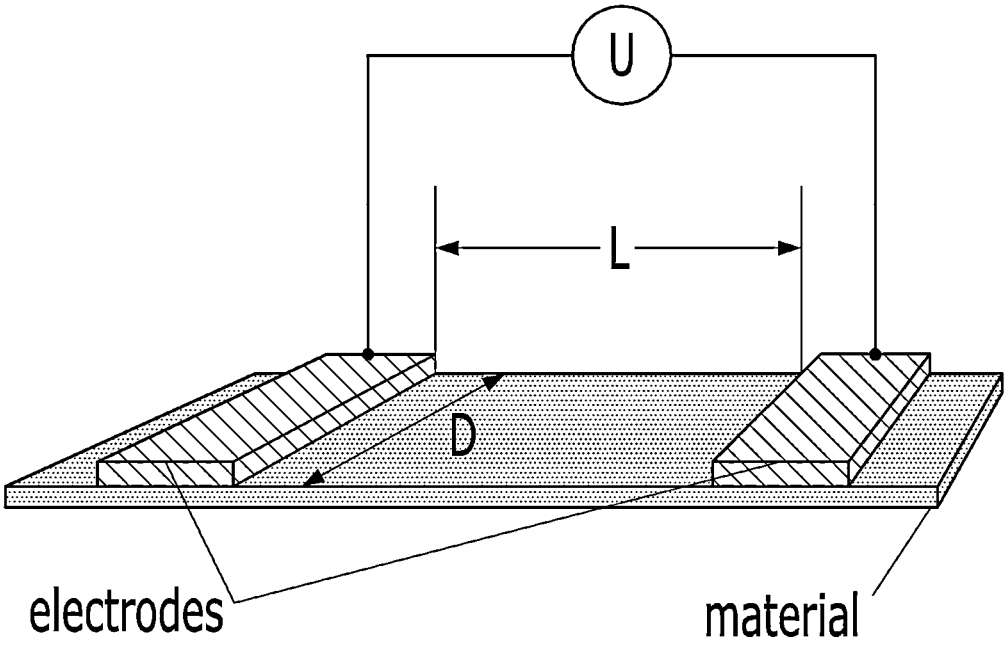
FIG. 3 illustrates a set up for measuring surface resistance and surface resistivity of test samples according to an embodiment and control samples using four-point probe measurement device.

In the present disclosure, surface resistance (Rs), also called sheet resistance or square resistance, is applicable to two-dimensional systems and refers to a measure of resistance of conductive or semi-conductive thin films (two dimensional) having uniform thickness along the plane of the thin films, not perpendicular to it. Surface resistance is invariable under scaling of the thin film contact and therefore can be used to compare the electrical properties of devices that are significantly different in size. Surface resistance is measured using a four-terminal sensing measurement (also known as a four-point probe measurement) and has a unit of "ohms square" (denoted "Ω") or "ohms per square" (denoted "Ω/sq" or "Ω/□"). Surface resistance, $R_s$ is defined as the ratio of a DC voltage U to the current, $I_s$ flowing between two electrodes of specified configuration that are in contact with the same side of a material under test (as shown in FIG. 3) as shown in Equation (1). The thin film between the two electrodes has a length L and a width D. When measuring the surface resistance of the thin film using the four-point probe measurement device, the length L equals the width D.

$$R_s = \frac{U}{I_s} \tag{1}$$

Surface resistivity ($\rho_s$) refers to a measure of the specific resistivity along the sample surface of a conductive or semi-conductive thin film. For a thin film having length L, width D and thickness t, and the current passing along the direction of the length L, the surface resistivity of the thin film is determined by the ratio of DC voltage U drop per unit length L to the surface current $I_s$ per unit width D, wherein the surface current $I_s$ flows along the direction of the length between two electrodes of specified configuration that are in contact with the same side of a material under test (as shown in FIG. 3) as shown in Equation (2). The surface resistivity can also be calculated from the surface resistance also shown in Equation (2) below.

$$\rho_s = \frac{U/L}{I_s/D} = R_s \cdot t \tag{2}$$

Flexible Heating Pad

Flexible Heating Pad

Figure 4A:
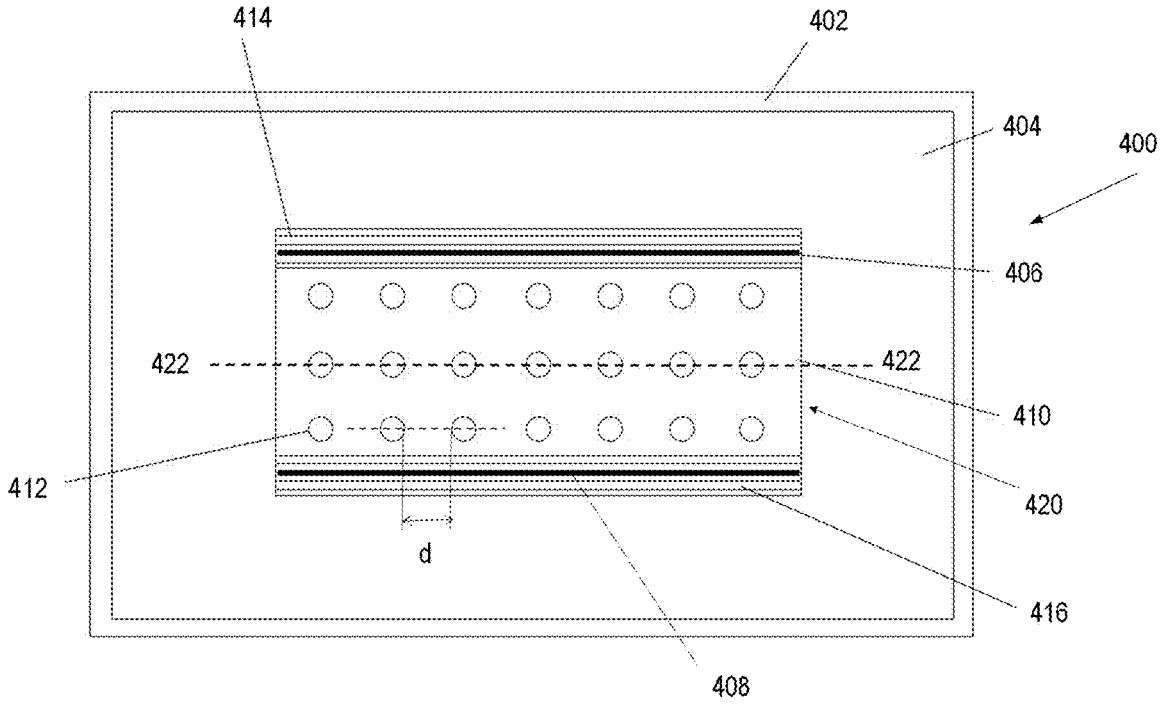
FIG. 4A illustrates the layered structures of a flexible heating pad in some embodiments according to the present disclosure.
Figure 4B:
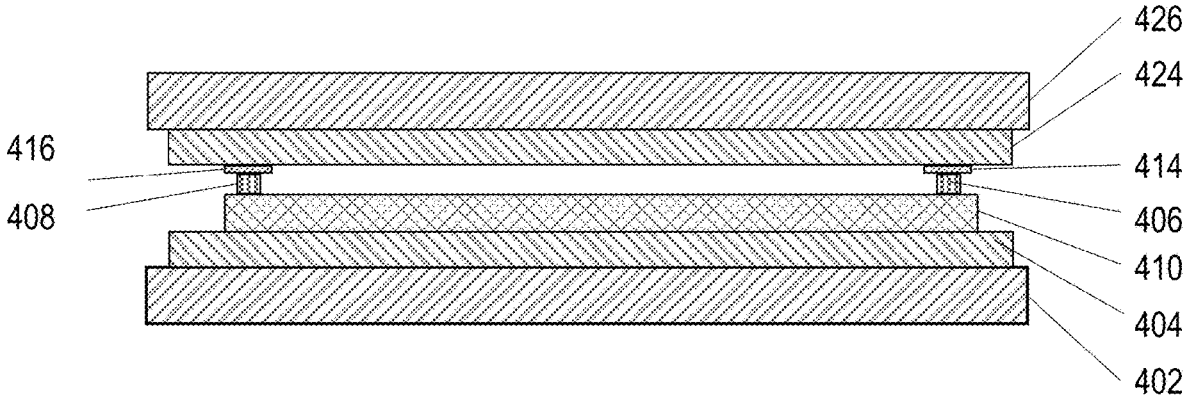
FIGS. 4B and 4C illustrates a cross-section view of the flexible heating pad in some embodiments according to the present disclosure.

The present disclosure provides a flexible heating device comprising one or more flexible heating pads. According to embodiments, the structure of a flexible heating pad is schematically illustrated in FIGS. 4A to 4D. As shown in FIGS. 4A and 4B, the flexible heating pad 400 is a flexible laminated thin film including multiple layers. The flexible heating pad 400 includes: a first flexible substrate (such as a fabric layer) 402; and an electroconductive heat module 420 formed over the first flexible substrate 402. The flexible heating pad 400 may optionally include a lateral heat transfer layer 404 formed between the electroconductive heat module 420 and the first flexible substrate 402. The flexible heating pad 400 may optionally include a second flexible substrate 426 formed over the electroconductive heat module 420 and the lateral heat transfer layer 404. The flexible heating pad 400 may optionally include a second lateral heat transfer layer 424 formed between the electroconductive heat module 420 and the second flexible substrate 426. Each of the layers of the flexible heating pad is sealed at all of its edges to its adjacent layers in the flexible heating pad using a hot melt adhesive compound such as thermoplastic polyurethane (TPU).

Electroconductive Heat Module

Electroconductive Heat Module

Figure 4C:
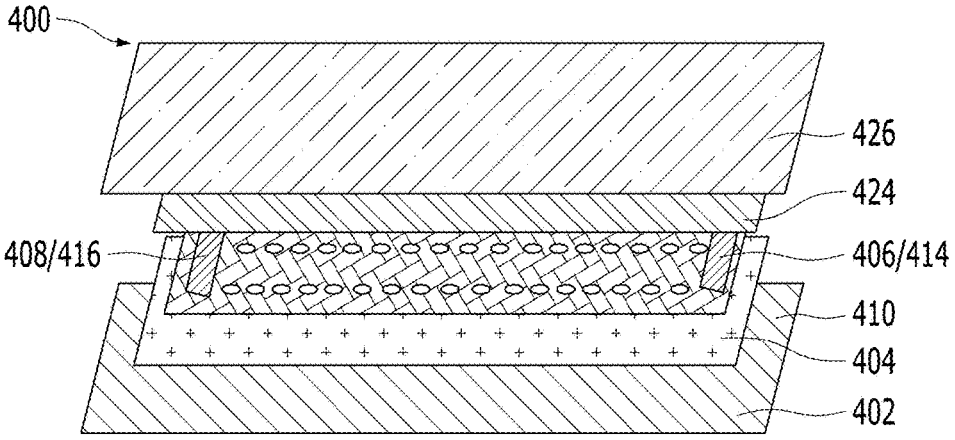
Figure 4D:
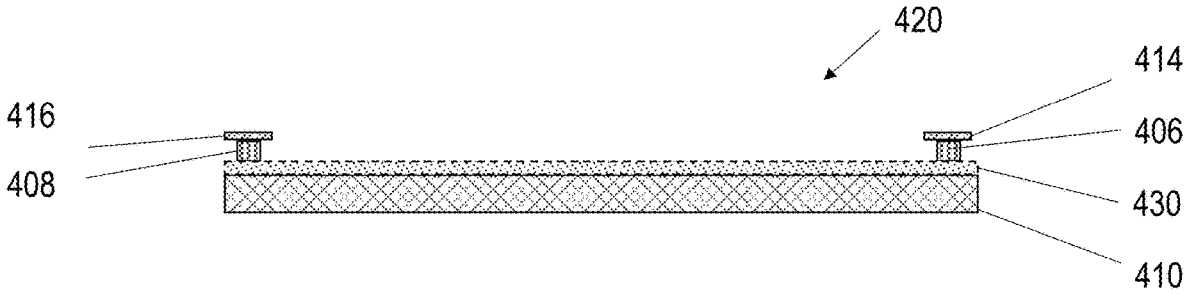
FIG. 4D illustrates a cross-section view of the an electroconductive heat module in some embodiments according to the present disclosure.
Figure 4E:
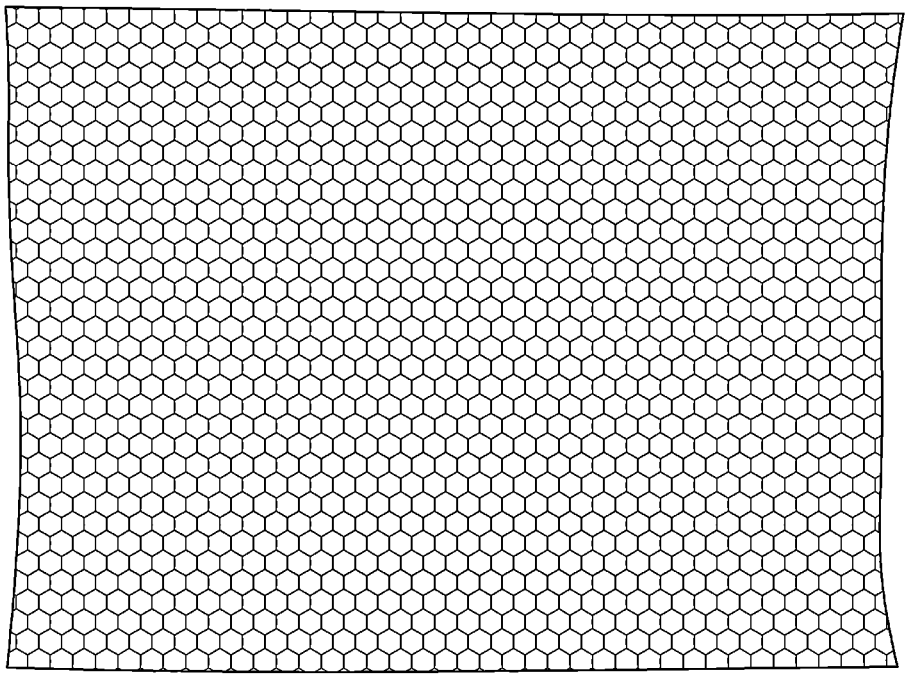
FIG. 4E shows a flexible heating pad in some embodiments according to the present disclosure.

In embodiments, as shown in FIGS. 4A-4C, the electroconductive heat module 420 includes a first electrode 406, a second electrode 408, a flexible heat generating layer 410 including an electrically conductive material, and optionally a first flexible protective layer 414 and a second flexible protective layer 416. The first electrode 406 extends generally parallel to an axis 422. The second electrode 408 also extends generally parallel to the axis 422 with a distance to the first electrode 406. The flexible heat generating layer 410 is interposed between the first and second electrodes 406 and 408 and electrically connected to the first and second electrodes 406 and 408. The flexible heat generating layer 410 is designed and configured to generate two-dimensional electroconductive heating when an electric current flows between the first and second electrodes 406 and 408. The first flexible protective layer 414 covers the first electrode 406. The second flexible protective layer 416 covers the second electrode 408. The flexible heat generating layer 410 may include a number of perforations 412 formed through a thickness thereof substantially throughout a two-dimensional area of the flexible heat generating layer. The electrically conductive material may include a carbon-based composite.

Conductivity Layer

In embodiments, the electroconductive heat module 420 may optionally include a conductivity layer 430 formed on the flexible heat generating layer 410. The conductivity layer 430 is preferably formed with silver, and this layer is also referred to as a silver layer 430 in this disclosure. However, silver may be substituted with one or more other highly electrically and thermally conductive material such as copper, aluminum or similar metals. The conductivity layer 430 may be formed on either or both sides of the flexible heat generating layer 410. In some embodiments, the silver layer 430 is formed on the side of the flexible heat generating layer 410 onto which the two electrodes 406 and 408 are layered. In other embodiments, the silver layer 430 is formed on the opposite side of the flexible heat generating layer 410. In embodiments, the silver layer 430 is formed by printing or coating silver particles on either of both surfaces of the flexible heat generating layer 410. The silver layer 430 may be formed before or after the electrodes 406 and 408 are layered onto the flexible heat generating layer 410. In some embodiments, the silver layer 430 may be formed before the electrodes 406 and 408 are layered onto the flexible heat generating layer 410 so that the silver layer can improve the electrical conductivity and reduce the contact resistance between the flexible generating layer 410 and the electrode 406, and between the flexible generating layer 410 and the electrode 408. In some embodiments, the silver layer 430 covers substantially all of the two dimensional area of the flexible heat generating layer 410 excluding perforations. In other embodiments, the silver layer 430 covers one or more portions of the two dimensional area of the flexible heat generating layer 410 and leaves some portions of the flexible heat generating layer uncovered.

Locally Continuous Areas

In embodiment, the conductivity layer 430 may include a number of locally continuous areas that are distributed in the overall two dimensional area of the silver layer. The locally continuous areas are formed with a dense deposit of silver particles and accordingly electrically conductive within those areas. In embodiments, these locally continuous areas are discontinuous from neighboring or adjacent locally continuous areas by at least one intervening area that has thin or no silver particles. In some embodiments, some or all of the locally continuous areas may be formed in a particular shape or pattern. In other embodiments, some or all of the locally continuous areas may be in irregular shapes. With these locally continuous areas that are discontinuous from adjacent locally continuous areas, the silver layer 430 does not form electrically conductive pathways through the distance formed between the two electrodes 406 and 408. However, the electrical current flowing between the two electrodes at least in part flows through some of these locally continuous areas of the silver layer 430. In embodiments, with the locally continuous areas of the silver layer, the electrical conductivity of the flexible heat generating layer 410 is adjusted to achieve a desired surface resistance within a range between about 0.1 ohms/square (2/square) and about 20 ohms/square.

Two-Dimensional Electroconductive Heating

The electroconductive heat module 420 has two-dimensional electroconductive heating from the two-dimensional area of the flexible heat generating layer 410 when the current passes through the two-dimensional area between the two electrodes. In embodiments, the electrical conductive element is the two-dimensional area of the flexible heat generating layer between the two electrodes instead of conventional wires. This two-dimensional electroconductive heating generates heat from the generally entire two-dimensional surface area of the flexible heat generating layer between the two electrodes and provides more uniform heat over the flexible heat generating layer as compared to conventional linear heating.

Electrodes

In embodiments, the flexible first and second electrodes 406 and 408 are at least one of a conductive metal foil, a metal film deposited onto the surface of the perforated electrically conductive material thin film, and a flexible conductive fabric. Non-limiting examples of the metal foil are a silver foil, a copper foil, and an aluminum foil. Non-limiting examples of the metal film are a silver film, a copper film and an aluminum film.

Electrode Protective Layer

In embodiments, the electroconductive heat module 420 comprises two flexible protective layers 414 and 416, each of which covers one of the two electrodes 406 and 408 respectively. In embodiments, the first and second flexible protective layers 414 and 416 are polyethylene terephthalate (PET) or polyimide (PI) thin films. In embodiments, the first and second flexible protective layers are waterproof and electrically insulative. The two flexible protective layers 414 and 416 are included to protect the two electrodes to evenly distribute the bending or folding forces applied to the two electrodes during usage or water-washing process; to protect the two electrodes from moisture or water during usage of the flexible heating device; and further to prevent the two electrodes from contacting the other components of the flexible heating pads, such as the lateral heat transfer layer 424, to ensure that the electrical current goes through the flexible heat generating layer 410.

Flexible Heat Generating Layer

Electrically Conductive Material

In embodiments, the flexible heat generating layer 410 includes or is made of an electrically conductive material for the two-dimensional electroconductive heating. The flexible heat generating layer may optionally comprise a number of perforations 412 formed through the thickness thereof.

Flexible Heat Generating Layer

In embodiments, the flexible heat generating layer 410 has a surface resistance in a range between about 2 ohms/square and about 15 ohms/square. The flexible heat generating layer with the perforations 412 has a resistance ranging between about 1 and about 100Ω, and preferably between about 2 and about 20Ω per unit area of 10 $cm^2$. The flexible heat generating layer has mechanical properties of flexibility and tear strength so that the flexible heating device is flexible, bendable, foldable, and water-washable. The flexible heat generating layer has a thickness in a range between about 1 μm and about 200 μm, between about 10 μm and about 100 μm, or between about 40 μm and about 80 μm.

Perforations

In embodiments, the flexible heat generating layer 410 may include a number of perforations 412 formed through its thickness. The perforations are formed generally uniformly throughout the flexible heat generating layer although not limited thereto. In some embodiments, the perforations are formed substantially throughout the two-dimensional area of the flexible heat generating layer. In other embodiments, the perforations are formed only in one or more segments of the two-dimensional area of the flexible heat generating layer.

Perforations Formed Before or after Silver Layer

In embodiments, the perforations 412 are formed before the silver layer 430 is printed or formed onto the surface of the electrically conductive material 410. In embodiments, the perforations 412 are formed after the silver layer 430 is printed or formed onto the electrically conductive material 410.

Configurations of Perforations

The perforations 412 may be in a shape of a circle, an oval, a triangle, a square, a rectangle, a parallelogram, a rhombus, a trapezoid, a pentagon, a hexagon, an octagon, or any other suitable shapes. In embodiments, the perforations are in a single shape throughout the flexible heat generating layer 410 in the same size or different sizes. In other embodiments, the perforations are in different shapes with similar size or varying sizes on the flexible heat generating layer 410.

Size of Perforations

In embodiments, each individual perforation have a perforation area of about 0.01, 0.1, 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 110, 120, 130, 140, 150, 160, 170, 180, 190, 200, 220, 240, 260, 280, 300, 320, 340, 360, 380, 400, 520, 540, 560, 580, 600, 620, 640, 660, 680, 700, 720, 740, 760, 780, 800, 820, 840, 860, 880, 900, 920, 940, 960, 980, 1000, 1100, 1200, 1300, 1400, 1500, 1600, 1700, 1800, 1900, 2000, 2100, 2200, 2300, 2400, 2500, 2600, 2700, 2800, 3000, 3100, 3200, 3300, 3400, 3500, 3600, 3700, 3800, 3900, 4000, 4100, 4200, 4300, 4400, 4500, 4600, 4700, 4800, 4900, or 5000 $mm^2$. In embodiments, the perforation area is in a range formed by two numbers selected from the numbers listed in the immediately preceding sentence such as between about 0.1 $mm^2$ and about 100 $mm^2$, between about 15 $mm^2$ and about 25 $mm^2$, between about 50 $mm^2$ and about 240 $mm^2$.

In embodiments, the perforations are in cycles each having a diameter in a range between about 0.01 cm and about 10 cm, between about 0.05 cm and about 5 cm, between about 0.1 cm and about 2 cm, between about 0.1 cm and about 1 cm, between about 0.1 cm and about 0.5 cm, or between about 0.2 cm and about 0.4 cm.

In embodiments, the perforations 412 cover about 5%, 10%, 5%, 20%, 30%, 3%, 40%, 45%, 50%, 55%, 60%, 65%, 70%, 75%, 80%, 90% of the surface area of the flexible heat generating layer 410. In embodiments, the perforations cover the surface area of the flexible heat generating layer in a range formed by two numbers selected from the numbers listed in the immediately preceding sentence such as between about 10% and about 50%, between about 20% and about 40%.

Distance Between Perforations

Two adjacent perforations are apart from each other without any intervening perforation or perforation area. The gap between two adjacent perforations can be defined by a distance between the two closest points thereof. The distance between two adjacent perforations are designed to control the flexibility and adjust the electrical conductivity of the flexible heat generating layer. For example, the distance is about 0.1, 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 110, 120, 130, 140, 150, 160, 170, 180, 190, 200, 220, 240, 260, 280, 300, 320, 340, 360, 380, 400, 520, 540, 560, 580, 600, 620, 640, 660, 680, 700, 720, 740, 760, 780, 800, 820, 840, 860, 880, 900, 920, 940, 960, 980, 1000, 1100, 1200, 1300, 1400, 1500, 1600, 1700, 1800, 1900, 2000, 2100, 2200, 2300, 2400, 2500, 2600, 2700, 2800, 3000, 3100, 3200, 3300, 3400, 3500, 3600, 3700, 3800, 3900, 4000, 4100, 4200, 4300, 4400, 4500, 4600, 4700, 4800, 4900, or 5000 mm. In embodiments, the distance is in a range formed by two numbers selected from the numbers listed in the immediately preceding sentence such as between about 0.1 mm and about 100 mm, between about 1 mm and about 50 mm, between about 2 mm and about 20 mm.

Electrically Conductive Material

Electrical Conductivity

In embodiments, the flexible heat generating layer includes or is made of an electrically conductive material for the two-dimensional electroconductive heating. The electrically conductive material has an electrical conductivity in a range of about $1\times10^6$-$1\times10^8$ S/m, or about $2\times10^7$-$7\times10^7$ S/m.

Carbon-Based Composite

In embodiments, the electrically conductive material comprises or is made of a carbon-based composite that is a mixture including a carbon-based filler. In embodiments, in addition to the carbon-based filler, the carbon-based composite may contain a binder. In embodiments, the electrically conductive material may comprise other additives that are electrically conductive or insulating.

Binder

In embodiments, the electrically conductive material is a mixture including one or more binders to put together the components of the carbon-based filler in an integral body of the flexible heat generating layer. The one or more binders to include is selected from a thermoplastic or thermoset polymer including a polyurethane resin, a phenolic resin, an unsaturated fatty acid resin, an epoxy resin, a polyester resin, a silicone rubber and a combination thereof. The viscosity of the binder may vary or be adjusted to a certain level to achieve a desired physical properties including flexibility and bending and folding endurance in the carbon-based composites.

Amount of the Binder

In embodiments, the carbon-based composite comprises a binder and a carbon-based filler. The amount of the binder relative to the total weight of the carbon-based composite is about 5%, about 10%, about 15%, about 20%, about 25%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 55%, about 60%, about 65%, about 70%, about 75%, about 80%, about 85%, or about 90%. In embodiments, amount of the binder relative to the total weight of the carbon-based composite is in a range formed by two numbers selected from the numbers listed in the immediately preceding sentence such as between about 10% and about 70%, between about 30% and about 50%, between about 35% and about 45%. The weight ratio of the binder to the carbon-based filler is about 5:95, about 10:90, about 15:85, about 20:80, about 25:75, about 30:70, about 35:65, about 40:60, about 45:55, about 50:50, about 55:45, about 60:40, about 65:35, about 70:30, about 75:25, about 80:20, about 85:15, about 90:10, or about 95:5. In embodiments, the weight ratio of the binder to the carbon-based filler is in a range formed by two numbers selected from the numbers listed in the immediately preceding sentence such as between about 20:80 and about 60:40, between about 35:65 and about 45:55, or about 40:60.

Polyurethane Resin Binder

In embodiments, the binder comprises or is a polyurethane (PU) resin. It will be appreciated that the generally recognized understanding of the term "polyurethanes" is inclusive of polyurethanes, polyureas, and polyurethane/polyureas. Thus, throughout this disclosure, where the term "polyurethane(s)" is used, it will be with this recognition that the term includes all three of these sub-groups, unless it is clear that the sub-group polyurethane is being discussed. The sub-group polyurethane will be understood to be associated with the use of a polyol (such as a diol or triol) with an isocyanate (such as a diisocyanate or triisocyanate). The sub-group polyurea will be understood to be associated with the use of a polyamine (such as a diamine) with an isocyanate (such as a diisocyanate or triisocyanate). The sub-group of polyurethane/polyurea will be associated with the use of an isocyanate (such as a diisocyanate or triisocyanate) with a monomer having a combination of a —OH group and a —$NH_2$ group. Polyurethane (PU) is one of the most versatile polymers. By changing the type, functionality and ratio of the isocyanate, polyol, and/or polyamine precursors, the final properties of the PU can be tailored, ranging from a rigid solid to a flexible elastomer for different applications. In embodiments, the polyurethane resin is fine tuned to be a flexible elastomer.

In embodiments, the polyurethane resin comprises isocyanate monomers and polyol monomers, and/or partially reacted oligomers of isocyanate monomers and polyol monomers; or is produced by reacting isocyanate monomers with polyol monomers. The reaction between the isocyanate and polyol monomers may be conducted in the presence of a catalyst or upon exposure to ultraviolet light. Both the isocyanate and polyol monomers (precursors) used to make polyurethanes contain, on average, two or more functional groups per molecule. In embodiments, the polyurethane resin is further cured or reacted during mixing and calendering process to form the carbon-based composites. In embodiments, the isocyanate and polyol monomers are present in substantially stoichiometric amounts. In embodiments, the isocyanate monomer is a diisocyanate monomer and the polyol monomer is a diol monomer. In embodiments, the isocyanate monomer is a diisocyanate monomer; and the polyol monomer consists of about 96-99.99 wt. % of a diol monomer and about 0.01-4 wt. % of a triol monomer including glycerol. The presence of the small amount of the triol monomer provides slight crosslinks of the final polyurethane after reaction to provide strong mechanical strength to the polymer. In embodiments, the polyurethane resin is fine tuned to have a viscosity in a range of about 10000 to about 50000 cps, about 12000 to about 25000 cps; about 15000 to about 25000 cps at 25° C., or about 18000 cps at 25° C.

Thermoplastic Polyurethane Resin Binder

In embodiments, the polyurethane resin is a thermoplastic polyurethane (TPU) resin. The TPU resin comprises diisocyanates, diols and/or partially reacted oligomers of diisocyanates and diols; or is formed by the reaction of the diisocyanates with the diols. The diols include short-chain diols (so called chain-extenders) and long-chain diols. The thermoplastic polyurethane resin may be further cured or reacted during the manufacturing process to form the carbon-based composites. The formed TPU polymer after reaction is a linear block copolymer consisting of alternating sequences of high polarity hard segments and low polarity soft segments. The hard and sift segments of the TPU may phase separate due to their significantly different polarities. By varying the ratio, structure and/or molecular weight of the reaction precursors (diisocyanates and diols), a variety of different TPU with desired final properties can be produced for the needs of different applications of the present disclosure. In embodiments, the thermoplastic polyurethane resin is fine tuned to be a flexible elastomer. In embodiments, the TPU resin is fine tuned to have a viscosity in a range of about 10000 to about 50000 cps, about 12000 to about 25000 cps; about 15000 to about 25000 cps, or about 18000 cps at 25° C.

Viscosity of the Polyurethane Resin

As detailed in Examples 1, 2, 4 and 8 of the present disclosure, when the viscosity of the polyurethane resin is fine tuned to be 18000 cps (Test Sample 1) and 15000 cps (Test Sample 2) at 25° C., the resulted carbon-based composite has good flexibility, bending strength and folding endurance. As shown in Table 1, the experimental results demonstrated that Test Samples 1 and 2 made of the polyurethane resin having viscosity within the desired range have no bending or folding marks on the surface of the test samples and no breakage of the test samples after the bending and folding tests. In contrast, when the viscosity of the polyurethane is 5000 cps at 25° C. (Control Sample 1), the resulted carbon-based composite has poor performance in both the bending and folding tests. As shown in Table 1, the experimental results demonstrated that Control Sample 1 made of the polyurethane resin having viscosity below the desired range has obvious bending or folding marks on the surface of the control samples and also some breakage of the control samples after the bending and folding tests.

Carbon-Based Fillers

In embodiments, the carbon-based filler includes two or more selected from the group consisting of carbon black particles, carbon nanotubes, carbon nanofibers, graphene, reduced graphite oxide, expanded graphite, and nano diamond. In some embodiments, the carbon-based filler includes carbon black particles, carbon nanotubes, and at least one of graphene, expanded graphite and reduced graphene oxide. In some embodiments, the carbon-based filler includes carbon black particles, carbon nanotubes, and graphene. In some embodiments, the carbon black particles are carbon black nanoparticles. In embodiments, the carbon-based filler may further include carbon nanofibers. In embodiments, the carbon-based filler may further include nano diamond.

Amount of Carbon-Based Filler

In embodiments, the amount of the carbon-based filler in the electrically conductive material may vary or be adjusted to accomplish a desired surface resistivity. In embodiments, the electrically conductive material contains the carbon-based filler in an amount of about 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94 or 95% of the total weight of the electrically conductive material for the flexible heat generating. In embodiments, the carbon-based filler's amount relative to the total weight of the electrically conductive material is in a range formed by and between any two of the numbers listed in the immediately preceding sentence, e.g., between about 20% and about 90%, between about 30% and about 90%, between about 40% and about 85%, between about 50% and about 80%, between about 55% and about 70%, or about 60%.

Graphene

Graphene is an allotrope of carbon consisting of a single layer of atoms arranged in a two-dimensional honeycomb lattice nanostructure with numerous carbon-carbon double bonds. Each atom in a graphene sheet is connected to its three nearest neighbors by a σ-bond, and contributes one electron to a conduction band that extends over the whole sheet. This is the same type of bonding seen in carbon nanotubes. Graphene has become a valuable and useful nanomaterial due to its exceptionally high tensile strength, electrical conductivity as high as $10^8$ S/m, thermal conductivity up to 5300 $W \cdot m^{-1} \cdot K^{-1}$ at room temperature, transparency, and being the thinnest two-dimensional material in the world. The thermal conductivities of more scalable and more defected graphene derived by Chemical Vapor Deposition (CVD) have been reported in a wide range between 1500-2500 $W \cdot m^{-1} \cdot K^{-1}$ for suspended single layer graphene. In addition, it is known that when single-layer graphene is supported on an amorphous material, the thermal conductivity is reduced to about 500-600 $W \cdot m^{-1} \cdot K^{-1}$ at room temperature as a result of scattering of graphene lattice waves by the substrate, and can be even lower for few layer graphene encased in amorphous oxide.

Properties of Graphene

In embodiments, the carbon composite comprises the graphene. The graphene has an electrical conductivity of $10^4$ to $10^8$ S/m, or $10^5$ to $10^7$ S/m; and a thermal conductivity of 500-3000 $W \cdot m^{-1} \cdot K^{-1}$. In embodiments, the graphene may comprise small amount of functional groups such as hydroxyl groups which can react with the NCO group of the isocyanate in the polyurethane to improve the bonding of the graphene to the polyurethane resin and thus improve the mechanical properties of the electrically conductive composite. In embodiments, the hydroxyl groups is present in an amount of about 0.001-1 wt. %, or about 0.01-0.1 wt. % of the graphene.

Dimensions of Graphene

In embodiments, the graphene of the present disclosure has a lateral dimension of about 0.01 μm, about 0.05 μm, about 0.1 μm, about 1 μm, about 2 μm, about 3 μm, about 4 μm, about 5 μm, about 6 μm, about 7 μm, about 8 μm, about 9 μm, about 10 μm, about 11 μm, about 12 μm, about 13 μm, about 14 μm, about 15 μm, about 16 μm, about 17 μm, about 18 μm, about 19 μm, about 20 μm or about 30 μm. In embodiments, the graphene has a lateral dimension in a range formed by and between any two of the numbers listed in the immediately preceding sentence, e.g., between about 0.01 and 100 μm, between about 0.05 and 20 μm, between about 0.1 and about 10 μm, between about 1 and about 10 μm, between about 3 and about 8 μm, between about 0.1 and about 1 μm, between about 0.1 and about 0.5 μm, between about 6 and 7 μm.

In embodiments, the graphene has an average thickness of about 1 nm, about 2 nm, about 3 nm, about 4 nm, about 5 nm, about 6 nm, about 7 nm, about 8 nm, about 9 nm, about 10 nm, about 11 nm, about 12 nm, about 13 nm, about 14 nm, about 15 nm, about 16 nm, about 17 nm, about 18 nm, about 19 nm, about 20 nm, about 25 nm, or about 30 nm. In embodiments, the average thickness of the graphene is in a range formed by and between any two of the numbers listed in the immediately preceding sentence, e.g., between about 1 and about 20 nm, between about 1 and 10 nm, between about 1 and about 5 nm, between about 2 and about 3 nm.

Carbon Nanotubes

Carbon nanotubes (CNTs) include single-wall carbon nanotubes (SWCNTs) and multi-wall carbon nanotubes (MWCNTs). Single-wall carbon nanotubes (SWCNTs) have diameters in the range of about 1 nm. Multi-wall carbon nanotubes (MWCNTs) include double- and triple-wall carbon nanotubes. Double-wall carbon nanotubes (DWCNTs) form a special class of nanotubes because their morphology and properties are similar to those of SWCNTs but they are more resistant to attacks by chemicals. Unlike graphene, which is a two-dimensional semimetal, carbon nanotubes are either metallic or semiconducting along the tubular axis. The pure carbon nanotubes have an electrically conductivity as high as $10^6$ to $10^7$ S/m as compared to $10^8$ S/m for pure graphene.

Properties of Carbon Nanotubes

The multi-wall carbon nanotubes have an electrical conductivity in a range of $10^4$ to $10^7$ S/m. In embodiments, the carbon nanotubes are double- and/or triple-wall carbon nanotubes having an average diameter of about 2-5 nm and electrical conductivity of about $10^5$ to $10^8$ S/m or $10^6$ to $10^8$ S/m.

Diameter of Carbon Nanotubes

In embodiments, the carbon nanotubes have an average diameter of about 1 nm, about 2 nm, about 3 nm, about 4 nm, about 5 nm, about 10 nm, about 11 nm, about 12 nm, about 13 nm, about 14 nm, about 15 nm, about 16 nm, about 17 nm, about 18 nm, about 19 nm, about 20 nm, about 25 nm, about 30 nm, about 35 nm, about 40 nm, about 45 nm, about 50 nm, about 55 nm, about 60 nm, about 65 nm, about 70 nm, about 75 nm, about 80 nm, about 85 nm, about 90 nm, about 95 nm, or about 100 nm. In embodiments, the carbon nanotubes have an average diameter in a range formed by and between any two of the numbers listed in the immediately preceding sentence, e.g., between about 1 and about 100 nm, between about 2 and about 5 nm, about 10 and about 20 nm, between about 12 and about 16 nm. In embodiments, the carbon nanotubes include double-wall carbon nanotubes and triple-wall carbon nanotubes having an average diameter of about 2-3 nm.

Length of Carbon Nanotubes

In embodiments, the carbon nanotubes have an average length of about 1 μm, about 5 μm, about 10 μm, about 15 μm, about 20 μm, about 25 μm, about 30 μm, about 35 μm, about 40 μm, about 45 μm, about 50 μm, about 55 μm, about 60 μm, about 65 μm, about 70 μm, about 75 μm, about 80 μm, about 85 μm, about 90 μm, about 95 μm, about 100 μm, about 110 μm, about 120 μm, about 150 μm, about 200 μm, about 250 μm, about 300 μm, about 350 μm, about 400 μm, about 450 μm, or about 500 μm. In embodiments, the carbon nanotubes have an average length in a range formed by and between any two of the numbers listed in the immediately preceding sentence, e.g., between about 1 and about 500 μm, between about 10 and about 100 μm, between about 50 and about 100 μm, between about 60 and about 90 μm, between about 70 and about 80 μm.

Carbon Black Particles

In embodiments, the carbon black particles are electrically conductive grades of carbon black particles such as Vulcan XC-72 carbon black, Acetylene carbon black, and Ketjenblack EC300J and EC600JD; or active carbon black. The specific surface areas of typical conductive carbon blacks are shown in Table. 1 below.

TABLE 1

Specific surface areas of typical conductive carbon blacks.

| | Surface area ($m^2$/g) | | DBPA |
|---|---|---|---|
| Carbon Black | $N_2$ | CTAB | ($cm^2$/100 g) |
| Vulcan XC-72 | 180 | 86 | 178 |
| Acetylene | 70 | 78 | 250 |
| Ketjenblack EC | 929 | 480 | 350 |

Size of Carbon Black Particles

In embodiments, the carbon black particles have an average diameter of about 1 nm, about 2 nm, about 3 nm, about 4 nm, about 5 nm, about 10 nm, about 15 nm, about 20 nm, about 25 nm, about 30 nm, about 35 nm, about 40 nm, about 45 nm, about 50 nm, about 55 nm, about 60 nm, about 65 nm, about 70 nm, about 75 nm, about 80 nm, about 85 nm, about 90 nm, about 95 nm, about 100 nm, about 110 nm, or about 150 nm. In embodiments, the carbon black particles have an average diameter in a range formed by and between any two of the numbers listed in the immediately preceding sentence, e.g., between about 1 and about 150 nm, between about 1 and about 100 nm, between about 10 and about 100 nm, between about 10 and about 90 nm, between about 20 and about 90 nm, between about 10 and about 80 nm, between about 30 and about 80 nm.

In embodiments, the carbon black particles have an average diameter in a range from about 1 nm to about 100 nm, or from about 10 nm to about 80 nm. The particle size of the carbon black particles may have some impact in the physical property of the flexible heat generating layer. As shown in Examples 1, 3, 5 and 8, the experimental results in Table 1 demonstrated that when the carbon black particles have an average diameter of 50 nm (Test Sample 1) and 80 nm (Test Sample 3) within the desired range, there were no bending or folding marks and no breakage of the samples after the bending and fold tests, indicating that the resulted electrically conductive materials have good flexibility, and good bending and folding performances. However, the experimental results in Table 1 demonstrated that when the carbon black particles have an average diameter of 200 nm (Control Sample 2) outside the desired range, there were obvious bending and folding marks on the surface of Control Sample 2, and also some breakage of the sample after the bending and folding tests, indicating that the resulted electrically conductive material has poor flexibility, poor bending strength, and poor folding endurance.

Surface Resistivity

In embodiments, the carbon-based composite has a surface resistivity of about 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 210, 220, 230, 240, 20, 260, 270, 280, 290, 300, 320, 340, 360, 380, or 400 milliohms·cm (mΩ·cm). In embodiments, the surface resistivity is in a range formed by two numbers selected from the numbers listed in the immediately preceding sentence such as between about 0.1 mΩ·cm and about 100 mΩ·cm, between about 1 mΩ·cm and about 50 mΩ·cm, between about 2 mΩ·cm and about 200 mΩ·cm.

Morphology of the Carbon-Based Composite

In embodiments, the carbon-based composite comprises a binder, and carbon-based fillers including carbon black particles, carbon nanotubes and graphene. In embodiments, the carbon-based fillers are generally well dispersed in the binder. In embodiments, the carbon-based filler including carbon black particles, carbon nanotubes, and graphene provides a unique morphology, in which graphene pieces are like two dimensional plates, carbon nanotubes are like one dimensional (straight or curved) strings, and carbon black particles are like particles.

Forming Electrically Conductive Pathways

Figure 4F:
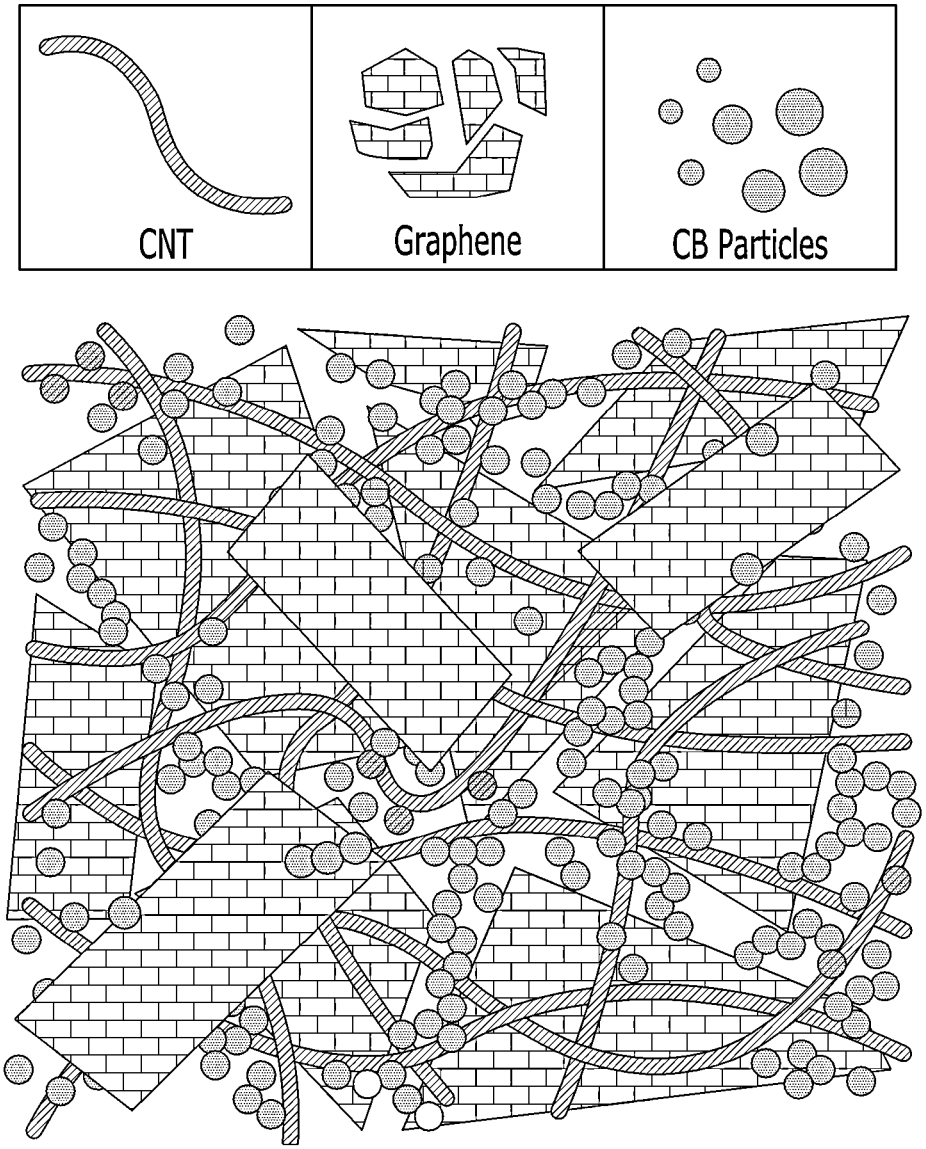
FIG. 4F schematically illustrates the morphology of the carbon-based composite comprising carbon black (CB) particles, carbon nanotubes (CNT) and graphene in some embodiments according to the present disclosure.

Some carbon nanotubes electrically bridge between carbon black particles, graphene pieces, other carbon nanotubes by contacting two or more of carbon black particles, graphene pieces, other carbon nanotubes. Some graphene pieces electrically bridge carbon black particles, carbon nanotubes and other graphene pieces by contacting two or more of them. The unique morphology of the carbon-based fillers including carbon black particles, carbon nanotubes and graphene has the advantages by forming electrically conductive pathways throughout the carbon-based composite and electrically conductive material. The electrically conductive pathways formed between the carbon black particles, carbon nanotubes and graphene in the carbon-based composite are schematically illustrated in FIG. 4F. Furthermore, some the carbon black particles, carbon nanotubes and graphene in the carbon-based composites are close enough to each other even they do not contact each other, so that the electrons can hop between the different carbon-based fillers. FIG. 4F is drawn to show the concept of the morphology and the electrical conductive pathways of the carbon-based composite comprising carbon black particles, carbon nanotubes and graphene. The particle size, diameter, lateral dimensional size, thickness, or size ratio of the carbon black particles, the carbon nanotubes and graphene are not drawn to reflect those parameters of three carbon-based fillers in reality. The graphene may have different shapes and orientations in the carbon-based composite.

Morphology of the Carbon-Based Polyurethane Composite

In embodiments, the carbon-based composite comprises a binder including a polyurethane resin; and carbon-based fillers including carbon black particles, carbon nanotubes and graphene. The polyurethane resin may be a thermoplastic polyurethane (TPU) resin having hard segments with high polarity and soft segments with low polarity. In embodiments, the TPU resin is fine tuned to be a flexible elastomer having a viscosity in a range of about 10000 to about 50000 cps, about 12000 to about 25000 cps; about 15000 to about 25000 cps, or about 18000 cps at 25° C. Applicant found that the phase separation of the hard and soft segments of the TPU facilitates the formation of the electrical conductive pathways in the carbon-based composites. The carbon-based composite comprising the TPU resin achieves higher electrical conductivity at the same amount of the same carbon-based fillers as compared to other polymeric resins.

Weight Ratios of the Carbon-Based Fillers

In embodiments, the carbon-based composite comprises a binder and carbon-based fillers including carbon black particles, carbon nanotubes and graphene. In some embodiments, the amount of the carbon black particles relative to the total weight of the carbon-based filler is in a range from about 10% to about 60%, from about 15% to about 50%, from about 15% to about 25%, or about 20%. The amount of the carbon nanotubes relative to the total weight of the carbon-based filler is in a range from about 10% to about 70%, from about 20% to about 60%, from about 40% to about 55%, or about 50%. The amount of the graphene relative to the total weight of the carbon-based filler is in a range from about 10% to about 50%, from about 20% to about 40%, from about 25% to about 45%, or about 30%. In embodiments, the weight ratios of the carbon black particles to carbon nanotubes to graphene are in a range of about 0.5-3:1-4:0.5-3; about 0.5-1.5:2-3:1-2; or about 1:2.5:1.5.

As detailed in Examples 1, 6 and 8, the experimental results in Table 1 demonstrate that when the carbon black particles to carbon nanotubes to graphene ratios is 1:2.5:1.5 (Test Sample 1) within the desired range, the resulted carbon-based composite exhibits good flexibility and bending and folding performances. There are no bending or folding marks on the surface of the test samples and also no breakage of the test samples after the bending and folding tests. In contrast, when the carbon black particles to carbon nanotubes to graphene ratios is 3.5:2.5:5 (Control Sample 3) outside the desired range, the resulted carbon-based composite exhibits poor flexibility and poor bending and folding performances. There are obvious bending or folding marks on the surface of the control samples and some breakage of the control samples after the bending and folding tests.

In embodiments, the carbon-based composite comprises three carbon-based fillers of carbon black particles, carbon nanotube and graphene. This carbon-based composite having three carbon-based fillers has advantages over composites having carbon black alone, composites having carbon nanotube alone, composites having graphene alone. The three different carbon-based fillers can form multiple electrically conductive pathways between different fillers and thus have synergistic effects in enhancing the electrical conductivity. The one-dimensional carbon nanotubes can electrically bridge between carbon black particles, between graphene particles, and between carbon black particles and graphene. Similarly, the two-dimensional graphene can electrically bridge between carbon black particles, between carbon nanotubes, and between carbon black particles and carbon nanotubes.

Although carbon nanotubes and graphene each have high electrical and thermal conductivity, carbon nanotubes and graphene are each very difficult to be dispersed evenly and homogeneously in the binders and thus can not be incorporated into a composite in high loading levels to achieve the desired electrical and thermal conductivities. In order to achieve a desired electrical conductivity, high loadings of carbon nanotubes alone need to be incorporated into the composite. However, carbon nanotubes tend to entangle with each other during mixing of the composite which leads to very poor dispersion of the carbon nanotubes in the composite and thus poor mechanical properties of the composite. Similarly, graphene also has the tendency to stack with each other and are difficult to be dispersed evenly and homogeneously in the composite. Therefore, a composite with high loading levels of graphene alone would lead to poor mechanical properties. Further, it is difficult to form electrical conductive pathways between carbon black particles. Thus, composites having carbon black particles alone need high loading levels of carbon black particles to achieve the desired electrical conductive pathways to obtain the desired electrical conductivity. High loading levels of carbon nanotubes would lead to very poor mechanical properties.

The carbon-based composite having three carbon-based fillers of the present disclosure also has advantages over composites having two carbon-based fillers selected from carbon black particles, carbon nanotubes and graphene.

Other Ingredients in the Carbon-Based Composites

In embodiments, the carbon-based composite may comprise one or more additional conductive or insulative ingredients, such as intrinsically conductive polymers, reduced graphite oxide, expanded graphite, and other ingredients. In embodiments, the carbon-based composite comprise reduced graphite oxide or expanded graphite having a thickness less than about 100 nm, less than about 50 nm, less than about 30 nm, less than about 20 nm, less than about 10 nm, between about 1 nm to about 100 nm, between about 1 nm to about 50 nm, or between about 1 nm to about 20 nm.

Intrinsically Conductive Polymers:

In embodiments, the electrically conductive material may include an intrinsically conductive polymer (ICP). In embodiments, the electrically conductive material comprises or is made of the carbon-based composite. The carbon-based composite may comprise other additives, such as an intrinsically conductive polymer. As used herein, the term "a conductive polymer" or "an intrinsically conductive polymer (ICP)" shall refer to an organic polymer that conducts electricity. An example of the ICP is halogen doped polyacetylene (PAC), a conjugated organic polymer, having high electrical conductivity when oxidized by halogen, so-called "doping". A key property of PAC is the presence of conjugated double bonds along the backbone of the polymer chain. In conjugation, the bonds between the carbon atoms are alternately single and double. Every bond contains a localised "sigma" ($\sigma$) bond which forms a strong chemical bond. Every double bond contains a less strongly localised "pi" ($\pi t$) bond which is weaker. However, conjugation is not enough to make the polymer conductive because orbitals are filled—no conduction because no "holes". Therefore, doping of the conjugated polymers is necessary to gain conductivity. Charge transport in doped conductive polymers is believed to occur through a combination of two primary mechanisms, propagation of charge along the polymer chain, and hopping between neighboring chains. High level of doping is necessary for high charge carrier mobility. Consequently, charge carrier can hop between different polymer chains, named an intermolecular charge transfer reaction. Because the interchain electron transfer interactions of conjugated polymers are relatively strong compared with the Van der waals and hydrogen bonding interchain interactions typical of saturated polymers, conductive polymers tend to be insoluble and infusible. Thus the processability of intrinsically conductive polymers is proven to be difficult.

Other Conductive Polymers

The electrically conductive material may include other conductive polymers that contain a number of conjugated hydrocarbon and aromatic heterocyclic polymers, such as poly(p-phenylene) (PPP), poly(p-phenylene vinylene) (PPV), poly((pphenylene sulfide) (PPS), polyaniline (PAM), polypyrrole (PPy), and polythiophene (PT), preferably in their doped forms respectively.

Other Additives

In embodiments, the carbon-based composite may comprise other additives, such as an intrinsically conductive polymer selected from the group consisting of halogen doped polyacetylene (PAC), poly(p-phenylene) PPP), poly (p-phenylene vinylene) (PPV), poly((pphenylene sulfide) (PPS), polyaniline (PAM), polypyrrole (PPy), polythiophene (PT), or combinations thereof, preferably in the doped forms respectively. In embodiments, the intrinsically conductive polymer is in a form of particles having an average particle size of about 1 nm-1 μm, about 1-100 nm, about 1-50 nm, or about 1-30 nm.

Making Carbon-Based Composite

In embodiments, the carbon-based composite is manufactured using a process. The process comprises blending the binder and the carbon-based filler components discussed herein above; heating the blends to a temperature to melt the binder; mixing the binder and the carbon-based fillers to form a homogeneous mixture; and forming a thin film of the carbon-based composite having a desired thickness in a range of about 0.1-200 μm, about 1-100 μm, or about 40-80 μm.

In embodiments, forming the thin film of the carbon-based composite is conducted by calendering and drawing in a calender; roll-milling in a rolling mill; or compression molding in a compression molding machine. In embodiments, the forming the thin film of the carbon-based composite is conducted by calendering in a calender and drawing to form the thin film. In embodiments, mixing the binder the carbon-based fillers are also conducted on the calender.

In embodiments, mixing the binder and the carbon-based fillers and forming the thin film of the carbon-based composite are conducted by roll-milling the mixture in the rolling mill to form a thin film of the carbon-based composite. In embodiments, the rolling mill is a two-roll mill, a three-roll mill, a four-roll mill, a multi-roll mill, a cluster rolling mill; or a universal roll mill. In embodiments, the rolling mill is a two-roll mill.

In embodiments, the process comprises adding the binder to a mixer, heating the binder to a temperature to melt the binder; adding the carbon-based fillers gradually to the melted binder and mixing the carbon-based fillers with the binder while adding; further mixing the carbon-based fillers and the binder to form a homogeneous mixture and the carbon-based fillers being well dispersed in the binder; and forming a thin film having a desired thickness. In embodiments, forming the thin film is conducted by calendering in a calender. In embodiments, the mixer is a calender and the whole process is conducted in the calender.

In embodiments, the desired thickness of the carbon-based composite film is in a range of about 0.1-200 μm, about 1-100 μm, or about 40-80 μm. In embodiments, the forming of the thin film of the carbon-based composite is conducted by compression molding in a compression molding machine; or by rolling milling in a rolling mill including a two-roll mill, a three-roll mill, a four-roll mill, a multi-roll mill, a cluster rolling mill; or a universal roll mill. In embodiments, the rolling mill is a two-roll mill.

Flexible Substrate Layer

The present disclosure provides a flexible heating pad comprising a flexible substrate layer. The flexible substrate layer is at least one of a fabric layer, a flexible silicone gel layer and a heat storage material layer.

Fabric Layer

A fabric layer is made of a fabric. A fabric is a flexible material made by creating an interlocking bundles of yarns or threads, which are produced by spinning raw fibers (from either natural or synthetic sources) into long and twisted lengths. The fabric used in the fabric layer is one of natural fabrics such as silk, wool, cotton, flux, and bamboo; or one of synthetic fabrics such as nylon, polyester, acrylic and rayon. The fabric may be further treated to be a water-repellant fabric, a water resistant fabric, or a waterproof fabric to increase the water repellency for different weather conditions and to improve water washability. The selection of the type of fabric as the flexible substrate layer depends on the application of the flexible heating device.

Water Repellent Fabric

In embodiments, the fabric is a water repellant fabric made by treating a natural or synthetic fabric with a durable water repellent (DWR) to form a thin layer of DWR on the surface of the fabric. In embodiments, the DWR is a specifically manufactured chemical such as a fluoropolymer and reduces the surface tension of the fabric. When the DWR is applied to the surface of the fabric to from a thin coating, the fabric becomes to repel water so that water simply rolls off the fabric. A water-repellent fabric means that the fabric is hydrophobic, or repels water on contact. A feature of water-resistant and waterproof fabrics, water repellency measures how much water pressure a material can withstand before amounts of water begins to permeate. In embodiments, the water repellant fabric is able to withstand a water pressure of at least about 500 mm, at least about 1,500 mm, or between about 1,500 mm to about 5,000 mm, according to the Hydrostatic Head Test (abbreviated as HH). The test procedures include placing a double open-ended cylinder on top of a DWR treated fabric; gradually filling water; measuring and recording the maximum height of water in millimeters (mm) filled in the cylinder that the fabric can withstand before permeation (or liquid penetration) occurs. The higher the number, the better the water repellency of the DWR treated fabric.

Water Resistant Fabric

In embodiments, the fabric is water resistant fabric made by treating a fabric with a durable water repellent (DWR) to specifically resist contact by light water (rain showers/light rain and snow flurries) but are not designed to withstand any heavy water exposure to the elements. In embodiments, the water-resistant fabric is able to withstand a water pressure of at least about 1,500 mm or more, according to the Hydrostatic Head Test (abbreviated as HH). The higher the number, the better the quality of waterproofness. In embodiments, the water-resistant fabric is able to withstand a water pressure of at least 1,500 mm, such as between about 1,500 mm to about 5,000 mm to be used in light to average weather conditions such as rain showers and light snow dustings; and about 5,000 mm to about 10,000 mm to be used in moderate weather conditions such as steady rain and snowfall.

Waterproof Fabric

In embodiments, the fabric is a waterproof fabric made by treating a natural or synthetic fabric with a durable water repellent (DWR) coating or laminate to ensure high-grade water repellency to withstand a water pressure of at least 10,000 mm, according to the Hydrostatic Head Test. The fabric layer made of a waterproof fabric has significantly high water repellency and good water washability. In embodiments, the waterproof fabric can withstand water-washing for at least 50 times, at least 60 time, at least 70 time, at least 80 time, at least 90 times, or at least 100 times as measured according to the GB/T 13769-2009 and GB/T8629-2017 Standards. In embodiments, the fabric may be a waterproof breathable fabric. The waterproof breathable fabric may be composed of stretched polytetrafluoroethylene (PTFE) or expanded PTFE (ePTFE). The waterproof breathable fabric is lightweight and waterproof for all weather uses and can withstand water-washing cycles for at least 50 times, at least 60 time, at least 70 time, at least 80 time, at least 90 times, or at least 100 time. One example of the waterproof breathable fabric is Gore-Tex fabric. In embodiments, the fabric is a waterproof breathable fabric optionally further treated with a DWR such as a fluoropolymer to enhance the water repellency to withstand a water pressure of at least 20,000 mm. The waterproof breathable fabric has high water repellency to withstand a water pressure of at least 10,000 mm, at least 20,000 mm, at least 30,000 mm, about 10,000 mm to about 40,000 mm, or more than 40,000 mm, according to the Hydrostatic Head Test. The fabric layer made of the waterproof fabric can be used in extreme weather conditions such as heavy rain and snowstorms and have good water-washability. In embodiments, the fabric layer made of the treated waterproof breathable fabric having a high water repellency and is capable of withstanding a water pressure of at least 10,000 mm, about 10,000 mm to about 40,000 mm, or more than 40,000 mm, according to the Hydrostatic Head Test; and is further capable of withstanding more than 100 times of water washing cycles as measured according to the GB/T 13769-2009 and GB/T8629-2017 Standards.

Flexible Silicone Gel Layer

In embodiments, the flexible substrate layer is a flexible silicone gel layer comprising or being made of a silicone gel. A silicone gel or polysiloxane gel is a polymer made up of siloxane ($—R_2Si—O—SiR_2—$, where R=organic group) and is a colorless rubber-like substance. The silicone gel is typically flexible. The silicone gel can be formulated to be electrically insulative or conductive, making it suitable for a wide range of electrical applications. The flexible silicone gel has low toxicity; good thermal stability, for example, having constancy of properties over a wide temperature range of −100 to 250° C.; does not support microbiological growth; is resistant to oxygen, ozone, and ultraviolet (UV) light; and has high gas permeability, for example, at room temperature (25° C.), the permeability of silicone gel or rubber for such gases as oxygen is approximately 400 times that of butyl rubber. These properties make silicone gel useful for medical applications in which increased aeration is desired. The silicone gel or rubber can be developed into rubber sheeting, where it has other properties, such as being FDA compliant. This extends the uses of silicone sheeting to industries that demand hygiene, for example, food and beverage, pharmaceuticals and medical applications. In embodiments, the fabric layer is made of a flexible silicone gel. In embodiments, the flexible heating device including a flexible medical heating pad comprising the flexible silicone gel for use under a patient to keep the patient warm during a surgery, a ICU care, or other medical conditions.

Flexible Heat Storage Material Layer

In embodiments, the flexible substrate layer is a flexible heat storage material layer comprising or being made of a heat storage material or a flexible heat storage material. In embodiments, the heat storage material includes eutectic materials and phase-change materials. In embodiments, the heat storage material is enclosed or encapsulated in an elastic shell or a flexible polymer film. In embodiments, the flexible polymer film may be selected from polyethylene, polypropylene, EVOH, Nylon, fluorinated PE, fluonnated PP, PTFE, a fluonnated polymer, coextruded PE/Nylon, PP/Nylon, PE/EVOH and PP/EVOH. In some applications, especially when incorporation to textiles is required, the eutectic material is micro-encapsulated. Micro-encapsulation allows the eutectic material to remain solid, in the form of small bubbles, when the eutectic material core has melted. The heat transfer enhancement using a flexible heat storage material such as an eutectic material or a phase change material has the advantages of reducing the cost and bulkiness of the flexible heating device, and further precisely controlling the temperature at the desired range for different applications.

Eutectic Materials

Figure 5:
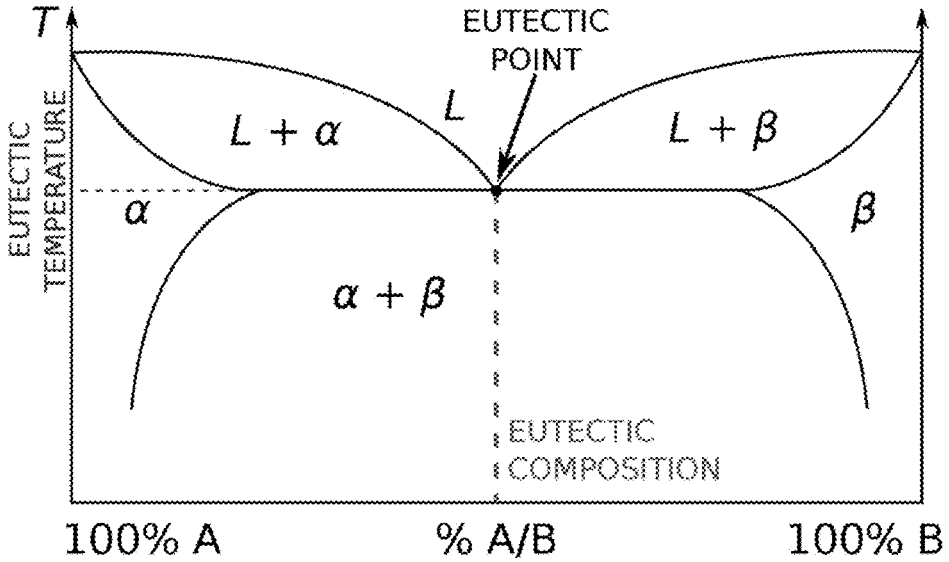
FIG. 5 illustrates a typical phase diagram of a fictitious binary chemical mixture (with the two components denoted by A and B) used to depict the eutectic composition, temperature, and point (L denotes the liquid state).

The eutectic material or system is a heterogeneous mixture of substances that melts or solidifies at a single temperature that is lower than the melting point of any of the constituents. This temperature is known as the eutectic temperature, and is the lowest possible melting temperature over all of the mixing ratios for the involved component species. On a phase diagram, the eutectic temperature is seen as the eutectic point as shown in FIG. 5. Non-eutectic mixture ratios would have different melting temperatures for their different constituents, since one component's lattice will melt at a lower temperature than the other's. Conversely, as a non-eutectic mixture cools down, each of its components would solidify (form a lattice) at a different temperature, until the entire mass is solid. Non-eutectic mixture ratios would have different melting temperatures for their different constituents, since one component's lattice will melt at a lower temperature than the other's. Conversely, as a non-eutectic mixture cools down, each of its components would solidify (form a lattice) at a different temperature, until the entire mass is solid. Not all binary alloys have eutectic points, since the valence electrons of the component species are not always compatible, in any mixing ratio, to form a new type of joint crystal lattice.

Compositions of Eutectic Materials

In embodiments, the eutectic material comprises a first component and a second component. In embodiments, the first component comprises a hydrogen bond donor and the second component comprises an organic salt. In embodiments, the hydrogen bond donor comprises at least one of a substituted or unsubstituted urea, thiourea, or biuret; an amide; a glycerol; a glycol; a metal salt hydrate; a carboxylic acid; and a di-, tri-, or poly-carboxylic acid. In embodiments, the hydrogen bond donor comprises at least one of 1-methylurea, 1,1-dimethylurea, 1,3-dimethylurea, 1-phenyl urea, acetamide, benzamide, ethylene glycol, polyethylene glycols, citric acid, oxalic acid, malonic acid, succinic acid, adipic acid, and an amino acid. In embodiments, the organic salt comprises at least one of a substituted or unsubstituted choline halide, betaine monohydrate, quaternary ammonium, an imidazolium- and pyridinium-based salt, a phosphonium or sulfonium salt, such as tetraphenylphosphonium chloride, octyldiphenylphoshonium bromide, benzylhexyldiphenylphosphonium chloride, and the like. In embodiments, the organic salt comprises at least one of choline chloride; choline bromide; acetylcholine chloride, betaine monohydrate, quaternary ammonium, a phosphonium or sulfonium salt represented by $R_4^+X^-$ and $R_4P^+X^-$, wherein R represents an organic radical, and wherein the organic radicals in any given molecule may be the same or different, and wherein $X^-$ represents a halide ion such as a chloride, bromide, or iodide ion. In embodiments, the organic radical is an alkyl, a cycloalkyl, or an aryl. In embodiments, the first component comprises urea and the second component comprises betaine monohydrate. In embodiments, the molar ratio of the first component to the second component is from about 20:1 to about 1:20, from about 10:1 to about 1:10, from about 5:1 to about 1:5, from about 2:1 to about 1:2, from about 2:1 to about 1:1, or about 3:2. In embodiments, the eutectic material may further comprises at least one additive, and wherein the identity and concentration of the at least one additive is selected to raise or lower one or both of the first and second temperature thresholds. In embodiments, the additive is a hydrogen bond donor, which can be any suitable hydrogen bond donor described herein, such as at least one of a substituted or unsubstituted urea, thiourea, or biuret; an amide; a glycerol; a glycol; a metal salt hydrate; a carboxylic acid; and a di-, tri-, or poly-carboxylic acid. In embodiments, the molar ratio of the at least one additive relative to the rest of the eutectic material is from about 10:1 to about 1:40, from about 3:1 to about 1:40, from about 2:1 to about 1:30, from about 1:1 to about 1:20, from about 1:2 to about 1:15, or from about 1:5 to about 1:14.

Properties of Eutectic Materials

In embodiments, the eutectic material exhibits a first characteristic when exposed to a high temperature at or above a first temperature threshold and maintains the first characteristic when subsequently exposed to a middle temperature between the first temperature threshold and a second temperature threshold at least about 10° C. lower than the first temperature threshold; and the eutectic material exhibits a second characteristic when exposed to a low temperature at or below the second temperature threshold and maintains the second characteristic when subsequently exposed to the middle temperature between the first temperature threshold and the second temperature threshold. In embodiments, the difference between the first and second temperature thresholds is about 1° C., between 1° C. and 5° C., at least about 5° C., at least about 10° C., at least about 15° C., at least about 20° C., at least about 25° C., at least about 30° C., at least about 35° C., at least about 40° C., at least about 45° C., or at least about 50° C. In embodiments, the first characteristic is that the eutectic material is in a liquid form, and the second characteristic is that the eutectic material is in a solid form, Non-Limiting Example of Flexible Substrate Layer Comprising or Made of Eutectic Materials In embodiments, the flexible heating device is a temperature control container/package/clothes having a flexible substrate layer including or being made of the eutectic material. The flexible heating device can control the temperature of the container/package/clothes at a constant temperature for a predetermined time. A non-limiting example of the flexible heating device may be a temperature control container to keep a subject inside the container at a constant temperature for a predetermined time. The subject may be a food product, a medicine, a vaccine, or an electronic device which is sensitive to temperature changes. For example, in order to transport a vaccine or a medicine in a cold climate and the vaccine or medicine is sensitive to temperature changes and must be keep at a narrow temperature range. In embodiments, the flexible heating device (container) is preheated or cooled to a desired temperature above the first threshold temperature and becomes to be a liquid. The subject such as the vaccine is then stored in the container for transportation. The flexible heating device is then configured to keep the container at a constant temperature of the desired temperature for a predetermined time for the transportation. When the temperature drops, the eutectic material will go through a phase change and release the latent heat energy to keep the container temperature constant. The flexible heating device further generate heat to keep the container temperature constant. In embodiments, the desired storage temperature range for the subject such as the vaccine or the medicine is between the first and the second threshold temperatures, at around the first threshold temperature plus and minus 5° C. In embodiments, if the vaccine has a desired storage temperature range of about 2-8° C. Then the eutectic material is formulated to have a first threshold temperature (melting temperature) of about 6° C. and a second threshold temperature (solidifying temperature) of about 4° C. The flexible heating device/container is first set at the temperature of about 6-8° C. for transporting the vaccine in the cold climate. The eutectic material is first in a liquid form. When the temperature drops to 4° C., then the eutectic material begins phase changing from liquid to solid and then releasing the latent stored heat energy to keep the container at the temperature between 4-8° C. When the temperature further drops to a predetermined temperature such as 4° C., then the heating module of the flexible heating device will begin to turn on to heating the container and thus to keep the subject in the container at the desired storage temperature range of about 2-8° C. for a predetermined time. The eutectic material is selected based on the desired storage temperature range. The predetermined time can be calculated based on the transportation distance, and the amount of eutectic material can then be calculated based on the predetermined time.

Phase Change Material (PCM)

A phase change material (PCM) is a substance which releases/absorbs sufficient energy at phase transition to provide useful heat/cooling. Generally the transition will be from one of the first two fundamental states of matter—solid and liquid—to the other. The phase transition may also be between non-classical states of matter, such as the conformity of crystals, where the material goes from conforming to one crystalline structure to conforming to another, which may be a higher or lower energy state. The energy released/absorbed by phase transition from solid to liquid, or vice versa, the heat of fusion is generally much higher than the sensible heat. Ice, for example, requires 333.55 J/g to melt, but then water will rise one degree further with the addition of just 4.18 J/g. Water/ice is therefore an example of a phase change material. By melting and solidifying at the phase change temperature (PCT), a PCM is capable of storing and releasing large amounts of energy compared to sensible heat storage. Heat is absorbed or released when the material changes from solid to liquid and vice versa or when the internal structure of the material changes; PCMs are accordingly referred to as latent heat storage (LHS) materials. There are two principal classes of phase change material: organic (carbon-containing) materials derived either from petroleum, from plants or from animals; and salt hydrates, which generally either use natural salts from the sea or from mineral deposits or are by-products of other processes. A third class is solid to solid phase change. PCMs are used in many different commercial applications where energy storage and/or stable temperatures are required, including, among others, heating pads, cooling for telephone switching boxes, and clothing. Solid-liquid phase change materials are usually encapsulated for installation in the end application, to contain in the liquid state. In some applications, especially when incorporation to textiles is required, phase change materials are micro-encapsulated. Micro-encapsulation allows the material to remain solid, in the form of small bubbles, when the PCM core has melted. The phase change material may be selected from the group consisting of water, paraffin wax, alkanes, alkenes, fatty alcohols, fatty acids, fatty esters, ethylene glycol, propylene glycol, eutectic mixtures, and hydrated salt(s). The phase change material can be selected based on the applications. For example, for the application in clothes, the PCM may have a phase change temperature around the human body temperature around 37° C. or about 0.5° C. higher, about 1° C. higher, about 2° C. higher, about 3° C. higher, about 4° C. higher, about 5° C. higher, about 6° C. higher, about 7° C. higher, about 8° C. higher, about 9° C. higher, about 10° C. higher, about 11° C. higher, about 12° C. higher, about 13° C. higher, about 14° C. higher, about 15° C. higher, about 16° C. higher, about 17° C. higher, about 18° C. higher, about 19° C. higher, about 20° C. higher, or more than about 20° C. higher than the human body temperature. The combination of the phase change material (PCM) and the flexible heating module of the flexible heating device can control the temperature at a desired temperature range for a long time with the same amount of electrical power from the portable power bank.

Vertical Heat Transfer Layer

In embodiments, as shown in FIGS. 4A and 4B, the heat generating layer comprises a thin film of the electrically conductive material (carbon-based composite) 410 and a vertical heat transfer layer 430 layering on top of the thin film of the electrically conductive material 410. The vertical heat transfer layer is an electrically conductive silver layer. In embodiments, the electrically conductive silver layer comprises or is made of a layer of conductive silver particles. In embodiments, the silver layer is a continuous layer of silver particles. In embodiments, the silver layer is a discontinuous layer of silver particles.

Forming Silver Layer

In embodiments, the electrically conductive silver layer is printed on a surface of the electrically conductive material film such as the carbon-based composite film discussed herein above or elsewhere in the present disclosure using a silver printing process. In some embodiments, the electrically conductive silver layer is printed on the surface of the electrically conductive material film prior to forming perforations on the heat generating layer. In embodiments, the silver printing process is an inkjet printing process. In embodiments, the inkjet printing process comprises sintering. During this process, a layer of silver ink or liquid drops is printed on the surface of the thin film of the electrically conductive material. After that, the printed silver liquid drops are sintered in an oven to obtain a compact silver layer. Repeat the "printing and sintering" process to form a thin conductive silver film by a layer-by-layer process.

Printing Silver

In embodiments, the silver printing process is a sinter-free process that results in direct printing of crystalline silver on the surface of the electrically conductive material film. In embodiments, the sinter-free process exploits the chemistries developed for Atomic Layer Deposition (ALD), to form the basis of a new ink formulation, reactive organometallic inks (ROM). These ROM ink formulations are capable of depositing low temperature, high conductivity metal films, without the need for subsequent sintering treatments. To reduce the temperature for direct formation of metallic silver (Ag), an alcohol is added as a catalytic reducing agent to dissociate the organometallic component. Silver films printed from our the ROM ink, on the surface of the electrically conductive material film at about 50-150° C., or about 100-150° C., or about 120° C., are electrically conductive with a typical resistivity as low as, or less than 60%, or less than 50%, or less than 45%, or about 40% that of bulk silver, without the need for sintering.

Silver Paste

The composition of the silver printing ink or silver paste is well known in the silver printing industry. In embodiments, the silver printing ink comprises one or more silver particles, silver nanoparticles, ethylene glycol, an alcohol such as ethanol and propanol, and other components. The silver particles have an average particle size in an range of 1-200 nm, about 1-100 nm, about 10-90 nm, about 30-80 nm, or about 70 nm; and 90% of the silver particles have a particle size less than 85 nm. In embodiments, the conductive silver layer is a conductive silver paste layer made by printing or spreading a thin layer of silver paste over the surface of the thin film of the electrically conductive material. The silver paste includes silver particles having an average particle size in an range of 1-200 nm, about 1-100 nm, about 10-90 nm, about 30-80 nm, or about 70 nm; and 90% of the silver particles have a particle size less than 85 nm.

Properties of Electrically Conductive Silver Layer

Pure silver has the highest electrical conductivity of about $6.7\times10^{7}$ S/m at 0° C. and the thermal conductivity of 429 $W\cdot m^{-1}\cdot K^{-1}$ at 20° C. of all metals, and possesses the lowest contact resistance. In embodiments, the conductive silver layer has a thickness in a range of about 0.01-100.0 μm, about 0.1-50.0 μm, about 1.0-10.0 μm, about 2.0-8.0 μm, or preferably about 4.0-5.0 μm. In embodiments, the conductive silver layer has a sheet resistivity of about 1.0-20.0 milliohms (mΩ), or about 6.0-8.0 milliohms; and a resistivity of about 1 to about $1\times10^{-6}$ Ω·cm, about $1\times10^{-2}$ to $1\times10^{-5}$ Ω·cm, about $1\times10^{-3}$ to $1\times10^{-5}$ Ω·cm, or about $1\times10^{-4}$ to $1\times10^{-5}$ Ω·cm; and a sheet resistance of about $1\times10^{-5}$-100 Ω/square, about 0.001-10 Ω/square, or about 0.01-1 Ω/square. The conductive silver layer has a thermal conductivity of about 0.1-429 $W\cdot m^{-1}\cdot K^{-1}$, about 1-400 $W\cdot m^{-1}\cdot K^{-1}$, about 1-100 $W\cdot m^{-1}\cdot K^{-1}$, about 1-50 $W\cdot m^{-1}\cdot K^{-1}$, about 1-20 $W\cdot m^{-1}\cdot K^{-1}$, or about 1-10 $W\cdot m^{-1}\cdot K^{-1}$ at room temperature of about 25° C. The conductive silver layer has the same length and width as the flexible heat generating layer. In embodiments, the vertical heat transfer layer has a lateral dimension (length and width) smaller than that of the flexible heating pad.

Functions of Electrically Conductive Silver Layer

The conductive silver layer increases the electrical conductivity of the heat generating layer. In embodiments, the silver layer increase the thermal conductivity between the heat generating layer and the lateral heat transfer layer laying on top of the heat generating layer. In embodiments, the silver layer increase the thermal conductivity between the heat generating layer and flexible substrate layer laying on top of the heat generating layer.

Lateral Heat Transfer Layer

Lateral Heat Transfer Layer

In embodiments, the electroconductive heat module includes a lateral heat transfer layer 404 for homogenizing the temperature on the two dimensional area of the heat generating layer 410, hence two dimensional area of the electroconductive heat module 420. The lateral heat transfer layer 404 minimizes, reduces or lessens a temperature gradient between two locations on the two dimensional area of the heat generating layer 410 when compared to that without the lateral heat transfer layer. Also, the lateral heat transfer layer 404 minimizes, reduces or lessens a temperature gradient between inside and around perforations when compared to that without the lateral heat transfer layer. In embodiments, the lateral heat transfer layer is formed over the flexible substrate layer such that the lateral heat transfer layer is interposed between the flexible substrate layer and the flexible heat generating layer of the electroconductive heat module. In embodiments, the electrically conductive silver layer discussed above is interposed between the flexible heat generating layer 410 and the lateral heat transfer layer 404.

Heat Conductive Pouches

Figure 4G:
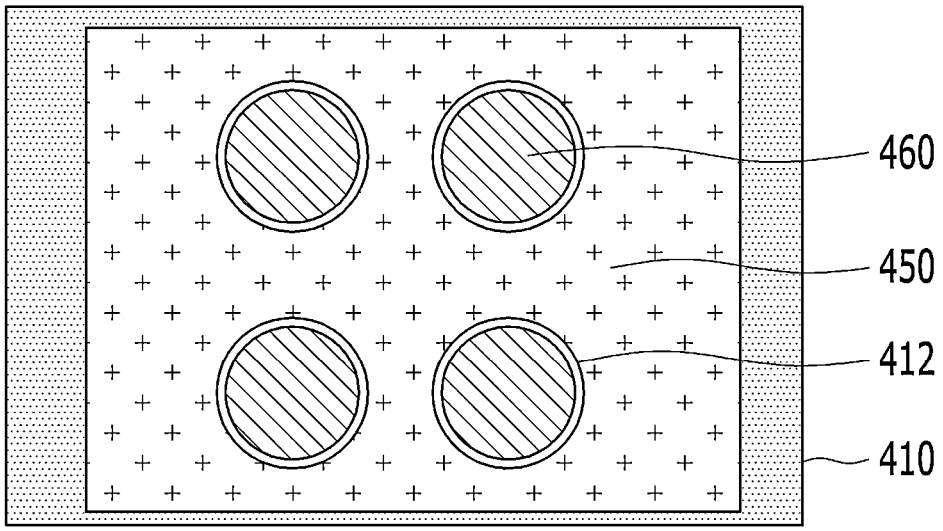
FIG. 4G schematically illustrates one example configuration of the lateral heat transfer layer layered onto the flexible heat generating layer with the liquid metal pouches fit into the perforations of the flexible heat generating layer in some embodiments according to the present disclosure.
Figure 4H:
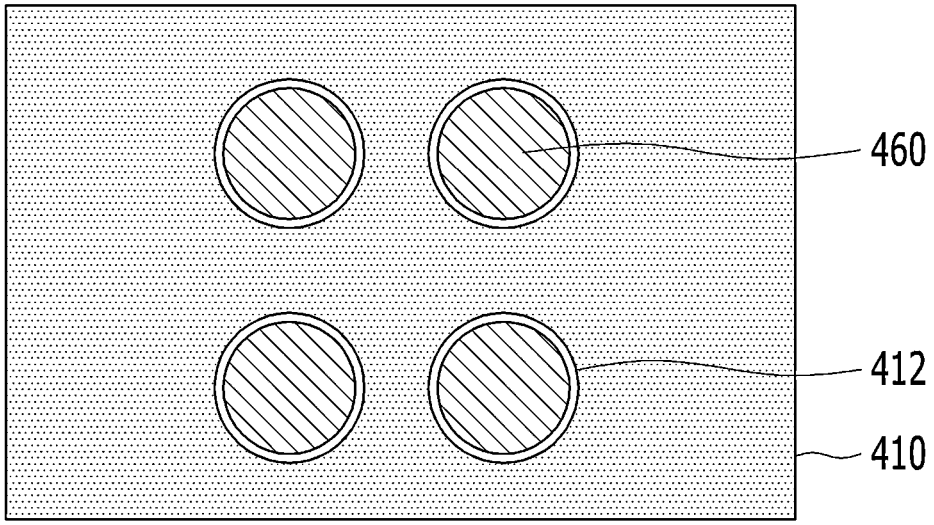
FIG. 4H schematically illustrates one example configuration of the individually packaged liquid metal pouches fit into the perforations of the flexible heat generating layer in some embodiments according to the present disclosure.
Figure 4I:
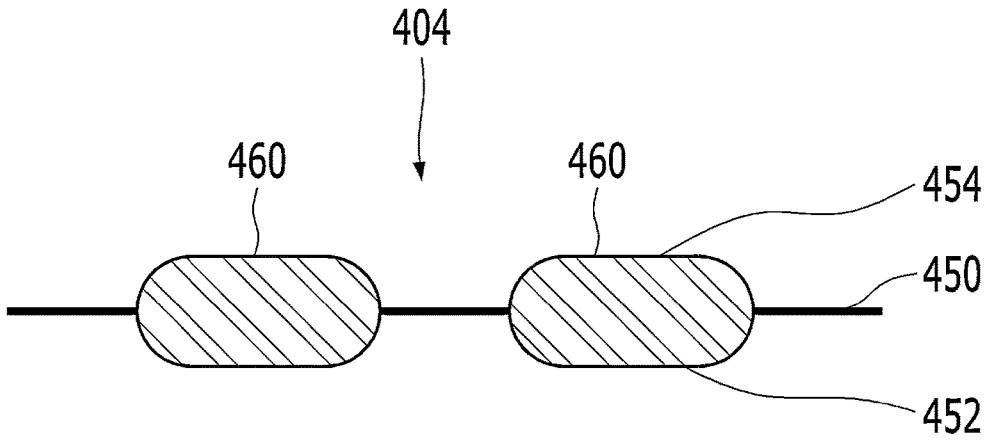
FIG. 4I schematically illustrates one example configuration of the lateral heat transfer layer in some embodiments according to the present disclosure.
Figure 4J:
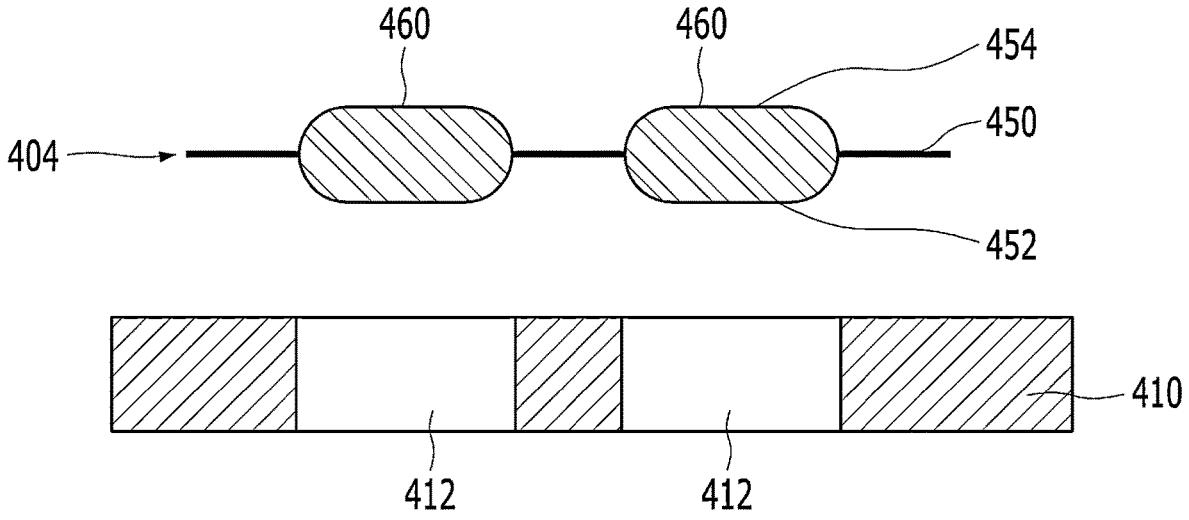
FIG. 4J schematically illustrates the cross-section view of one example configuration of the lateral heat transfer layer in some embodiments according to the present disclosure.

In embodiments, as shown in FIGS. 4G, 4I and 4J, the lateral heat transfer layer 404 includes a first thin plastic film 452, a second thin plastic film 454, and a number of heat conductive pouches 460 sealed between the first and second thin plastic films. The heat conductive pouches contain liquid metal therein, preferably substantially free of air bubble therein. In embodiments, the heat conductive pouches 460 are sized and aligned with perforations 412 of the flexible heat generating layer 410 such that one heat conductive pouch is placed inside one perforation (as shown in FIG. 4J), a portion of one heat conductive pouch is placed inside one perforation while another portion is placed outside that perforation, two or more heat conductive pouches are placed inside one perforation, one heat conductive pouch covers the entire area of one perforation, one heat conductive pouch entirely covers two or more perforations, one heat conductive pouch covers a portion of one perforation and at least a portion of another perforation. In embodiments, the heat conductive pouches contain one or more selected from the group consisting of a heat conducting silicon resin, a graphene heat conducting film, a liquid metal, a heat conducting gel, and a heat conducting fabric film, although not limited thereto.

Alternatively, as shown in FIG. 4H, the lateral heat transfer layer 404 includes a number of individually packaged heat conductive pouches 460. The individually packaged heat conductive pouches 460 contain liquid metal therein, preferably substantially free of air bubble therein. In embodiments, the individually packaged heat conductive pouches 460 are sized and placed into perforations 412 of the flexible heat generating layer 410 such that one individually packaged heat conductive pouch is placed inside one perforation (as shown in FIG. 4H), a portion of one individually packaged heat conductive pouch is placed inside one perforation while another portion is placed outside that perforation, two or more individually packaged heat conductive pouches are placed inside one perforation, one individually packaged heat conductive pouch covers the entire area of one perforation, one individually packaged heat conductive pouch entirely covers two or more perforations, one individually packaged heat conductive pouch covers a portion of one perforation and at least a portion of another perforation.

Making Heat Conductive Pouches

Now discussed is a method of making the lateral heat transfer layer with liquid metal heat conductive pouches. The same or modified method can be used to produce heat conductive pouches containing another material therein. In embodiments, the lateral heat transfer layer 404 is formed by laminating the first thin plastic film 452 over at least part of or the whole surface area of the flexible heat generating layer 410 having a number of perforations 412; placing, spreading or painting the liquid metal paste or composition on the first thin plastic film 452; laminating the second thin plastic film 454 over the liquid metal paste so that the liquid metal paste is sealed between the first and second thin plastic films to form a liquid-tight liquid metal package; and hot pressing the liquid metal package to the flexible heat generating layer 410 having the perforations 412 such that the liquid metal paste is sealed in a number of liquid-tight pouches 460 enclosing the liquid metal between the first and second thin plastic films and each of the liquid-tight pouches 460 enclosing the liquid metal paste is located in one of the perforations 412, which is to lessen a temperature gradient between inside and around the one of the perforations when compared to that without the at least one of the liquid-tight pouches, as shown in FIGS. 4G, 4I and 4J. The first and second thin films 452 and 454 are hot sealed together to form film 450 with small amount of or substantially no liquid metal at areas that have no perforations to separate the liquid-tight pouches 460.

Alternatively, the liquid metal heat conductive pouches can be prepared individually each sealed between two thin plastic films. Each of the individually packaged heat conductive pouches is sized and shaped to fit into one of the perforations of the flexible heat generating layer, as shown in FIG. 4H.

Characteristics of Lateral Heat Transfer Layer

In embodiments, the lateral heat transfer layer has a thickness ranging between about 0.01 μm and about 100 μm; a thermal conductivity of about 1-500 $W \cdot m^{-1} \cdot K^{-1}$ or about 10-200 $W \cdot m^{-1} \cdot K^{-1}$ at about 25° C. In embodiments, the lateral dimension (length and width) of the lateral heat transfer layer is substantially the same as that of the flexible substrate layer or the flexible heating pad, and is larger than the lateral dimension of the flexible heat generating layer. Such a design has an advantage of reducing the size of the heat generating layer and thus reducing the bulkiness of the flexible heating device; and increasing the heat distribution over the entire area of the flexible heat generating device or the flexible heating pad.

Liquid Metal

In embodiments, the lateral heat transfer layer comprises or is made of a liquid metal. The term "liquid metal" as used in this disclosure refers to a metal or a metal alloy which is liquid at or near room temperature; at or near the human body temperatures of about 37° C.; or at a temperature higher than about −30° C., about −20° C., about −15° C., about −10° C., about −5° C., about 0° C., about 1° C., about 2° C., about 3° C., about 4° C., about 5° C., about 6° C., about 7° C., about 8° C., about 9° C., or about 10° C. One example of a liquid metal is mercury (Hg) which is molten above −38.8° C. and is the only stable liquid elemental metal at room temperature. Three more stable elemental metals melt just above room temperature: caesium (Cs) having a melting point of 28.5° C. (83.3° F.); gallium (Ga) having a melting point of 30° C. (86° F.); and rubidium (Rb) having a melting point of 39° C. (102° F.). In embodiments, the liquid metal is a paste or a liquid at or near room temperatures of about 25° C., at or near the human body temperatures of about 37° C., or at a temperature higher than about 0° C., about 10° C., about 15° C., about 25° C. or about 37° C. In embodiments, the liquid metal is a liquid metal alloy. In embodiments, the liquid metal is a eutectic alloy of gallium, indium and tin. In embodiments, the liquid metal is a liquid metal alloy including about 30-90 wt. % gallium, about 5-40 wt. % indium, and about 5-30 wt. % tin. In embodiments, the liquid metal is a eutectic alloy of gallium, indium and tin which melts at −19° C. In embodiments, the liquid metal is a eutectic alloy which comprises or is made of about 68.5 wt. % gallium (Ga), about 21.5 wt. % indium (In) and about 10.0 wt. % tin (Sn) and melts at −19° C. (−2° F.). This eutectic alloy has low toxicity and low reactivity. In embodiments, the liquid metal comprises or is made of about 62 wt. % gallium (Ga), about 22 wt. % indium (In) and about 16 wt. % tin (Sn) and melts at about 10.7° C. (51° F.).

Composition of the Liquid Metal

In embodiments, the liquid metal is selected from the group consisting of mercury (Hg), caesium (Cs), gallium (Ga) and a liquid metal alloy. Metal alloys can be liquid if they form a eutectic, meaning that the alloy's melting point is lower than any of the alloy's constituent metals. The standard metal for creating liquid alloys used to be mercury, but gallium-based alloys, which are lower both in their vapor pressure at room temperature and toxicity, are being used as a replacement in various applications. The liquid metal alloys also have a higher electrical conductivity that allows the liquid to be pumped by more efficient, electromagnetic pumps. This results in the use of these materials for specific heat conducting and/or dissipation applications of the present disclosure. Because of their excellent characteristics and manufacturing methods, liquid metal alloys can be used in wearable devices, medical devices, interconnected devices and so on. In embodiments, the liquid metal is a liquid metal alloy or a eutectic liquid metal alloy including a gallium-based alloys such as gallium-indium eutectic alloy. In embodiments, the liquid metal is a eutectic alloy of gallium, indium and tin which melts at −19° C. In embodiments, the liquid metal is a eutectic alloy Galinstan which is composed of 68.5 wt. % gallium (Ga), 21.5 wt. % indium (In) and 10.0 wt. % tin (Sn) and melts at −19° C. (−2° F.).

Thermal Conductivity of the Liquid Metal Pouches

In embodiments, the liquid metal or liquid metal alloy has a thermal conductivity in a range of about 1-500 $W \cdot m^{-1} \cdot K^{-1}$, about 2-300 $W \cdot m^{-1} \cdot K^{-1}$, about 10-200 $W \cdot m^{-1} \cdot K^{-1}$, about 20-100 $W \cdot m^{-1} \cdot K^{-1}$, about 20-80 $W \cdot m^{-1} \cdot K^{-1}$, about 30-50 $W \cdot m^{-1} \cdot K^{-1}$, or about 30-40 $W \cdot m^{-1} \cdot K^{1}$ at room temperature (about 25° C.). This eutectic alloy has low toxicity and low reactivity.

Liquid Metal Pouches

In embodiments, the lateral heat transfer layer comprises or is made of a liquid metal. In embodiments, the liquid metal is a paste spread or painted inside and around at least one of the perforations and on at least part of surfaces of the flexible heat generate layer and/or the flexible substrate layer and/or the vertical heat transfer layer. In embodiments, the liquid metal is a paste sealed in a liquid-tight thin film package enclosing the liquid metal. The liquid-tight thin film package is placed on top of and covers at least part of or the whole surface area of the flexible heat generating layer and/or the flexible substrate layer and/or the vertical heat transfer layer. In embodiments, the liquid-tight thin film package is placed on top of the flexible heat generating layer having a number of perforations and covers at least part of or the whole surface area of the flexible heat generating layer. In embodiments, the liquid-tight thin film package is hot pressed to the flexible heat generating layer having the perforations so that a number of liquid-tight liquid metal pouches are formed and located in at least part or all of the perforations of the flexible heat generating layer. In embodiments, the liquid metal is sealed in a number of individual liquid-tight pouches enclosing the liquid metal, and the liquid-tight pouches are each prepared individually and subsequently placed in at least one of the perforations. In embodiments, the liquid metal paste is sealed in a number of liquid-tight pouches enclosing the liquid metal, and at least one of the liquid-tight pouches is placed in one of perforations, which is to lessen a temperature gradient between inside and around the one of the perforations when compared to that without the at least one of the liquid-tight pouches.

Liquid Metal Based Solid Thermal Conductor

In embodiments, the liquid metal is mixed with an elastomer and cured to form a liquid metal (LM) based solid thermal conductor. In embodiments, the liquid metal based thermal conductor is selected from the group consisting of a microfluidic elastomer prepared by injecting a liquid metal alloy into an elastomer such as a silicone; and a liquid metal-embedded elastomer (LMEE) which is a composite of an elastomer and a liquid metal alloy. In embodiments, the liquid metal alloy may be a gallium-based liquid metal alloy. Once the gallium-based liquid metal alloy undergoes shear nixing in a polymer matrix or sonicated in an alcohol, the thin native oxide on LM is formed and works as a surfactant, thereby remaining in droplet structures. With the gallium oxide skin on the droplets, the droplets do not easily bond back to bulk LM when agitated in a solvent. However, the oxide layer is broken easily under applied strain, tensile strain, or even peeling so that electrical connection can be made autonomously. For some of the polymer matrix or depending on liquid metal volumetric percentages, the liquid droplets are suspended tightly in the polymer matrix, making it useful for applications in mechanically compliant and metal-like material properties such as high thermal conductivity. In embodiments, the liquid metal is a liquid metal-embedded elastomer (LMEE) in which the liquid metal alloy droplets are dispersed homogeneously in the polymer matrix to form a mixture and the mixture is further cured to form a solid or semisolid liquid metal-embedded elastomer (LMEE) composite. This design has the advantages that the risk for the liquid metal to leak out the polymer matrix and the pouches is significantly reduced.

Dimensions of Lateral Heat Transfer Layer

In embodiments, the flexible heat generating layer may have at least one lateral dimension (length and/or width) smaller than those of the flexible heating pad; and may have a surface area less than that of the flexible heating pad, such as about 30%, about 40%, about 50%, about 60%, about 70%, about 80%, about 90%, about 95% or about 99% of surface area of the flexible heating pad. The lateral heat transfer layer may have at least one lateral dimensions (length and width) larger than that of the flexible heat generating layer; and has a surface area of at least about 50%, about 60%, about 70%, about 80%, about 90%, about 95%, or about 100% of the flexible heating pad. This design has the advantages that the heat generating module can be manufactured in smaller lateral dimensions, and the heat can be transferred to the whole surface area of the flexible heat pad through the larger lateral heat transfer layer. In embodiments, The lateral heat transfer layer may have the same lateral dimensions (length and/or width) as those of the flexible heat generating layer.

Combination of Liquid Metal and Solid Lateral Heat Transfer Layers

In embodiments, the flexible heating pad comprises both the liquid-tight liquid metal pouches located in at least one of the perforations as discussed herein above; and a solid lateral heat transfer layer such as the graphene heat conducting film, the liquid-tight liquid metal pouches is first laminated on the surface of the flexible heat generating layer and subsequently, the solid lateral heat transfer layer is laminated over the flexible heat generating layer having the liquid metal pouches.

Method for Preparing the Flexible Heating Device

In an aspect, the present disclosure provides a method for preparing the flexible heating device. The method comprises: 1) weighing the binder and the carbon-based fillers including carbon black particles, carbon nanotubes and graphene; 2) adding the binder and the carbon-based fillers to a mixing machine; 3) melting the binder at a high temperature; 4) mixing the binder and the carbon-based fillers to form a homogeneous carbon-based composite; and 5) forming a thin film of the carbon-based composite. In embodiments, the mixing machine is a calender and the mixing is conducted in the calender. In embodiments, the forming the thin film of the carbon-based composite is by calendering and drawing the homogeneous carbon-based composite.

In embodiments, the method further comprises printing a conductive silver ink onto a surface of the thin film of the carbon-based composite to form a conductive silver layer printed on the thin film of the carbon-based composite. The combined conductive silver layer and the thin film of the carbon-based composite is defined as electrically conductive material thin film. In embodiments, the method further comprises perforating the electrically conductive material thin film to form multiple perforations. In embodiments, perforating is conducted by at least one of laser perforating, die cutting and punching.

In embodiments, the method further comprises laminating a first flexible conductive electrode on the top edge of a first surface of the perforated electrically conductive material thin film in a first direction; laminating a second flexible conductive electrode on the bottom edge of the same first surface of the perforated electrically conductive material thin film in a second direction; and laminating a first flexible protective layer to cover the first flexible electrode and a second flexible protective layer to cover the second flexible electrodes to form the flexible heat generating layer, wherein the first direction and the second direction are substantially parallel and have a distance. In embodiments, the first and second flexible protective layers are waterproof and electrically insulative. In embodiments, the first and second flexible protective layers are polyethylene terephthalate (PET) or polyimide (PI) thin films. In embodiments, the flexible first and second electrodes are at least one of a conductive metal foil, a metal film deposited onto the surface of the perforated electrically conductive material thin film, and a conductive cloth. Non-limiting examples of the metal foil are a silver foil, a copper foil, and an aluminum foil. Non-limiting examples of the metal film are a silver film, a copper film and an aluminum film.

In embodiments, the method further comprises laminating a first flexible substrate layer to the second surface of the perforated electrically conductive material thin film. In embodiments, the perforated electrically conductive material thin film has a lateral dimension (length and width) smaller than of the lateral dimension of the flexible substrate layer, the perforated electrically conductive material thin film is centered on the flexible substrate layer. In embodiments, the surface area of the perforated electrically conductive material thin film (including surface areas of the multiple perforations) is about 5%, about 10%, about 15%, about 20%, about 25%, about 30%, about 35%, about 40%, about 45%, about 50%, about 60%, about 70%, about 80%, about 90%, about 95%, or about 100% of the surface area of the flexible substrate layer.

In embodiments, the method further comprises spreading a liquid metal paste inside and/or around the perforations and/or on at least part of surfaces of the flexible heat generating layer and/or the flexible substrate layer and/or the lateral heat transfer layer, which is to lessen a temperature gradient between inside and around the one of the perforation when compared to without the liquid metal. In embodiments, the liquid metal is a liquid metal alloy. In embodiments, the liquid metal is a liquid metal alloy of gallium, indium and tin which is composed of 68.5 wt. % gallium (Ga), 21.5 wt. % indium (In) and 10.0 wt. % tin (Sn) and melts at −19° C. (−2° F.).

In embodiments, the method further comprises putting multiple pouches of liquid metal in the multiple perforations of the electrically conductive material thin film. In embodiments, the pouches of the liquid metal is smaller than the perforations and can be fitted into the perforations. In embodiments, the method further comprising putting one or more thin films comprising liquid metal on the first surface of the electrically conductive material thin film. In embodiments, the thin film comprises the liquid metal is a thin film of a liquid metal embedded elastomer to prevent the leaking of the liquid metal. In embodiments, the thin film comprising liquid metal are further encapsulated in a polymer film to further prevent the leaking of the liquid metal. In embodiments, the thin films comprising liquid metal are smaller than the perforations and can be fitted into the perforations. In embodiments, the thin films comprising liquid metal are larger than the perforations and are laminated on top of the perforated electrically conductive material thin film.

In embodiments, the pouches of liquid metal or the thin films comprising liquid metal are configured to be fixed to the electrically conductive material thin film so that they are not moving around. In embodiments, the method further comprising laminating a lateral heat transfer layer to the first surface of the perforated electrically conductive material thin film having the first and second flexible electrodes and the first and second flexible protective layers. The lateral heat transfer layer has substantially the same lateral dimension and surface area as those of the flexible substrate layer.

In embodiments, the method further comprises laminating a second flexible substrate layer onto the lateral heat transfer layer to form a flexible heating pad. In embodiments, the second flexible substrate layer has the same dimensions and surface areas as those of the first flexible substrate layer. In embodiments, the second flexible substrate layer is the same as the first flexible substrate layer. In embodiments, the second flexible substrate layer is made of a different material or has a different composition from the first flexible substrate layer.

In embodiments, the method further comprises sealing the edges of each layer of the flexible heating pad using a hot melt adhesive compound. The sealing of the edges of each layer of the flexible heating pad prevents moisture and/or water from entering into the flexible heating pad and improves the water-washing performance of the flexible heating device. The sealing of the edges of each layer of the flexible heating pad further fix each layer inside the flexible heating pad, prevents each of the layer or components inside the flexible heating pad from moving around in relation to other layers or components in the flexible heating pad.

In embodiments, the hot melt adhesive compound comprises at least one of thermoplastic polyurethane (TPU), polyurethanes (PUR) or reactive urethanes, styrene block copolymers (SBC), polycarbonate, polyolefins (PO) or atactic polypropylene (PP or APP), ethylene-vinyl acetate or poly(ethylene-vinyl acetate) (EVA), polyamides, and polyesters. In embodiments, the hot melt adhesive compound comprises EVA as the mail polymer and terpene-phenol resin (TPR) as the tackifier. In embodiments, the sealing comprises sealing each layer of the flexible heating pad, including sealing the edges of first and second flexible protective layers to the carbon-based composite thin film, sealing the edges of the carbon-based composite thin film to the first flexible substrate layer and the lateral heat transfer layer, sealing the edges of the first and second flexible substrate layers and the lateral heat transfer layer so that the flexible heat generating pad is waterproof and the liquid meal paste spreading or painting on the surfaces of the flexible heat generating layer, and/or the flexible substrate layer and/or the lateral heat transfer layer inside the flexible heating pad does not leak out of the flexible heating pad.

In embodiments, the method further comprises connecting a first lead wire to the first flexible electrode; and connecting a second wire lead to the second flexible electrode before laminating the first and second protective layers onto the first and second flexible electrodes.

In embodiments, the method further comprises connecting the first and second wire leads to an electrical switch. In embodiments, the method further comprises connecting the first and second wire leads to a control unit, wherein the control unit is configured to adjust the temperature of the flexible heating pad to a desired temperature and maintain the flexible heating pad at the desired temperature or within about 5° C., about 4° C., about 3° C., about 2° C., or about 1° C. above or below the desired temperature.

In embodiments, the method further comprising connecting the first and second lead wires to a power source, such as a portable power bank, or an external electrical plug.

The method further comprises electrically connecting one or more flexible heating pads such as 2, 3, 4 or more flexible heating pads so that the flexible heating device can selectively heat different areas.

Flexible Heating Device

Figure 6A:
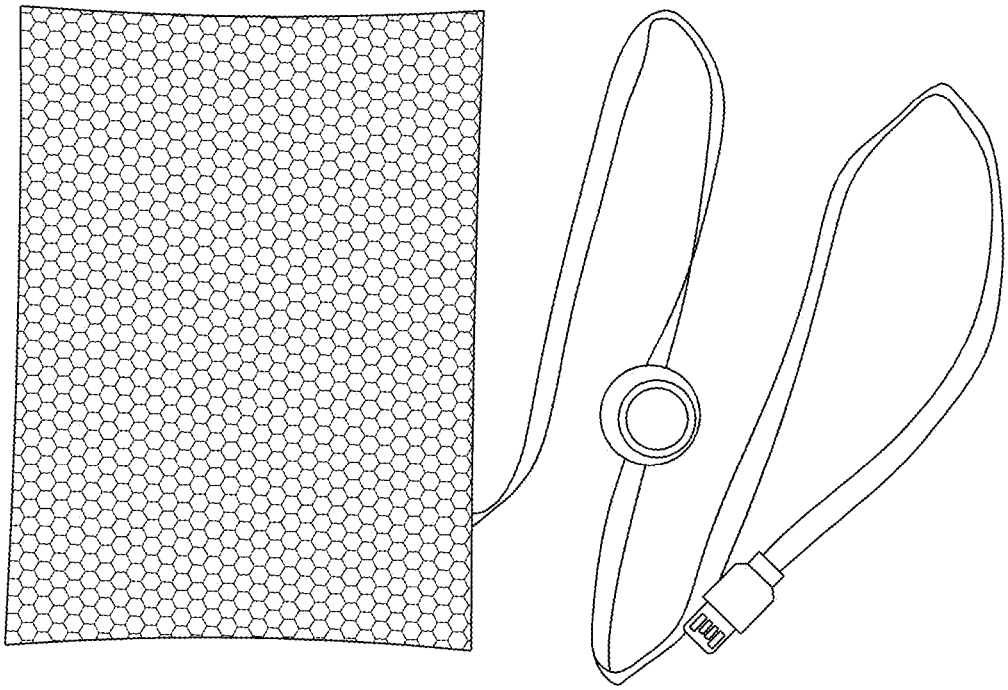
FIGS. 6A, 6B, 6C and 6D illustrates a flexible heating device and flexible heating devices including one, two and three flexible heating pads respectively, the flexible heating pads are electrically connected to a control unit and a USB connector in some embodiments according to the present disclosure.
Figure 6B:
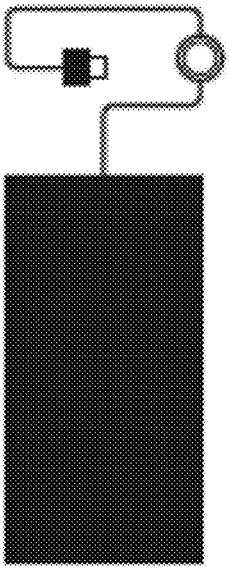
Figure 6C:
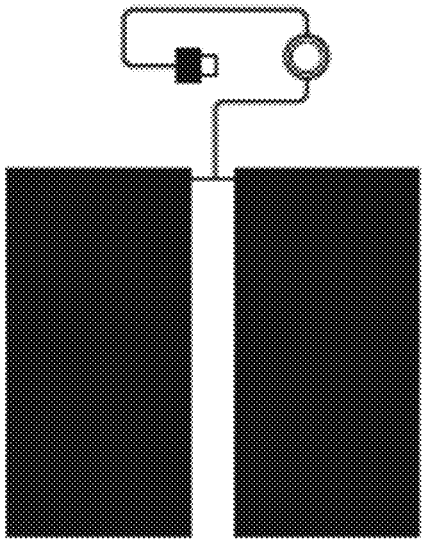
Figure 6D:
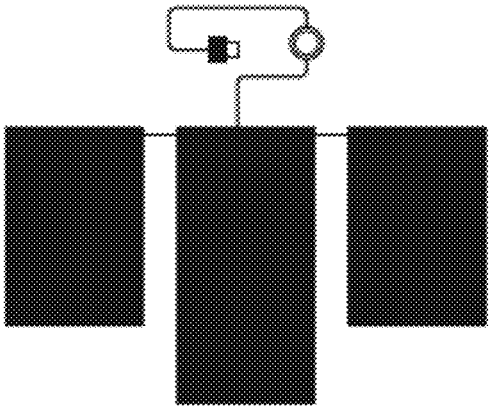

A flexible heating device of the present disclosure is shown in FIG. 6A. As shown in FIGS. 6A and 6B, the flexible heating device comprises a flexible heating pad; a control unit; a power source; and electrical wires configured to connect the flexible heating pad, the control unit and the power source to form an electrical circuit. The flexible heating device may comprise multiple flexible heating pads, such as two or three flexible heating pads as shown in FIGS. 6C and 6D respectively. The flexible heating device may comprise four or more flexible heating pads.

Advantages of the Present Flexible Heating Device

Figure 7A:
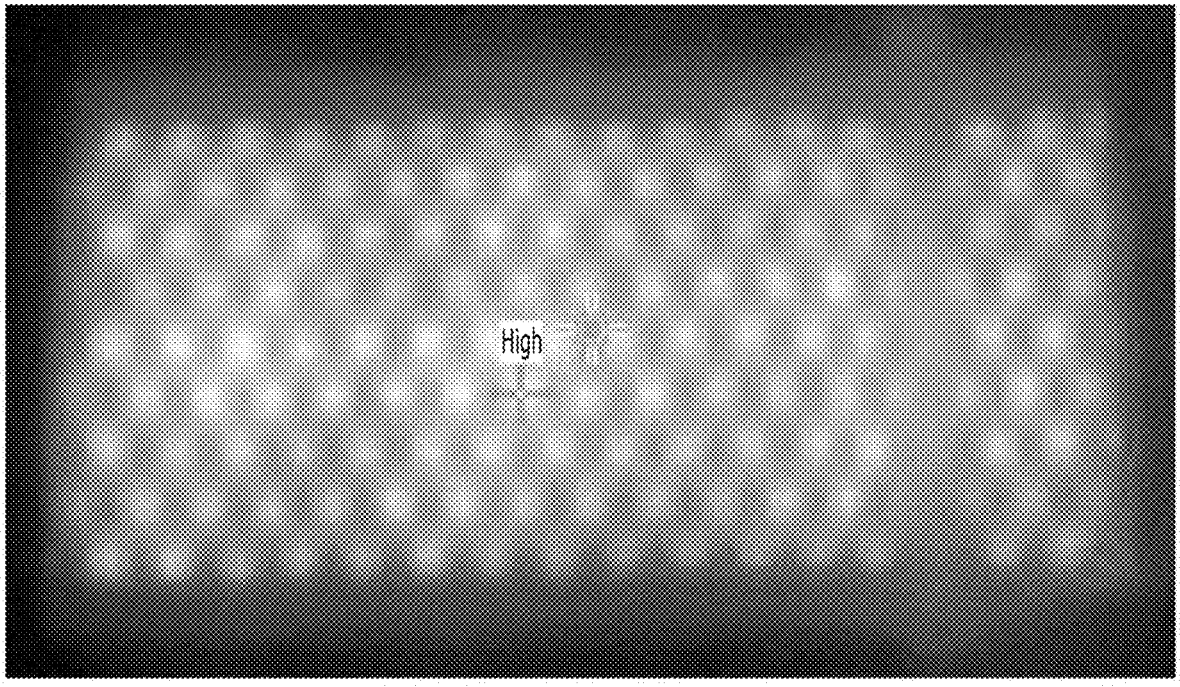
FIG. 7A shows an infrared image of the flexible heating pad which demonstrates the even heat distribution over the entire flexible heating pad in some embodiments according to the present disclosure.
Figure 7B:
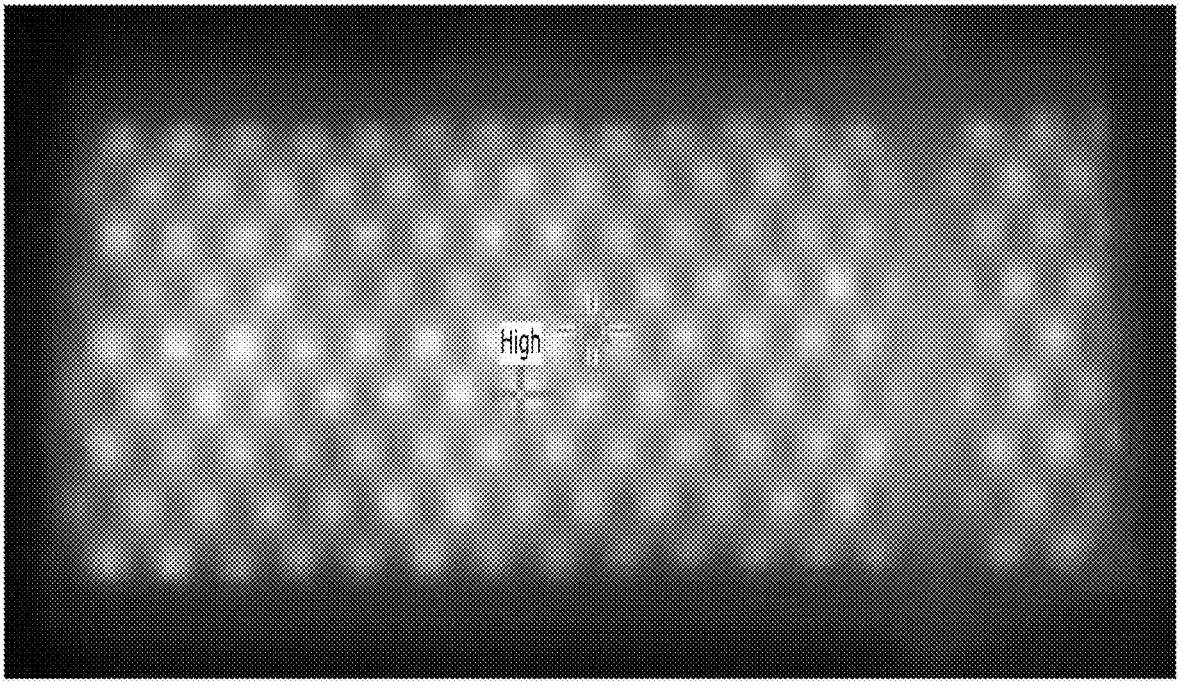
FIG. 7B a color version of FIG. 7A.

Applicant has conducted experimental tests to evaluate the effective heating surface area and the heating uniformity of the flexible heating pad by taking the infrared images of the flexible heating device after heating. The infrared image is shown in FIG. 7A. As shown in FIG. 7A, Applicant notes that the flexible heating device demonstrated large effective heating surface area. The whole surface area of the flexible heating pad was uniformly heated and no temperature gradient was observed on the flexible heating pad. Contrary to the hot and cold spots of the conventional heating pads using long copper wires (FIG. 1B) or carbon fibers (FIG. 2B), there are substantially no hot and cold spots of the flexible heating pad of the present disclosure.

The flexible heating device further has the advantages that multiple flexible heating pads can be used in one flexible heating device which makes the device more compact to heating multiple locations simultaneously, as shown in FIGS. 6C and 6D.

Applications of the Flexible Heating Device

Applications

Figure 8:
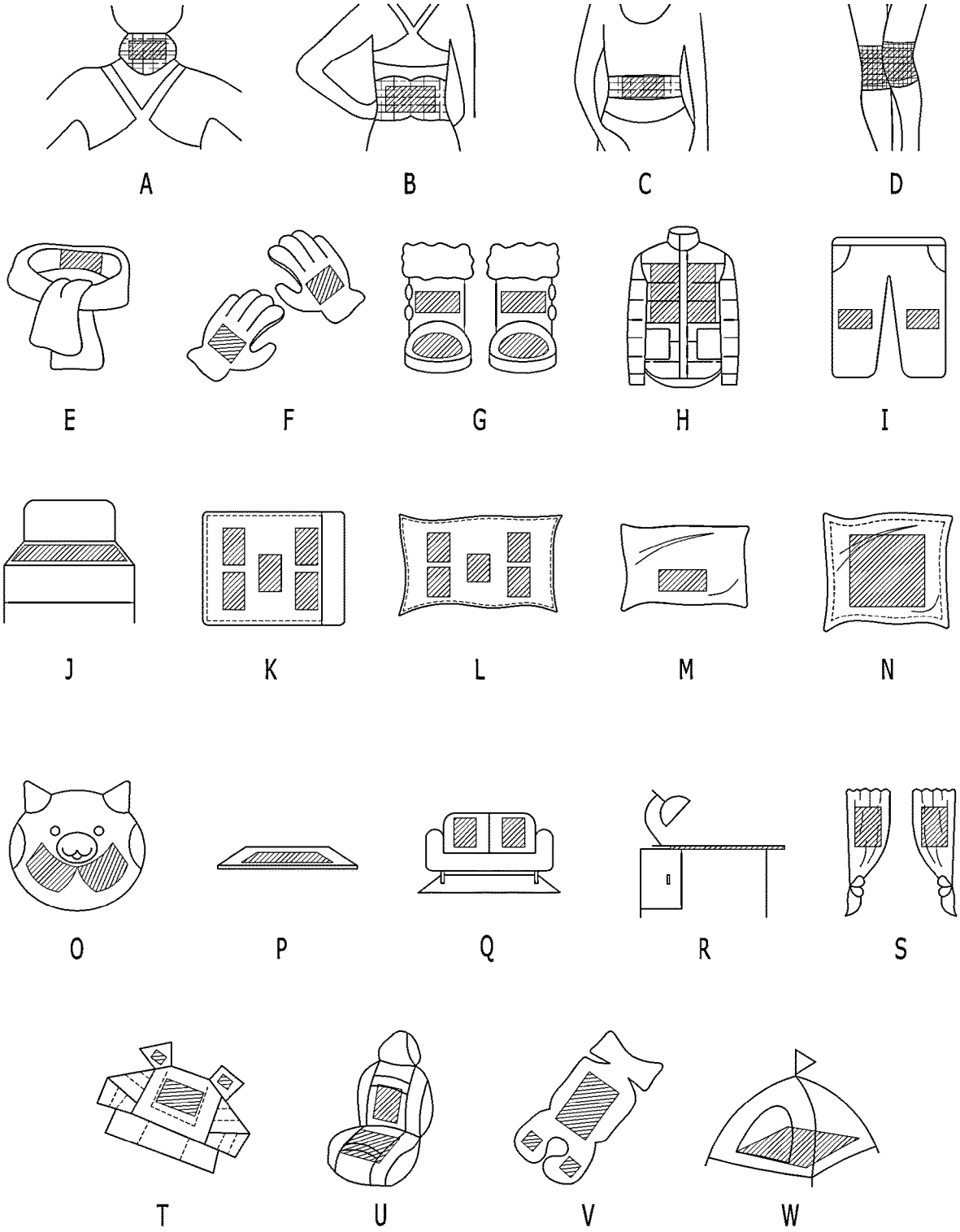
FIGS. 8A to 8W illustrate non-limiting examples of applications of the flexible heating devices according to the present disclosure.

In embodiments, the flexible heating device is versatile and can be used in a wide variety of applications such as textile articles, garments, wearable devices, household goods and products, automobiles, outdoor and sports equipment, and other devices, as shown in FIGS. 8A to 8W. As shown in FIGS. 8A to 8I, the flexible heating device can be used in wearable devices such as neck protecting devices, waist protecting devices, belly protective devices, knee protecting devices, scarfs, gloves, socks or shoes heating pads, clothes and pants. As shown in FIGS. 8G to 8S, the flexible heating device can be used in household goods or products such as bed heating pads, bed heating covers, heating blankets, heating pillows, portable hand heaters, heating floors, heat chair cushions, heating desk cushions and heating curtains. As shown in FIGS. 8T to 8W, the flexible heating device can be used as heating accessories for motorcycles and cars, baby products, and accessories for outdoors and sports equipment such as outdoor heating tents.

Figure 9A:
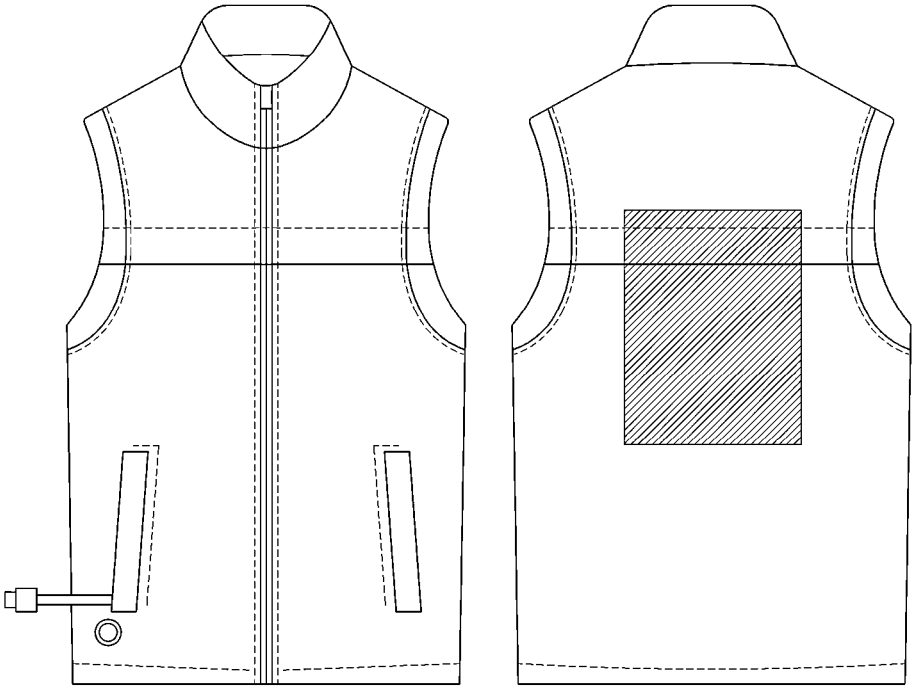
FIGS. 9A to 9G illustrate garments and other textile products each having a flexible heating device including one or more flexible heating pads; and different ways to electrically connecting the flexible heating pad to a power source including a portable power bank (9G) or an external power source (9F), and the temperature control status indicators (9G) in some embodiments according to the present disclosure.
Figure 9B:
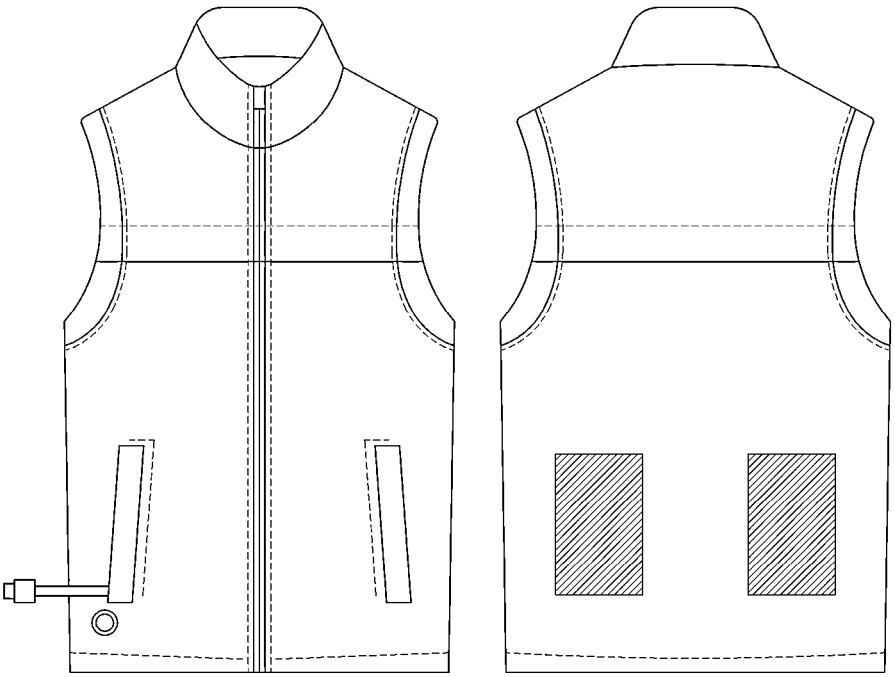
Figure 9C:
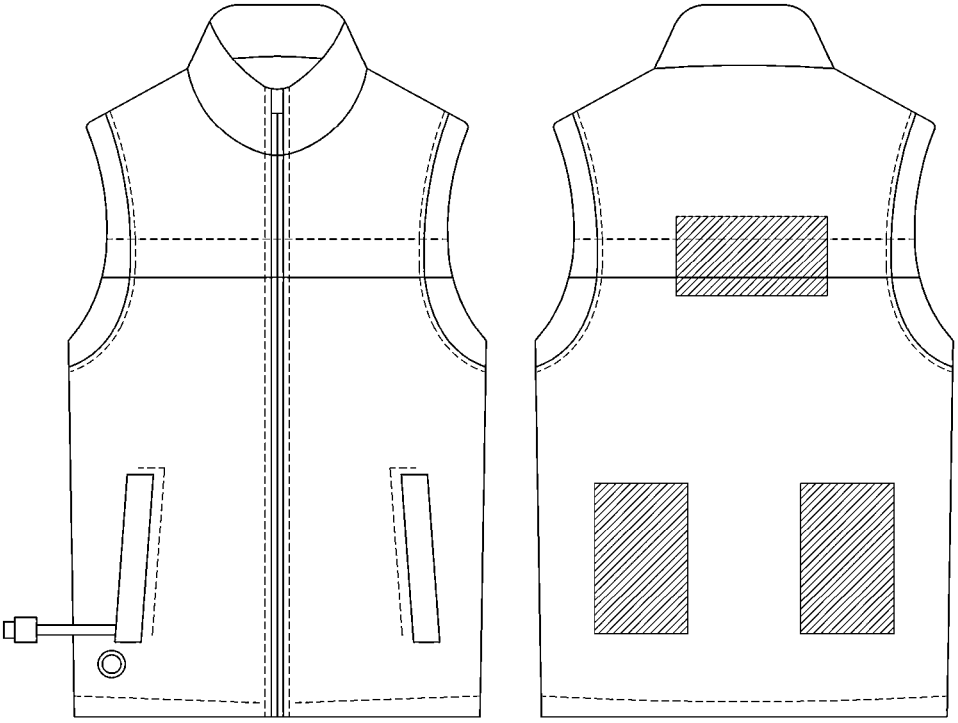
Figure 9D:
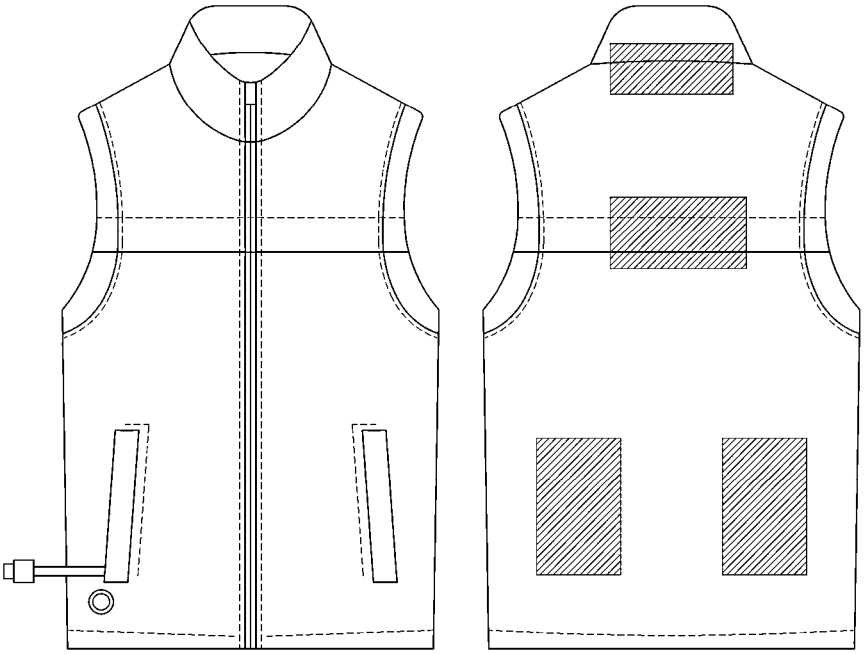

Flexible Heating Device for Applications in Wearable Devices, Textile and Garments In embodiments, the flexible heating device can be used for a wide variety of applications such as applications in textile, garment or a wearable device. The flexible heating device is configured to be sewed or fixed to the wearable devices at certain desired locations. In embodiments, the flexible heating device is used in wearable devices. The flexible heating device is configured to be sewed or fixed to the wearable devices. A non-limiting example of applications of the flexible heating device in a jacket or vest is shown in FIGS. 9A to 9D. As shown in FIGS. 9A to 9D, the flexible heating device is configured to be sewed into the sections of the vest which are desirable to be maintained at a desired temperature range, such as the upper back section, the lower back sections, the belly section, the neck section of the vest. As shown on FIG. 9A, the flexible heating device has one flexible heating pad which is placed in the upper back section of the vest. As shown in FIG. 9B, the flexible heating device has two flexible heating pads which are placed in the lower back section of the vest. As shown in FIG. 9C, the flexible heating device has three flexible heating pads which are placed in the upper and lower back section of the vest. FIG. 9D shows a flexible heating device has an additional flexible heating pad placed at the back neck of the vest.

Figure 9E:
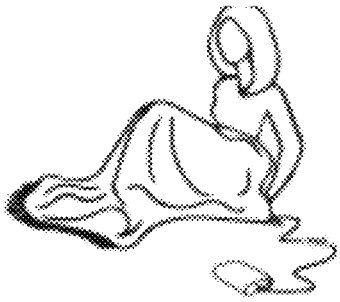
Figure 9F:
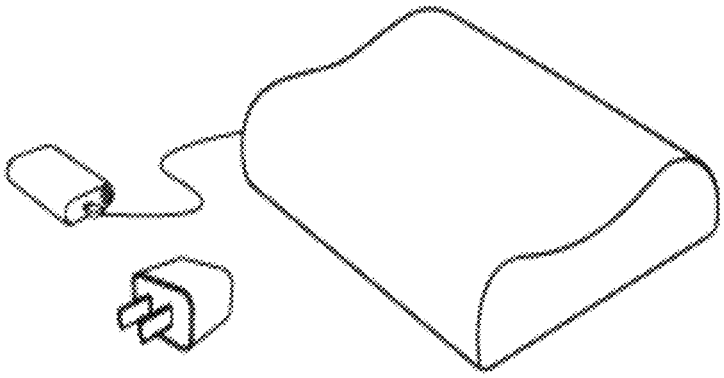
Figure 9G:
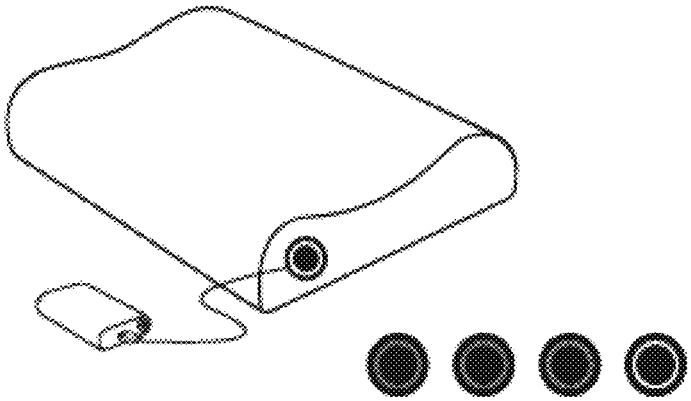
Figure 10A:
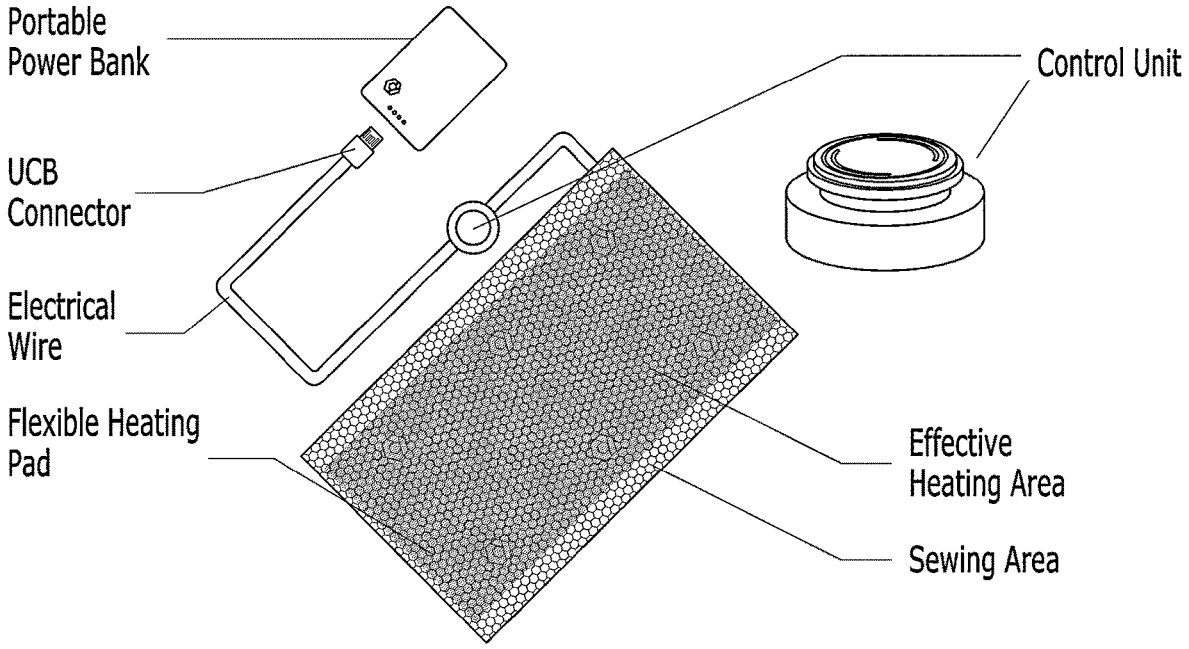
FIGS. 10A to 10D illustrate the structures, designs and assembly of the control unit in some embodiments according to the present disclosure.
Figure 10B:
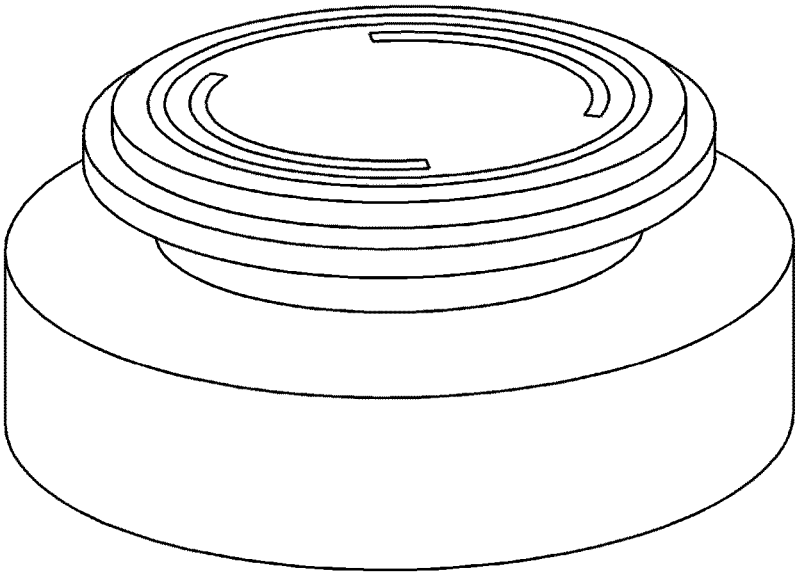
Figure 10C:
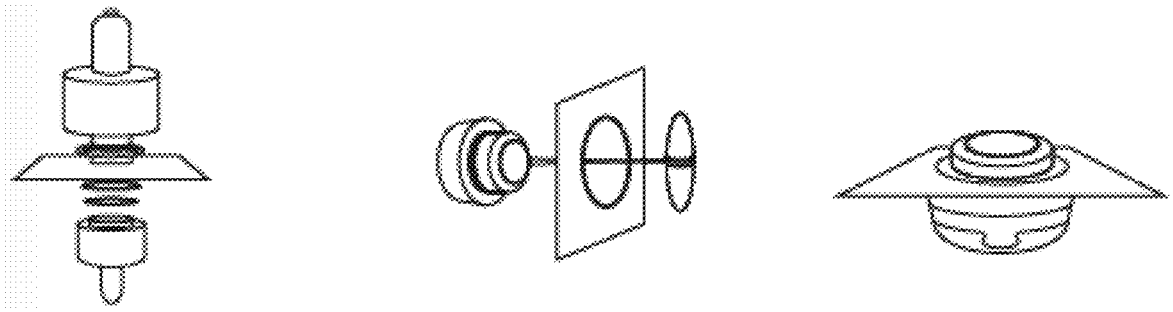
Figure 10D:
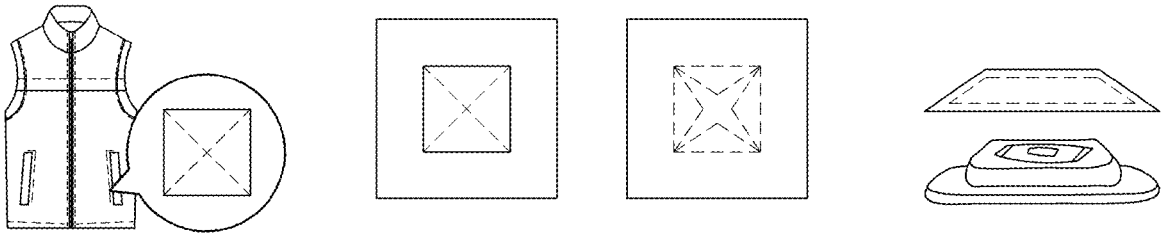
Figure 11A:
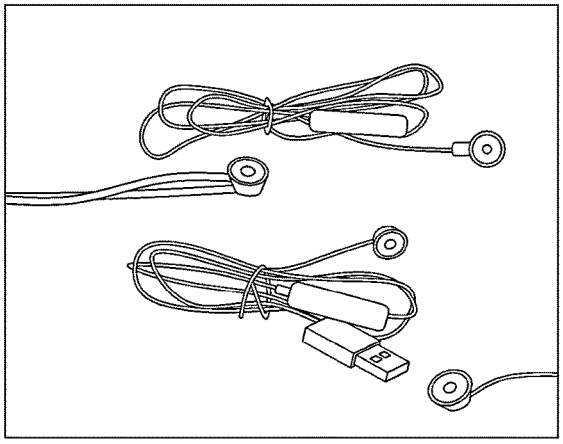
FIGS. 11A to 11D illustrate non-limiting examples of suitable shapes for the control unit in some embodiments according to the present disclosure.
Figure 11B:
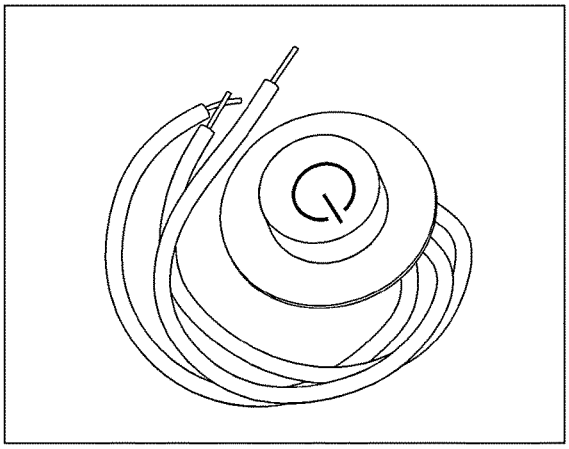
Figure 11C:
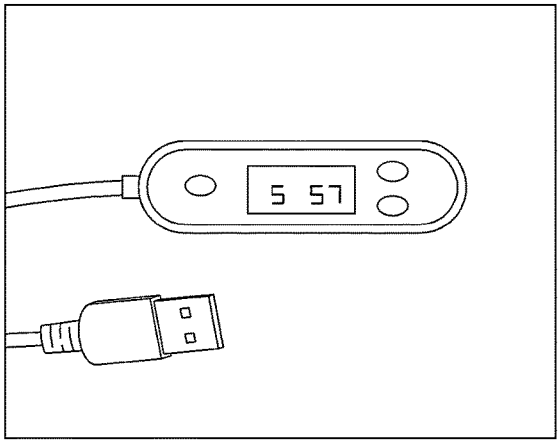
Figure 11D:
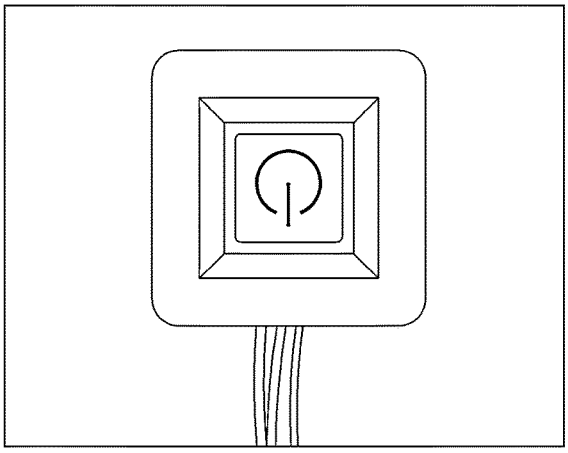
Figure 12A:
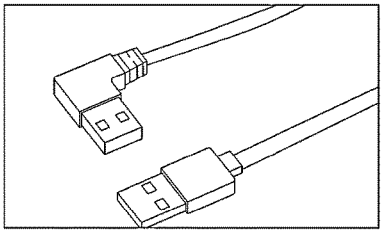
FIGS. 12A to 12F illustrate non-limiting examples of the suitable USB connectors for the flexible heating device in some embodiments according to the present disclosure.
Figure 12B:
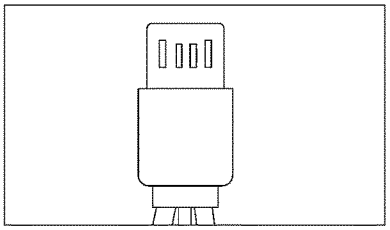
Figure 12C:
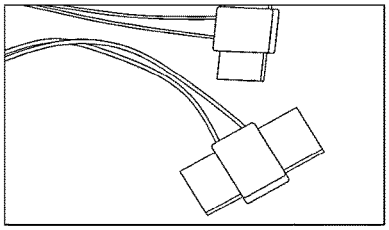
Figure 12D:
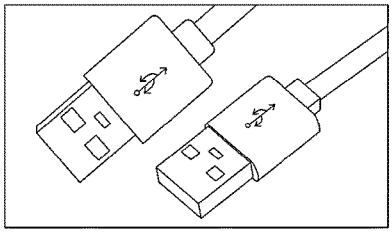
Figure 12E:
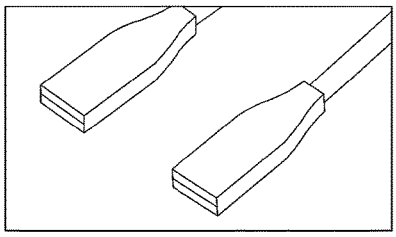
Figure 12F:
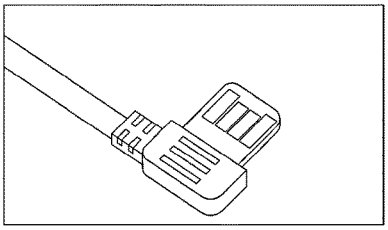

Another example of the applications of the flexible heating device is in a heating blanket as shown in FIG. 9E. In embodiments, the flexible heating pad in the heating blanket has a large surface area which is substantially as large as that of the blanket. Another example of the applications of the flexible heating device is in a heating pillow as shown in FIGS. 9F and 9G. In embodiments, the flexible heating pad in the heating pillow can use an electrical power source such as through an electrical power outlet as shown in FIG. 9F or a portable electrically power bank. In embodiments, the vest or the heating blanket has a surface fabric layer and a liner. The flexible heating device is sewed between the surface fabric layer and the liner. In embodiments, the flexible heating device comprises a flexible heating pad, a control unit, a power source such as a portable power bank, and electrically conductive wires configured to connect the flexible heating pad, the control unit, and the power source through USB connectors.

In embodiments, the power source is a portable power bank or provided through an electrical power outlet. In embodiments, the control unit, electrical wires and optionally the portable power bank are placed in one of the pockets of the clothes. The portable power bank is detachable from the flexible heating device and can be electrically connected to the flexible heating device through a USB connector. In embodiments, the control unit is detachable from the flexible heating device and is electrically connected to the flexible heating device through a USB connector. In embodiments, the flexible heating device can be configured to have the control unit on the clothes visible from outside and designed as a logo, as shown in FIGS. 9A to 9D.

Configuration of the Control Unit

In embodiments, the control unit of the flexible heating device can be configured to attach to a garment visible from outside and designed as a logo, as shown in FIGS. 10A to 10D. In embodiments, the control unit may be configured to be in two parts, with a first part being placed on the outside of the garment visible from outside, and the second part being placed inside the garment invisible from outside. In embodiments, the control units can be configured to be in a shape selected from a cycle, or cube or different shapes as shown in FIGS. 11A to 11D. The USB connectors can be configured to use different types of the connectors, such as USB connectors, as shown in FIGS. 12A to 12F.

Flexible Heating Device for Medical Applications

In embodiments, the flexible heating device can be used in medical applications, such as a flat, breathable and flexible heating pad to support a patient and maintain the body temperature of the patient during surgery and ICU care. The flexible heating devices can also be used to make a container to hold a temperature sensitive medicine or vaccine for storage and transportation in cold climate and to maintain at a desired temperature range for the temperature sensitive medicine or vaccine.

Flexible Medical Heating Pad

In embodiments, the flexible heating device is used in a flexible medical heating pad. In embodiments, the flexible medical heating pad comprises the flexible heating device layered on top of another supporting sheet of the flexible medical heating pad. In embodiments, the flexible medical heating pad is the flexible heating device. In embodiments, the first and second substrate layers of the flexible heating device are each selected from the group consisting of a flexible fabric layer such as synthetic fabric, wool, cotton or a waterproof fabric; a flexible silicone gel; and a flexible heat storage material layer. In embodiments, the first substrate layer is a flexible fabric layer. In embodiments, the first substrate layer is a flexible silicone gel layer. In embodiments, the second substrate layer is a flexible fabric layer. In embodiments, the second substrate layer is a flexible silicone gel layer. In embodiments, the flexible heating device is plugged to an external power source or a power bank. In embodiments, the flexible heating device comprises a portable power bank.

Temperature Control Container for Medicines and Vaccines

In embodiments, the flexible heating device is used in a temperature control container for temperature sensitive medicines and vaccines. In embodiments, the temperature control container comprises or is made of the flexible heating device. In embodiments, the flexible heating device comprise a second flexible substrate layer and optionally a first flexible substrate layer. The first and second flexible substrate layers of the flexible heating device are each selected from the group consisting of a flexible fabric layer such as synthetic fabric, wool, cotton or a waterproof fabric; a flexible silicone gel; and a flexible heat storage material layer. In embodiments, the first substrate layer is a flexible heat storage material layer. In embodiments, the second substrate layer is a flexible heat storage material layer. In embodiments, the flexible heating device is enclosed in, inserted into, or attached to the inner surface of a rigid box of the temperature control container.

Flexible Heating Device for Automobile Applications

In embodiments, the flexible heating device can be used in automobiles to heat the car seats, the car windows such as the front and rear windows, and car mirrors.

Wireless Flexible Heating Device

The present disclosure provides a flexible heating system comprising a wireless flexible heating device and a charging device configured to charge or recharge the wireless flexible heating device. The charging device is configured to electrically connect to a power source such as a portable power bank or a power outlet. In embodiments, the wireless flexible heating device comprises at least one flexible heating pads as discussed herein above, a receiver circuit configured to attach to or inside at least one of the at least one flexible heating pads, and a wireless control module. In embodiments, the receiver circuit is a wireless signal receiver and is configured to receive signals from the wireless control module to operate the at least one flexible heating pads according to the received signals.

Figure 13:
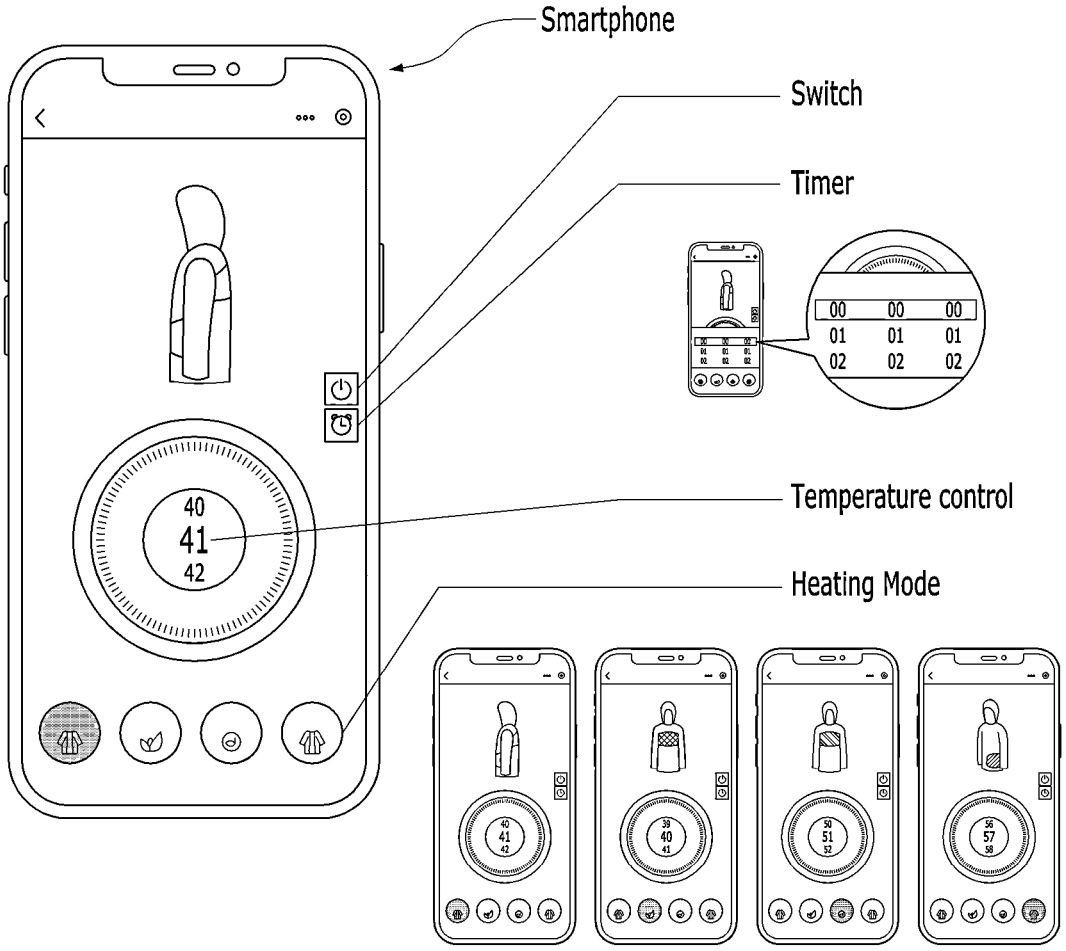
FIG. 13 illustrates the use of a smartphone APP to wirelessly control the targeted temperature and heating time for the flexible heating device in some embodiments according to the present disclosure.

In embodiments, the wireless control module comprises or is designed to be an app installed on a smart electronic device such as a smartphone, a laptop or other portable smart electronic devices. A non-limiting example of the wireless control module is designed to be an app installed on a smartphone as shown in FIG. 13. The app on the smartphone is designed to provide signals to the receiver circuit to: turn on or off the wireless flexible heating device; set up the targeted temperature ranges and heating time for each of the at least one flexible heating pads; and select a heating mode such as energy saving heating module; and operate the wireless flexible heating device to generate heat.

In embodiments, the receiver circuit includes a rechargeable battery. The rechargeable battery is configured to electrically connect to the electroconductive heat module of each of the at least one flexible heating pads. In embodiments, the rechargeable battery supplies electrical power to the electroconductive heat modules of the at least one flexible heating pads to generate heat when the receiver circuit receives signals from the wireless control module. In embodiments, the rechargeable battery is charged or recharged through the power source such as a portable power bank or a power outlet to store the electrical power.

In embodiments, the rechargeable battery is configured to electrically connect to the power source for charging or recharging through a detachable USB cable. In embodiments, the power source is a portable power bank, and the detachable USB cable includes two USB connectors connected to each other by an electrical wire; and is electrically connect to the rechargeable battery through one of the USB connectors and to the portable power bank through the other USB connector. In embodiment, the power source is a power outlet, and the detachable USB cable includes a USB connector to electrically connect to the rechargeable battery, and an electrical power plug to plug into the power outlet.

In embodiments, the rechargeable battery is charged or recharged wirelessly. The wireless flexible heating device is used in combination with a charging device. In embodiments, the charging device is an inductive charging device. In embodiments, the charging device comprises a transmitter circuit configured to realize wireless electrical charging of the rechargeable battery. The charging device having the transmitter circuit is connected to the power source. The power source supplies electrical power to the transmitter circuit of the charging device. The charging device, after receiving the electrical power, converts the electrical power through the transmitter circuit into an alternate current signal that is transmitted to the receiver circuit of the wirelessly flexible heating device. The receiver circuit receives and converts the alternate current signal into electrical power that is then stored in the rechargeable battery. The rechargeable battery subsequently supplies the electrical power to the at least one flexible heating pads to generate heat according to the received signals from the wireless control module.

EXAMPLES

Now various aspects and features of the present disclosure are further discussed in connection with examples and experiments.

Preparation of Electrical Flexible Heating Device

Example 1—Test Sample 1

In this study, a first flexible heating pad was prepared according to the present disclosure.

Raw Materials

The carbon black nanoparticles, the multi-wall carbon nanotubes (MWCNTs) and graphene were purchased from Shandong Qiyuan Nano Technology Co., Ltd. The carbon black nanoparticles had an average particle size of about 50 nm. The graphene had an average thickness of about 3 nm and an average lateral particle size of about 7 μm. The MWCNTs had an average diameter of 14 nm, and an average length of 75 μm. The electrically conductive fabric was the black electrically conductive fabric product purchased from Suzhou Bazuan New Materials Technology Ltd. which is used to prepare flexible electrodes (www.bazuan.com). The heat transfer graphene film was purchased from TanYuan Technology Co., Ltd. The heat transfer graphene film had a thermal conductivity of about 500 w/m/K at 25° C. The polyurethane resin was purchased from Cangzhou Dahua Group Co., Ltd. The polyurethane resin had a viscosity of 18000 cps at 25° C. The polyacrylonitrile (PAN) was purchased from Wujiang Fuhua Shijia Weaving Co., Ltd. The hot melt adhesive TPU was purchased from Shanghai Hehe Hot-melt Adhesive Co., Ltd. The silver conductive paste was purchased from Shanghai Jiuyin Electronic Technology Co., Ltd. All materials were used as they were purchased.

Method of Preparing the Flexible Heating Pad

The flexible heating pad were prepared according to the process below: 1) weighting 40 parts of polyurethane (PU) resin; and 60 parts carbon-based fillers including 12 parts of carbon black nanoparticles, 30 parts of MWCNTs, and 18 parts of graphene; 2) mixing the PU resin and the carbon-based fillers to form a mixture; 3) adding the mixture to a calender; 4) heating the calender to a temperature to melt the PU resin and mixing the mixture to form a homogeneous carbon-based composite; 5) calendering and drawing to form a thin film of the carbon-based composite (a flexible heat generating layer); 6) printing a conductive silver paste layer onto the thin film of the carbon-based composite; 7) perforating the flexible heat generating layer having the printed conductive silver layer; 8) preparing two electrodes from the electrically conductive fabric and laminating the two electrodes to the conductive silver layer; 9) laminating a protective layer to each of the electrodes to form an electroconductive heat module; 10) laminating a lateral heat transfer graphene film on top of the electroconductive heat module having the flexible heat generating layer having the printed conductive silver layer and the two electrodes and two protective layers; 11) laminating a flexible PAN fabric layer on each side of the electroconductive heat module to form the flexible heating pad. The weight ratio of the carbon black nanoparticles, multi-wall carbon nanotubes (MWCNTs), and graphene was about 1:2.5:1.5. In this process, each layer was laminated and sealed using a hot melt adhesive TPU to ensure that the flexible heating pad was sturdy and waterproof.

Components of the Flexible Heating Device

The flexible heating device included a flexible heating pad. The flexible heating pad included first and second flexible substrate layers which are two flexible fabric layers, and an electroconductive heat module formed between the first and second flexible substrate layers. The electroconductive heat module included a first electrode, a second electrode, a first protective layer, a second protective layer, a flexible heat generating layer, a vertical heat transfer layer and a lateral heat transfer layer. The first electrode was attached to the top edge of the flexible heat generating layer and extended along a first axis. The second electrode was attached to the bottom edge of the flexible heat generating layer and extended generally along a second axis parallel to the first axis and with a distance to the first electrode. The first protective layer covered the first electrode, and the second protective layer covered the second electrode. The flexible heat generating layer was interposed between the first and second electrodes and electrically connected to the first and second electrodes such that the flexible heat generating layer generates electroconductive heating when an electric current flows between the first and second electrodes. The flexible heat generating layer had a number of perforations formed through a thickness thereof substantially throughout a two-dimensional area of the flexible heat generating layer over the flexible substrate layer. There were no perforations beneath the two electrodes. The different components and layers were laminated together to form a laminated structure. The edges of each layers were sealed with a hot melt adhesive thermoplastic polyurethane (TPU).

Compositions and Properties of the Components and the Flexible Heating Pad

The two electrodes were two electrically conductive fabric electrodes. The two protective layers were made of polyethylene terephthalate (PET) and were waterproof and insulative. The two electrodes was layered on the flexible heat generating layer and covered by the two protective layers respectively. The flexible fabric layer was made of polyacrylonitrile (PAN). The flexible heat generating layer was made of an electrically conductive material. The electrically conductive material is a carbon-based composite. The carbon-based composite included 40 parts of polyurethane resin (a binder); and 60 parts carbon-based fillers. The carbon-based fillers included including carbon black nanoparticles, multi-wall carbon nanotubes (MWCNTs), and graphene in a weight ratio of 1:2.5:1.5. The flexible heat generating layer had a thickness of about 55 μm. The surface area of the flexible heat generating layer is about 70% of the lateral heat transfer graphene layer. The vertical heat transfer layer was a conductive silver layer printed on the surface of the flexible heat generating layer. The conductive silver layer had a thickness of about 4.5 μm and a surface resistance of about 7 milliohms/square (mΩ/sq). The perforations were circular perforations and were even distributed on the flexible heat generating layer. The circular perforations had a diameter of about 0.3 cm. The distances between the centers of two adjacent circular perforations was about 0.6 cm.

Example 2—Test Sample 2

In this study, a second flexible heating pad was prepared according to the same preparation process of Example 1 using the same raw materials of Example 1 except that a polyurethane (PU) resin had a viscosity of 15000 cps at 25° C. was used.

Example 3—Test Sample 3

In this study, a third flexible heating pad was prepared according to the same preparation process of Example 1 using the same raw materials of Example 1 except that the carbon black nanoparticles had an average particle size of 80 nm.

Example 4—Control Sample 1

In this study, a first control sample of the flexible heating pad was prepared according to the same preparation process of Example 1 using the same raw materials of Example 1 except that a polyurethane (PU) resin had a viscosity of 5000 cps at 25° C. was used.

Example 5—Control Sample 2

In this study, a second control sample of the flexible heating pad was prepared according to the same preparation process of Example 1 using the same raw materials of Example 1 except that the carbon black particles having an average particle size of 200 nm was used to replace the carbon black nanoparticles in Example 1.

Example 6—Control Sample 3

In this study, a third control sample of the flexible heating pad was prepared according to the same preparation process of Example 1 using the same raw materials of Example 1 except that weight ratios of the carbon black nanoparticles, the MWCNTS and graphene were changed to 3.5:2.5:5.

Example 7—Control Sample 4

In this study, a third control sample of the flexible heating pad was prepared according to the same preparation process of Example 1 using the same raw materials of Example 1 except that circular perforations had a diameter of 0.3 cm and the distance between the centers of two adjacent perforations was 0.4 cm.

Example 8—Property Tests of the Test Samples and the Control Samples

In this study, the surface resistance, the bending and folding properties and water-washability of the test samples and the control samples were measured. For each of the test samples and the control samples, 5 specimens were used for each test. The test results for the 5 specimens for each of the test samples and control samples were averaged and reported in Table 1 below.

Surface Resistance Test

The surface resistance of the carbon-based composite thin film for each of the test samples and control samples were tested using a four-point probe measurement device. For each of the test samples and the control samples, 5 specimens were used for each test. The test results for the 5 specimens for each of the test samples and control samples were averaged and reported in Table 1 below.

Bending and Folding Property Test

For each of the test samples and control sample, 5 flexible heating pad specimen having a dimension of 5 cm×5 cm were cut. Each of the specimen for each of the test samples and control samples were folded 100 times and an observation of the appearance of the specimen was recorded after each folding. The observations of the folding marks and breakage of the specimen were reported in Table 1 below.

Water-Washability Test

Five specimens each having the size of 20 cm×20 cm were cut from each of the test samples and the control samples. Each of the specimens were water-washed 100 times according to the standard test method of GB/T 13769-2009 and GB/T8629-2017. After each water-washing of the specimen, the specimen were tested to measure whether the specimen could generate heating as designed and the whether the switch could be turn on and off as originally designed. The test results were shown in Table 1 below.

Figure 14A:
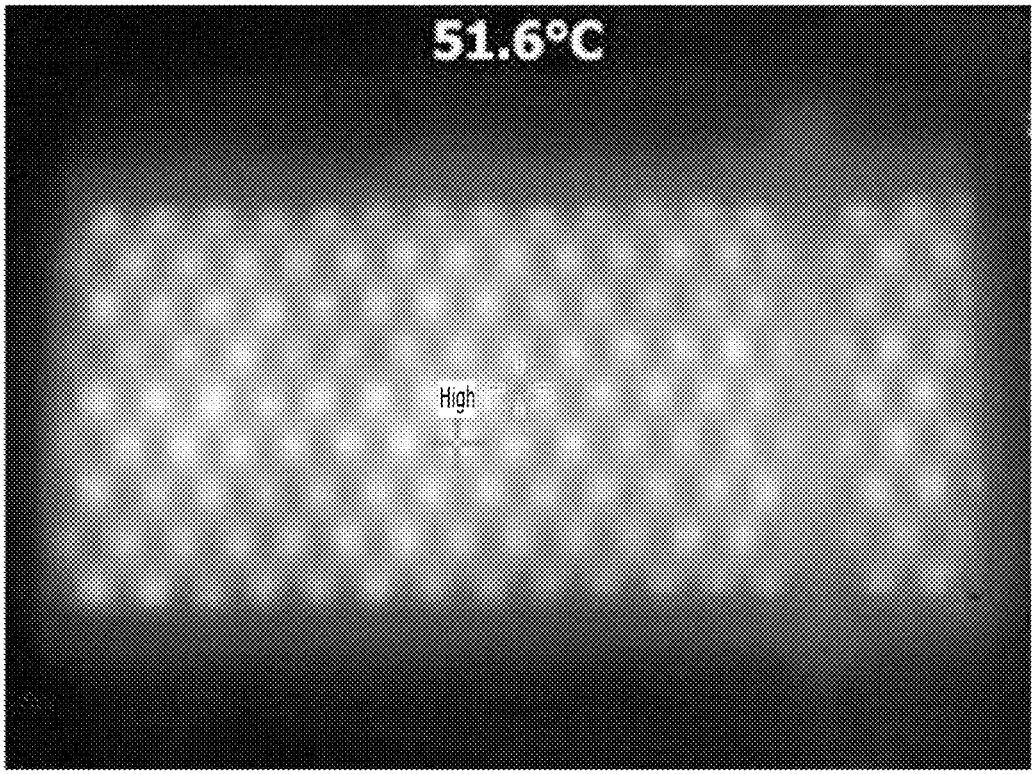
FIGS. 14A to 14B illustrate water-washability test results and the heat distribution after the test of a flexible heating device in Example 8 of the present disclosure.
Figure 14B:
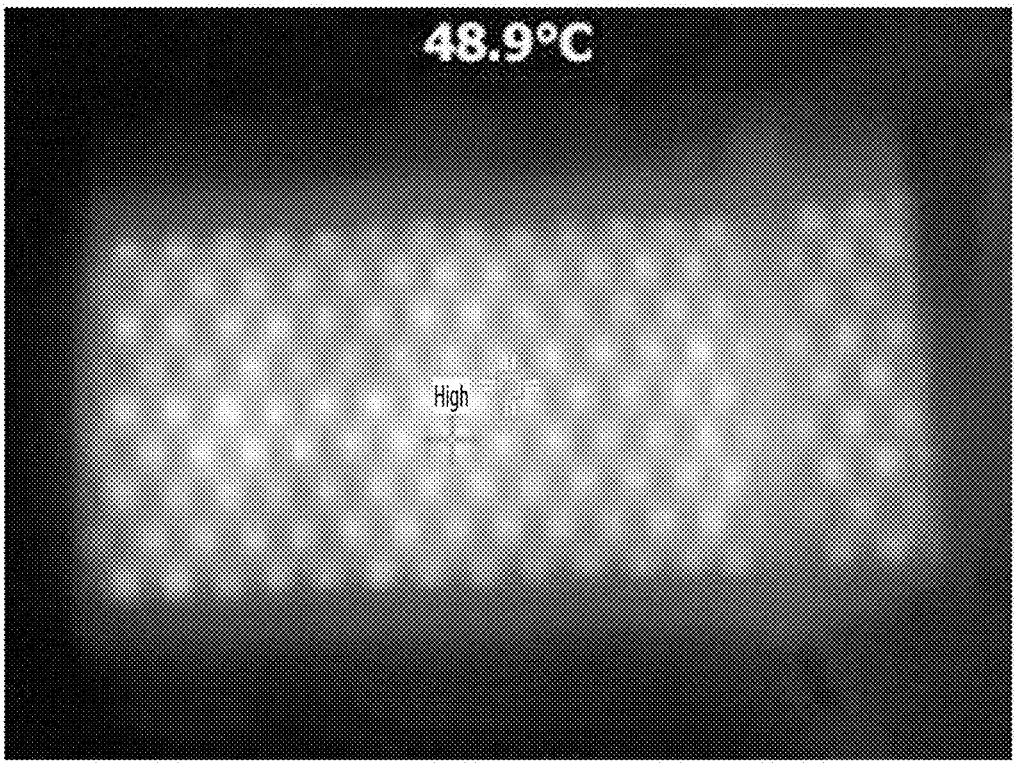
Figure 14C:
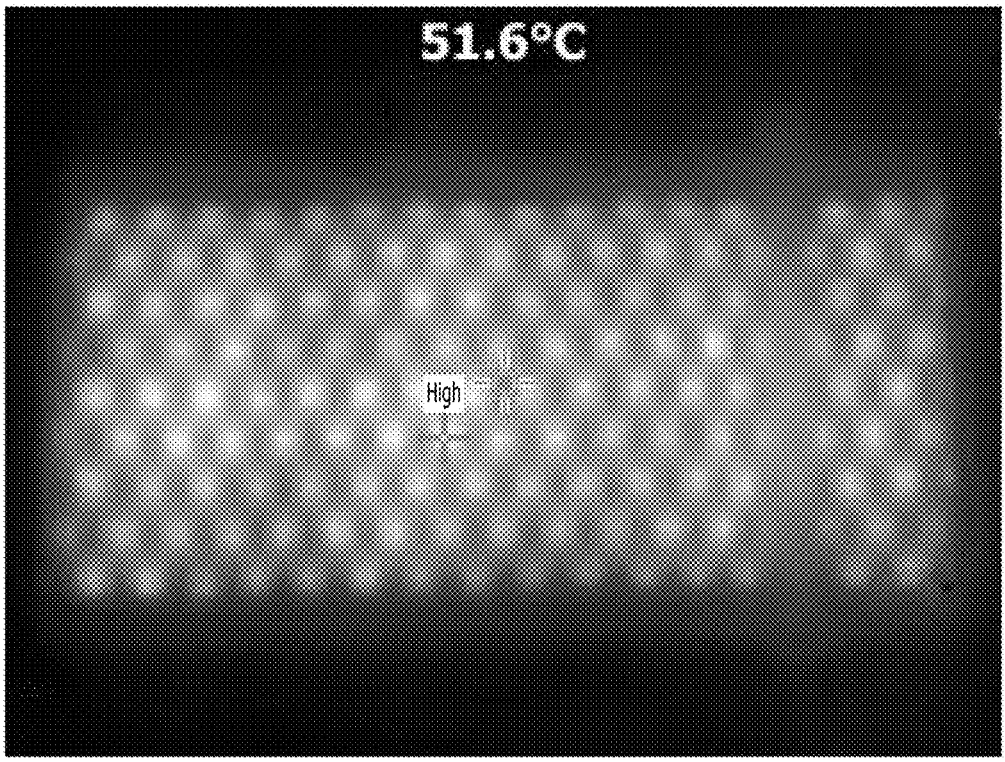
FIG. 14C is a color version of FIG. 14A.
Figure 14D:
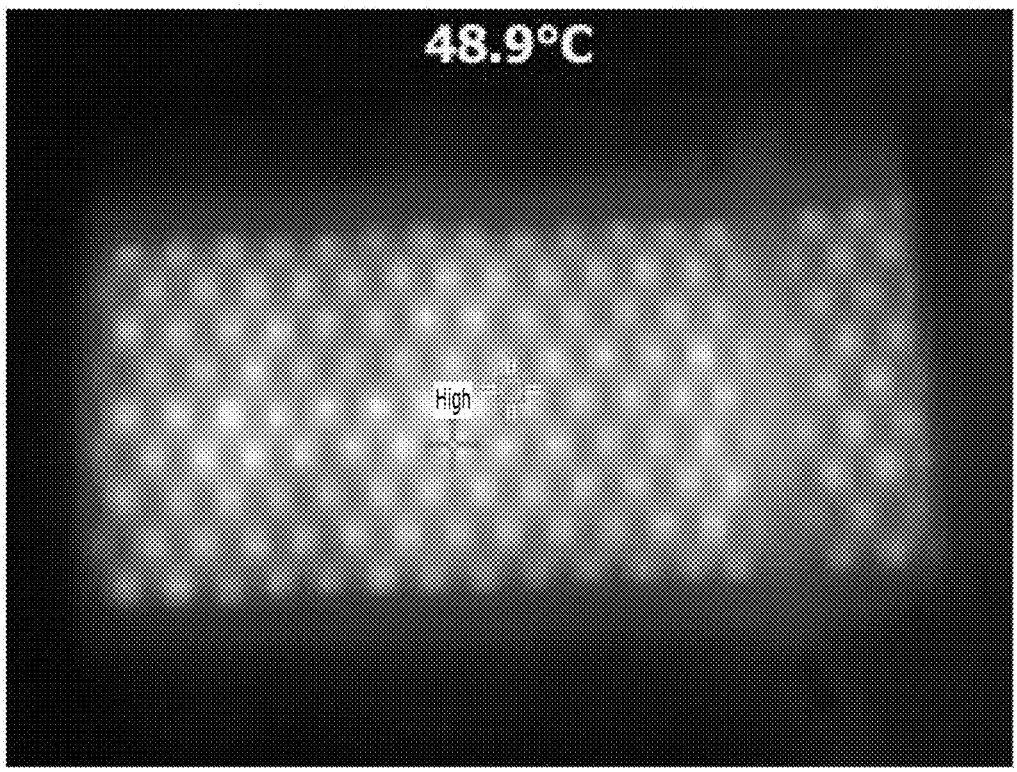
FIG. 14D is a color version of FIG. 14B.

Infrared images were taken for the heated Test Sample 1 before and after the water-washing test and are shown in FIGS. 14A and 14B respectively. The infrared images shown in FIGS. 14A and 14B clearly demonstrated that the switch of the control unit of Test Sample 1 could be turn on and off as originally designed; and the specimen could generate heating uniformly as designed without the issues of hot and cold spots.

The Properties of the Test Samples and the Control Samples

Surface Resistance

As shown in Table 1 below, Test Samples 1, 2 and 3 had a surface resistance of about 8.8, 8.4 and 9.1 respectively. Control Samples 1, 2, 3 and 4 had a surface resistance of about 9.7, 10.2, 5.6 and 8.78 respectively.

Bending and Folding

As shown in Table 1, Test Samples 1, 2 and 3 according to the present invention did not show any folding marks and no breakage was observed for any of the specimens. In contrast, Applicant observed significant folding marks and slight breakage on all of the specimens for all Control Samples 1, 2, 3 and 4.

Water-Washability

As shown in Table 1, each of the specimens for Test Samples 1, 2 and 3 were tested after each of the water-washing cycles. Applicant found that all the specimens for Test Samples 1, 2 and 3 were able to generate heat properly and evenly as designed and the switches could be turned on and off properly as designed after 100 times of water-washing cycles. In contrast, Applicant found that the specimens for Control Samples 1, 2, 3 and 4 could not generate heat evenly and properly and had hot and cold spots; and the switches could not be turned on and off properly.

Comparison of Properties

The test results are shown in Table 1 below clearly demonstrated that test samples prepared based on the present invention were flexible, and had good water-washability, and good resistance to bolding and folding. Applicant further found that Test Sample performed the best among all the test samples and control samples.

TABLE 1

Comparison of the properties of the test samples and the control samples.

| Samples | Surface Resistance (Ω/sq) | Bending and Folding Performace | Water-Washability |
|---|---|---|---|
| Test Sample 1 | 8.8 | No Fold Marks, No Breakage | Generate Heat evenly as designed, Switch works normally |
| Test Sample 2 | 8.4 | No Fold Marks, No Breakage | Generate Heat evenly as designed, Switch works normally |
| Test Sample 3 | 9.1 | No Fold Marks, No Breakage | Generate Heat evenly as designed, Switch works normally |
| Control Sample 1 | 9.7 | Obvious Fold Marks and Cracks | Generate heat unevenly and has uneven hot and cold spots, switch could not function normally |
| Control Sample 2 | 10.2 | Obvious Fold Marks and Cracks | Generate heat unevenly and has uneven hot and cold spots, switch could not function normally |
| Control Sample 3 | 5.6 | Obvious Fold Marks and Cracks | Generate heat unevenly and has uneven hot and cold spots, switch could not function normally |
| Control Sample 4 | 8.78 | Obvious Fold Marks and Cracks | Generate heat unevenly and has uneven hot and cold spots, switch could not function normally |

Example 9—Effect of Perforation on Total Resistance of Flexible Heat Generating Layer In this study, the effects of perforations on the total resistance of the flexible heating generating layer (carbon-based composite thin film) were evaluated. Six test samples having the same dimensions (10 cm×10 cm) were cut from the same flexible heat generating layer having a total resistance of 3.5Ω before perforation and a surface resistance of 5 Ω/sq before perforation. These six samples were subsequently perforated with circular perforations as detailed in Table 2. The total resistance of the 6 samples after perforations were measured and the test results are shown in Table 2.

TABLE 2

Effect of perforation on the total resistance of the flexible heat generating layer.

| Sample Dimension | Surface Resistance (Ω/sq) | Total Resistance (Ω) before Perforation | Perforation Diameter (mm) | Distance between centers of two adjacent perforations (mm) | Total Resistance (Ω) After Perforation |
|---|---|---|---|---|---|
| 10 × 10 cm | 5.0 | 3.5 | 6 | 12 | 7.0 |
| | | | | 14 | 6.1 |
| | | | 8 | 14 | 8.2 |
| | | | | 16 | 7.0 |
| | | | 10 | 16 | 9.3 |
| | | | | 18 | 7.9 |

As shown in Table 2, the perforations of the flexible heating generating layer increased the total resistance. The total resistance increased with the increased of the diameter of the circular perforations from 6, 8, and 10 mm when the distance between the centers of two adjacent perforations (total perforation numbers) were the same. The total resistance decreased with the increase of the distance between the centers of two adjacent perforations was increased (less total perforation numbers) when the diameter of the perforations were the same. The larger the diameter of the perforations and the higher the total perforation numbers (smaller center distance) on the test specimen of the same size, the higher the total resistance was observed for that test specimen.

Figure 15:
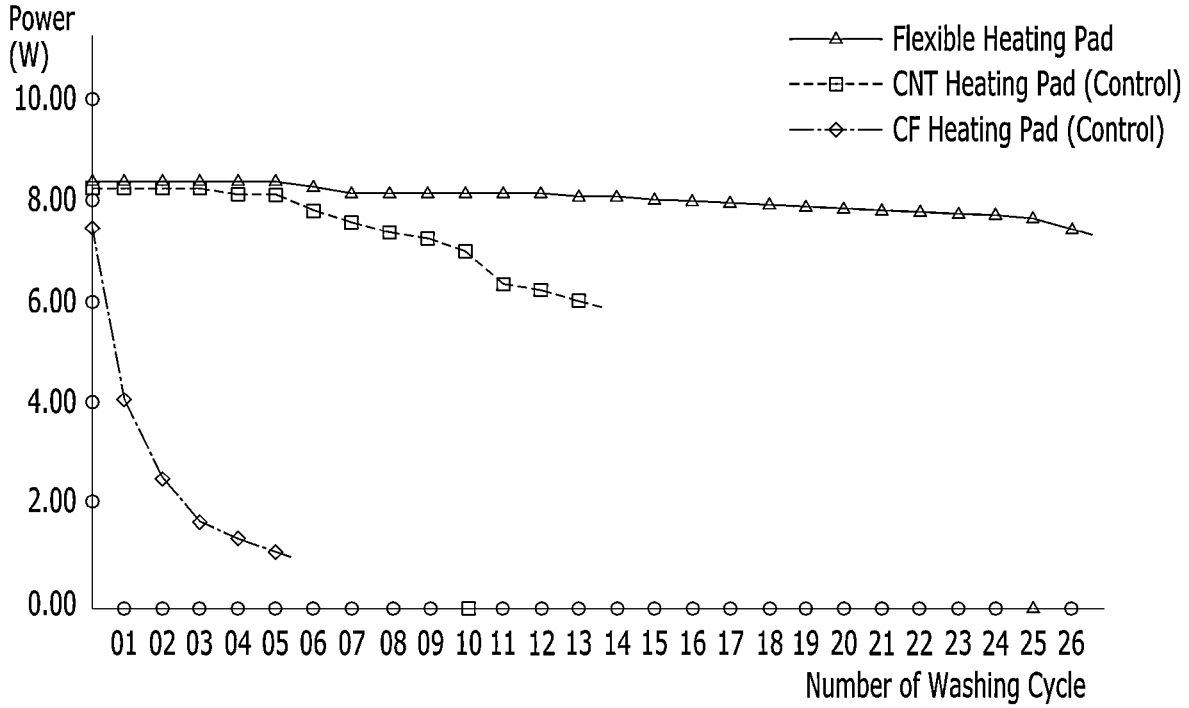
FIG. 15 illustrates the water-washability test results of the flexible heating device according to the present invention with heating devices made of carbon fiber (CF) and carbon nanotube (CNT) after water-washing tests in Example 10 of the present disclosure.

Example 10—Water-Washability Test on a Flexible Heating Pad of the Present Invention with Carbon-Fiber and Carbon Nanotube Heating Pads In this study, water-washing tests were conducted on a flexible heating pad of according to Test Sample 1 in Example 1, a heating pad made of carbon-fibers alone and a heating pad made of carbon nanotubes alone. The test results are shown in FIG. 15. As shown in FIG. 15, each of the specimens for Test Sample 1 were tested after each of the water-washing cycles. Applicant found that all the specimens for Test Sample 1 demonstrated stable heating power well, with less than 5% heating power loss after 25 water-washing cycles. In contrast, the heating pad made of carbon fibers dramatically loss the heating power even after 1 water-washing cycle and lost more than 80% of the heating power after even 5 water-washing cycles. The heating pad made of carbon nanotubes lost about 10% of the heating power after 10 water-washing cycles and lost about 25% of the heating power after only 13 water-washing cycles. The test results in FIG. 15 clearly demonstrated that the flexible heating pad of the Test Sample 1 of the present disclosure exhibited significantly better water-washability as compared to heating pads made of carbon-fibers alone according to FIG. 2A and carbon nanotubes alone respectively.

Figure 2A:
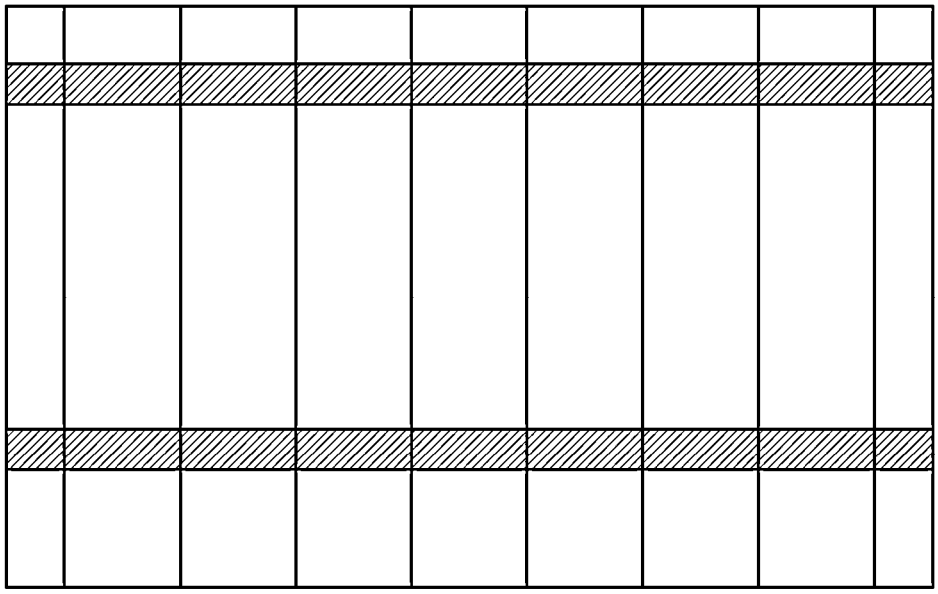
FIGS. 2A and 2B illustrate a conventional surface heating pad having long carbon fiber (CF) wires as the resistance heating element and its effective heating area respectively.
Figure 2B:
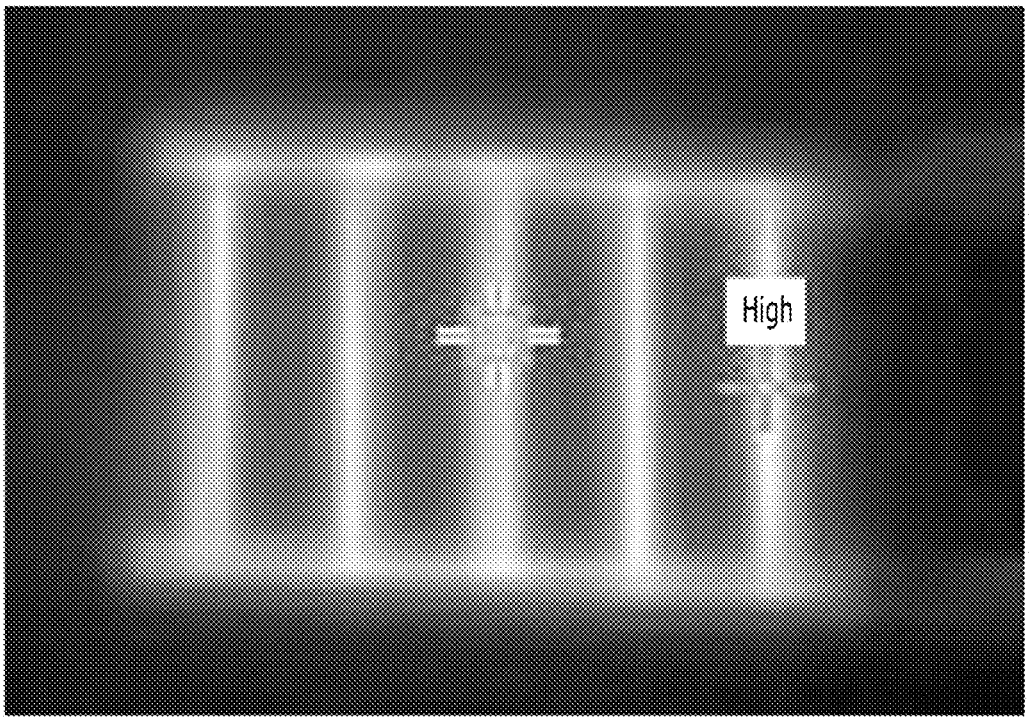
Figure 2C:
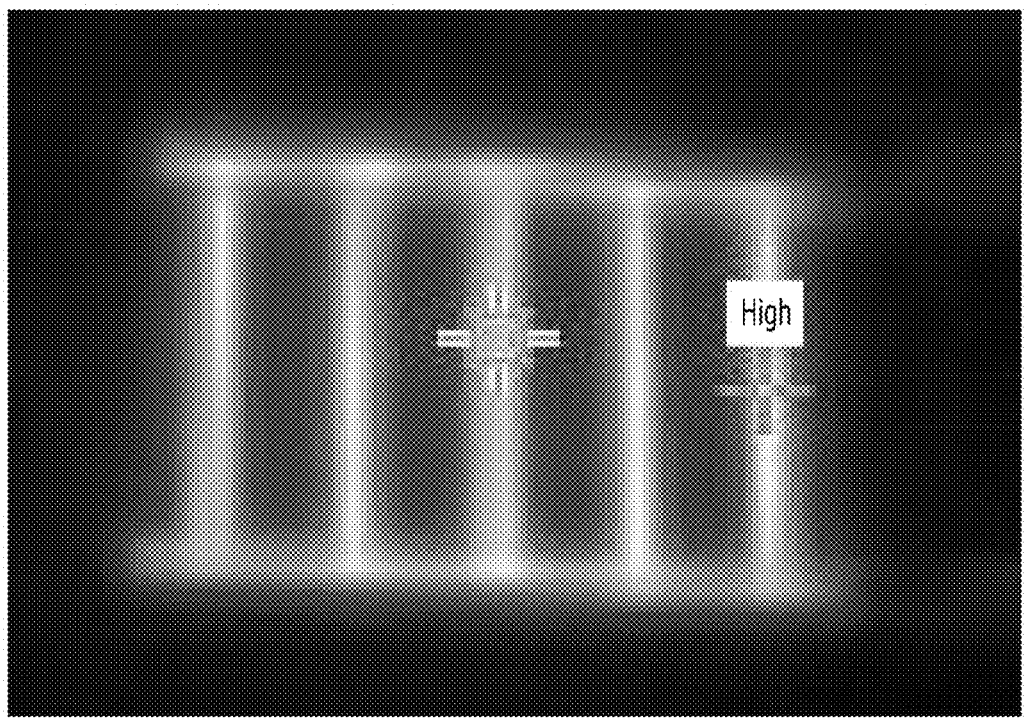
FIG. 2C is a color version of FIG. 2B.
Figure 16A:
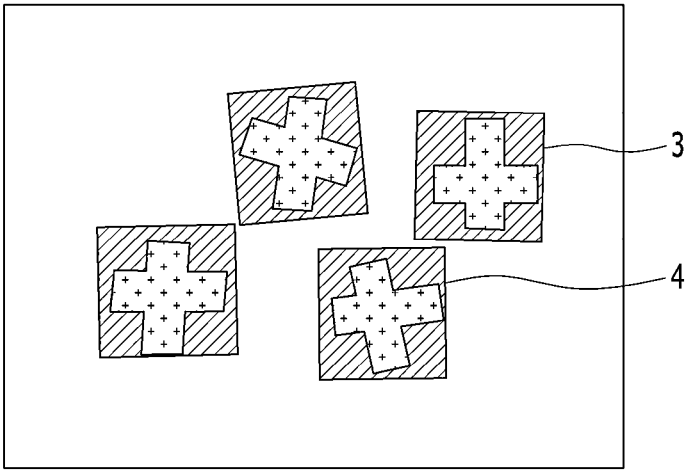
FIGS. 16A to 16E illustrate the comparison of the heat distribution test results of the flexible heating device according to an embodiment of the present disclosure to those of the carbon-fiber (CF) heating device in Example 11 of the present disclosure.
Figure 16B:
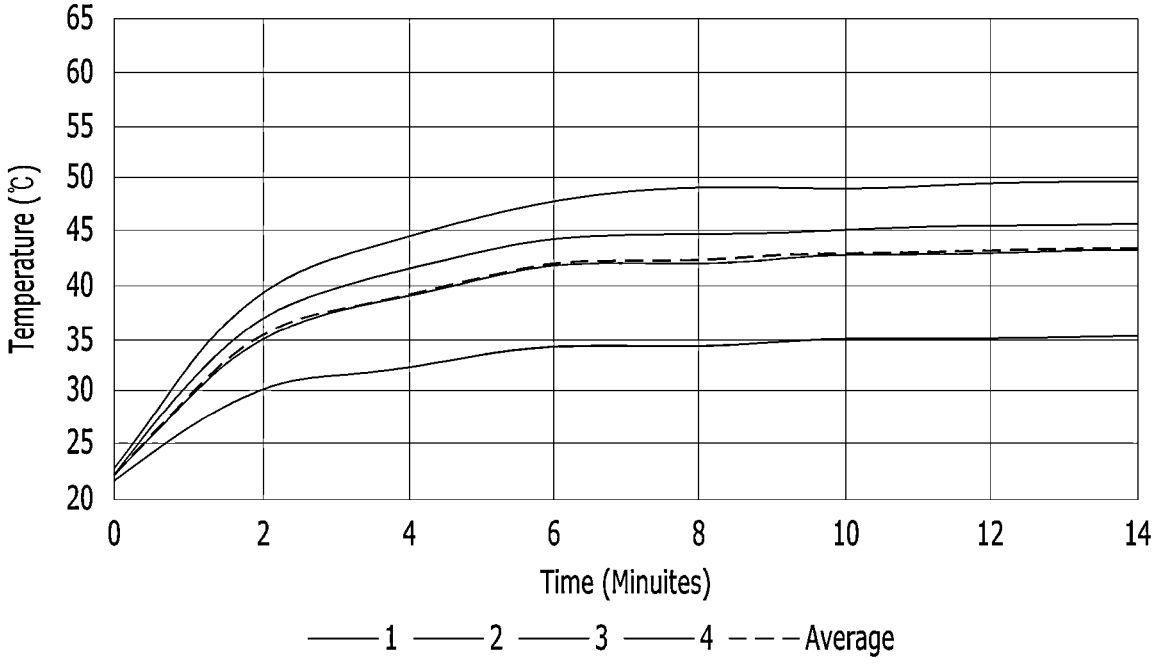
Figure 16C:
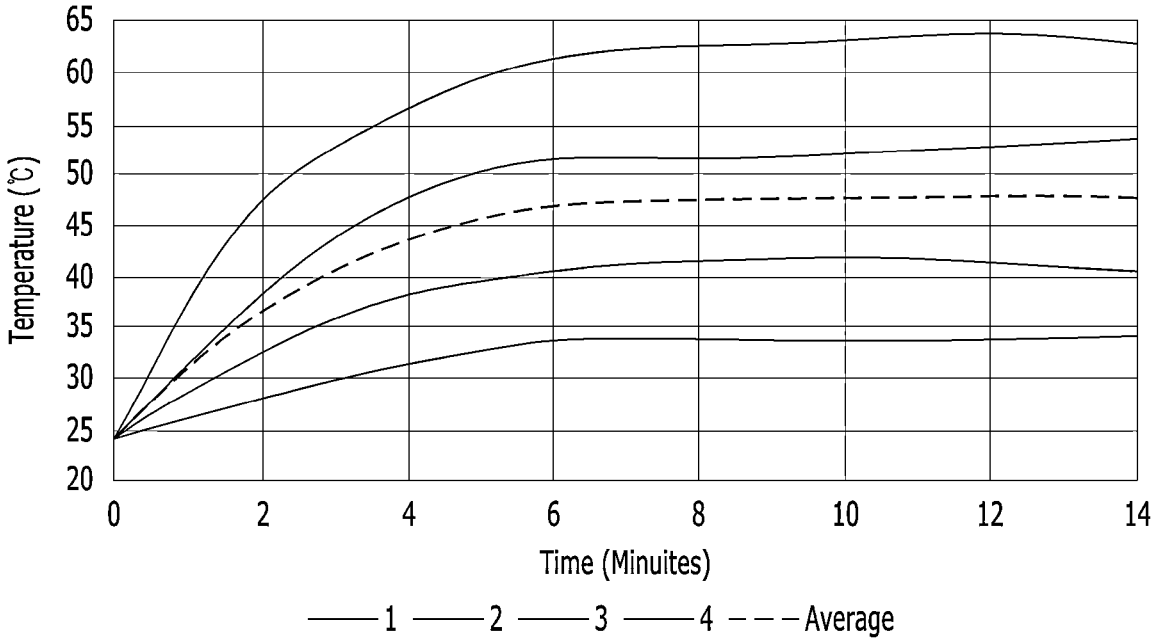
Figure 16D:
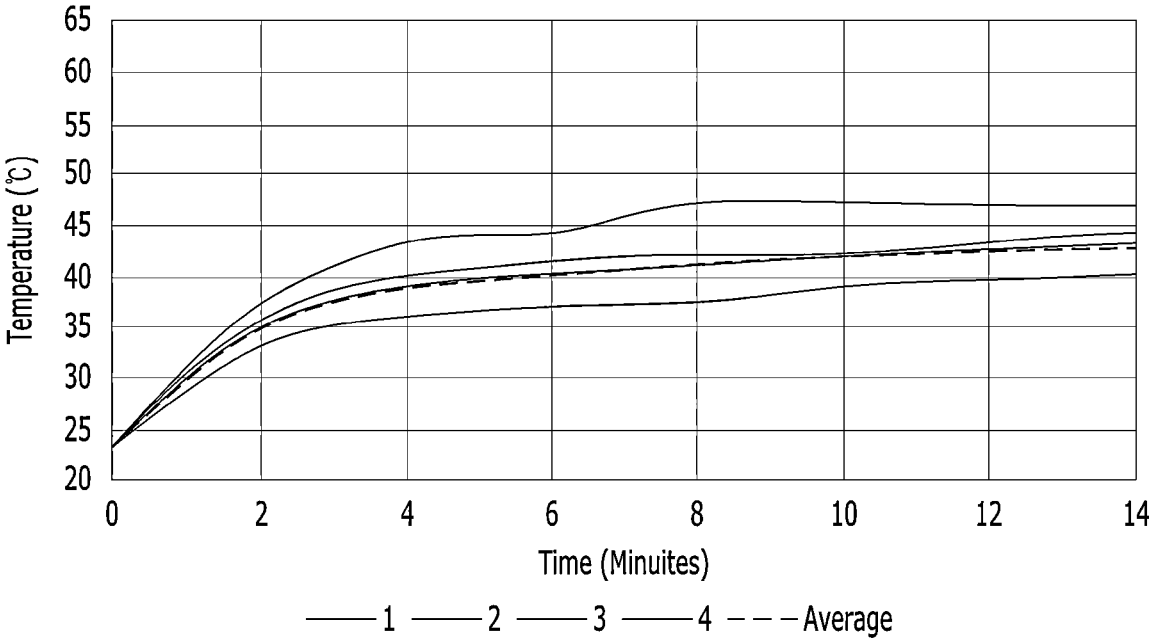
Figure 16E:
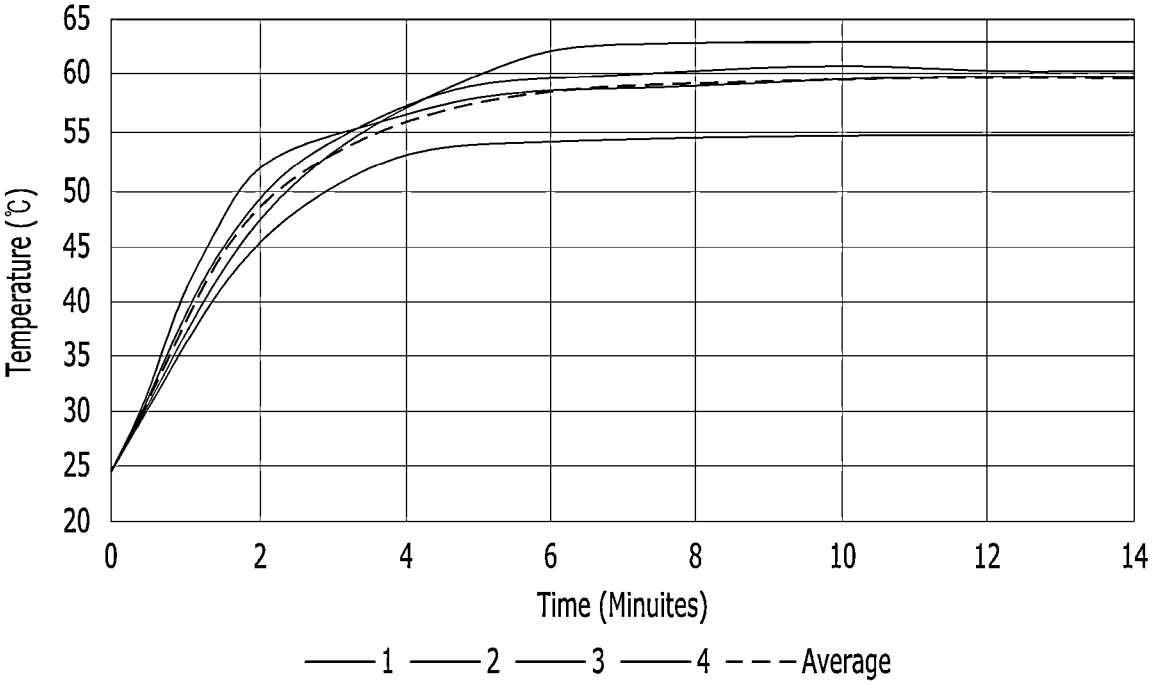

Example 11—Comparison of the Heat Distribution of A Flexible Heating Pad of the Present Invention with Carbon-fiber Heating Pads In this study, the heat distributions of a flexible heating pad of Test Sample 1 in Example 1, and a heating pad made of carbon-fibers alone according to FIG. 2A were measured at the same heating powers using 4 temperature sensors installed on 4 locations of the heating pad, as shown in FIG. 16A. The test results are shown in FIGS. 16B-16E. The heating distribution of the heating pad made of carbon-fibers alone are shown in FIGS. 16B and 16C; and the heating distribution of the flexible heating pad of Test Sample 1 of the present disclosure are shown in FIGS. 16D and 16E. The curve lines 1-4 in each figures were the accurate test results of the temperatures of the 4 test locations respectively, and the curve line Average are the average temperature of the 4 test locations. The test results in FIGS. 16B to 16E clearly demonstrated that the 4 temperature curve lines of the 4 different test locations of the heating pads are widely separated from each other, indicating the temperatures at the 4 different test locations at the same test time were significantly different and the thus the heat distribution of the heating pad was uneven. In contrast, the 4 temperature curve lines of the 4 different test locations of the Test Sample 1 were close to each other, indicating the temperatures at the 4 different test locations at the same test time were close to each other and the thus the heat distribution of the Test Sample 1 was more uniform than that of the heating pads made of carbon fibers alone.

Example 12—Impact of Lateral Heat Transfer Layer on the Heat Distribution of the Flexible Heating Pad This study investigated the impact of a lateral heat transfer layer on the heat distribution of the flexible heating pad. Five test samples of the flexible heating pad was prepared with the same formulations and preparation process of Test Sample 1 and had a lateral heat transfer layer including the liquid metal alloy sealed in a plurality of liquid metal alloy pouches. The liquid metal alloy included 68.5 wt. % gallium (Ga), 21.5 wt. % indium (In) and 10.0 wt. % tin (Sn) and has a melting point of −19° C. (−2° F.). The flexible heating pad had a number of perforations in a rhombus shape evenly distributed on the flexible heating pad. The liquid metal alloy pouches were each located in each of the perforations. The lateral heat transfer layer was prepared by first layering a first thin plastic film on the perforated flexible heat generating layer; printing a layer of the liquid metal alloy paste on the first thin plastic film; layering a second thin plastic film on the printed liquid metal alloy paste; and hot press the resulted laminated structure to form a plurality of liquid metal pouches located in the perforations of the flexible heat generating layer.

Figure 17A:
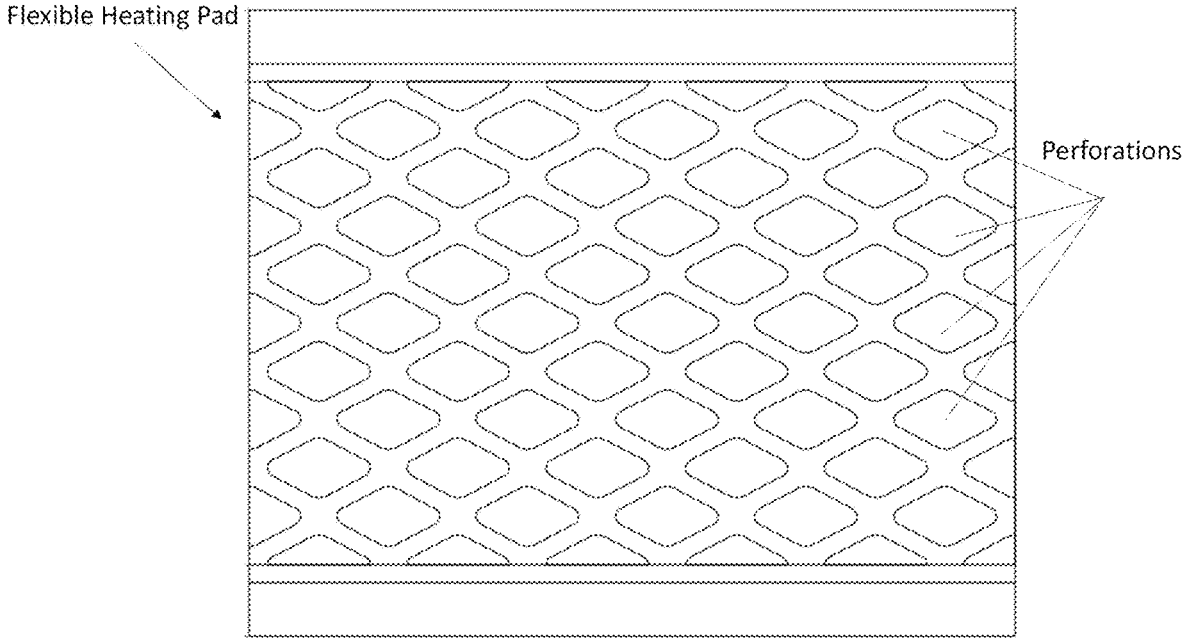
FIG. 17A illustrates a flexible heating pad having a plurality of perforations in a rhombus shape.
Figure 17B:
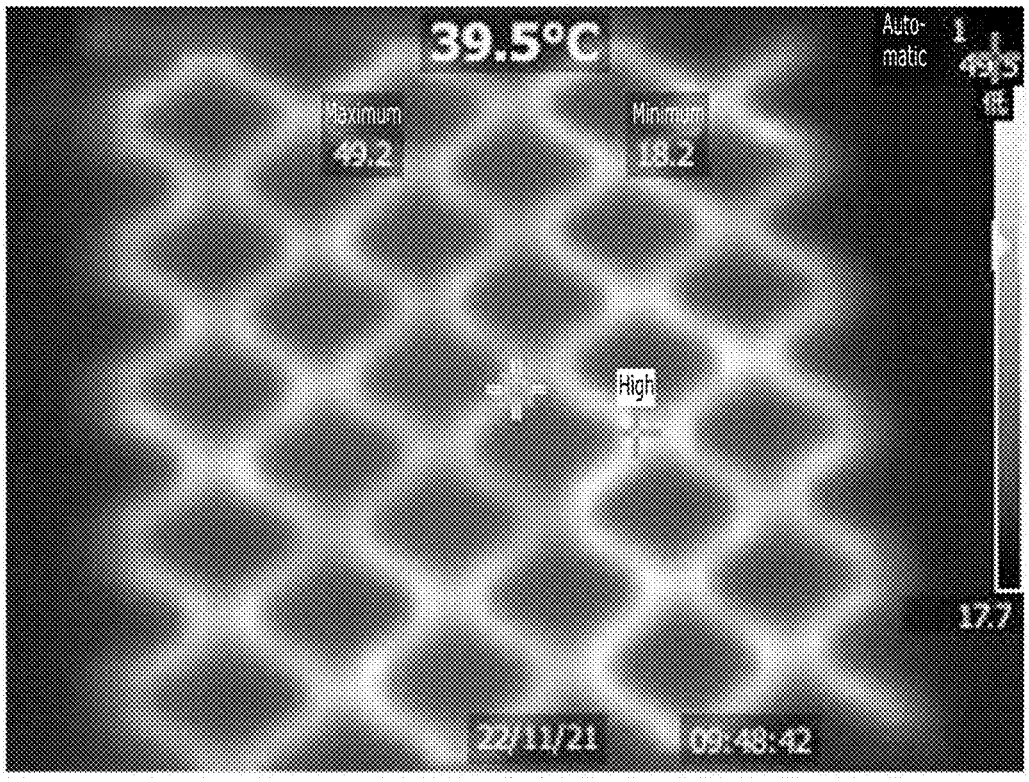
FIG. 17B illustrates a flexible heating pad having a plurality of perforations without any liquid metal vertical heat transfer layer.
Figure 17C:
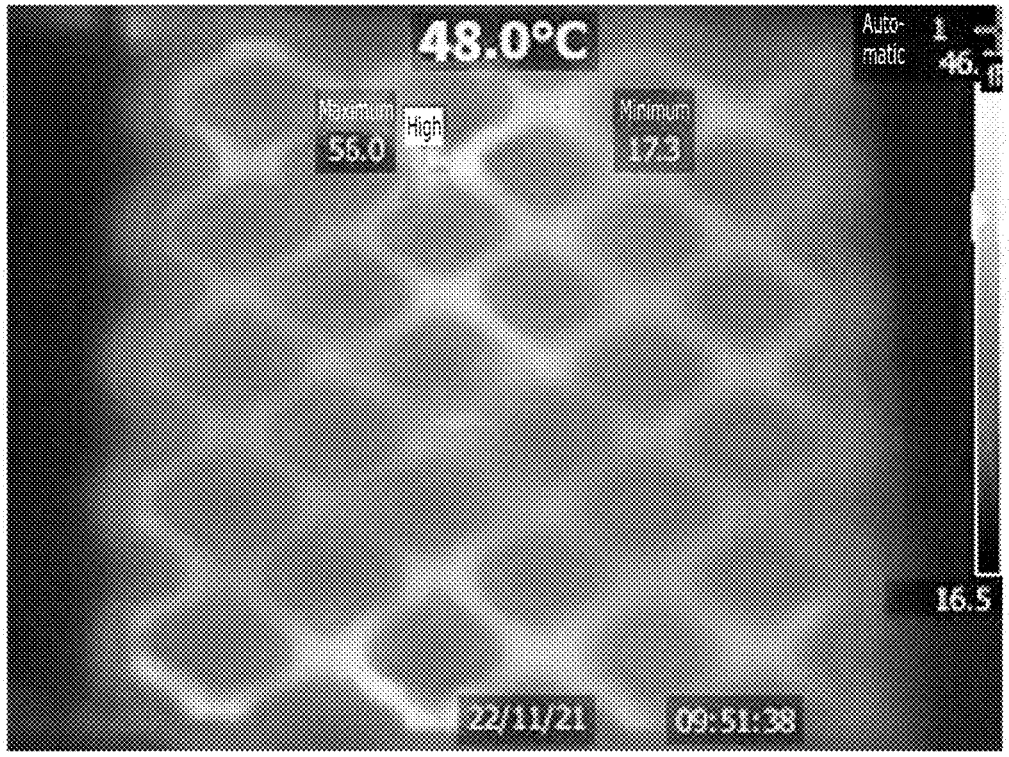
FIG. 17C illustrates a flexible heating pad having a plurality of perforations and a liquid metal vertical heat transfer layer having multiple liquid metal pouches.
Figure 17D:
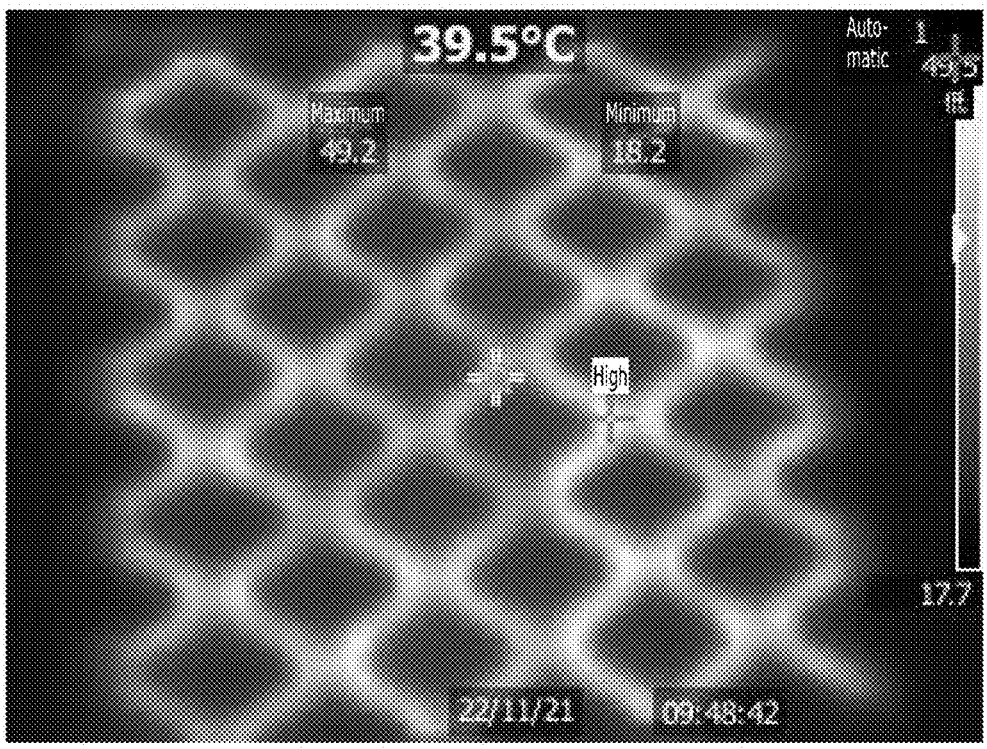
FIG. 17D is a color version of FIG. 17B.
Figure 17E:
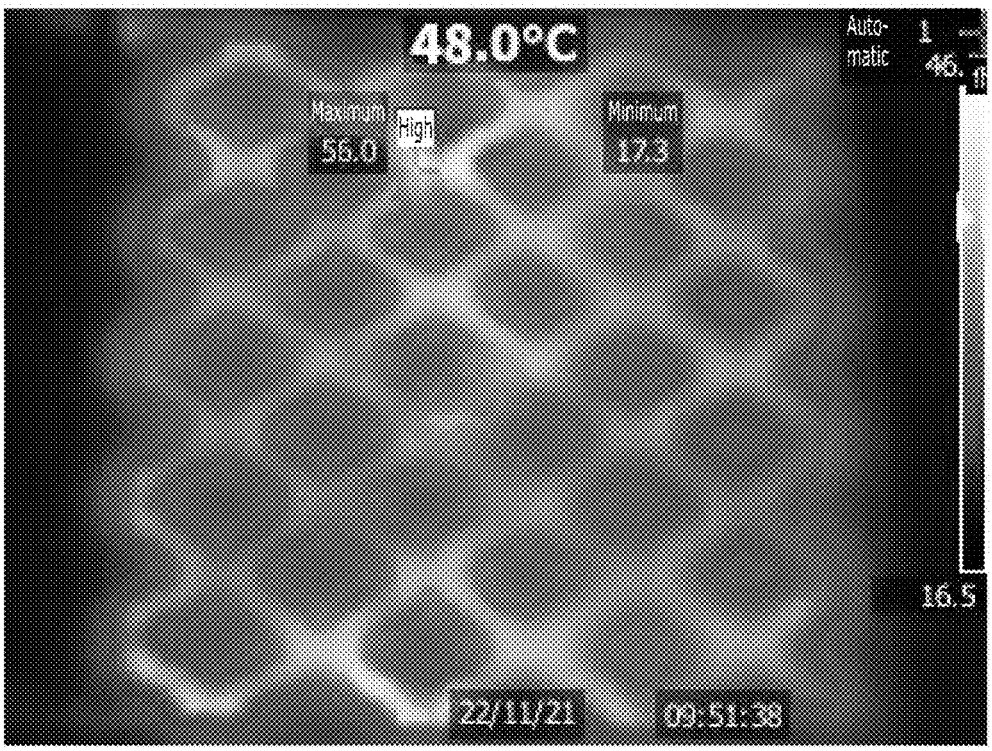
FIG. 17E is a color version of FIG. 17E.

The control sample of the flexible heating pad was prepared with the same formulations and preparation process of the test sample, except that the control sample did not have any lateral heat transfer layer. The test samples of the flexible heating devices and the control samples of the flexible heating device were each powered by a portable power bank. Each of the test and control samples were turned on the power to heat the flexible heating pad. The infrared images of each of the test and control samples were taken. A representative infrared image for the control sample is shown in FIG. 17B; and a representative infrared image for the test sample is shown in FIG. 17C. From the images in FIGS. 17B and 17C, it is clearly shown that the flexible heating pad having the liquid metal alloy pouches (test sample) had even heat distribution and no significant temperature gradient cross the whole flexible heating pad. In contrast, the flexible heating pad without liquid metal lateral heat transfer layer (control sample) had significant temperature gradients with cold spots in the perforation areas and hot sports at areas having no perforations. Further, the test samples having the liquid metal was heated up and reached even heat distribution much faster than the control sample.

Combination of Features

This disclosure provide a lot of discussions and information about many features relating to flexible heating pads and surface heating technologies. It is the intention of this disclosure to provide as many devices, systems and methods relating to those features. Two or more features disclosed above may be combined together to form a device, system or method to the extent they are combinable even if a particular combination is not presented in the present disclosure. Also, it is the intention of this disclosure to pursue claims directed to many of those features disclosed herein. Some of those features are presented in the form of claims in following section. Many claims are presented in dependent form by referring to one or more other claims. Applicant notes that some claims referring to multiple claims may encompass a combination of features that are in conflict with one another (hereinafter "improper combination"). However, Applicant recognizes that such claims may still encompass one or more combinations of features that do not have any conflicts with one another (hereinafter "proper combination"). By presenting claims that may encompass both proper and improper combinations, Applicant confirms its or inventor's possession of the proper combinations and intends to provide specific support for the proper combinations for later claiming of those proper combinations.

In describing embodiments of the present application, specific terminology is employed for the sake of clarity. However, the invention is not intended to be limited to the specific terminology so selected. Nothing in this specification should be considered as limiting the scope of the present invention. All examples presented are representative and non-limiting. The above-described embodiments may be modified or varied, without departing from the invention, as appreciated by those skilled in the art in light of the above teachings. It is therefore to be understood that, within the scope of the claims and their equivalents, the invention may be practiced otherwise than as specifically described.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that various changes and modifications may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated. Note that elements recited in means-plus-function format are intended to be construed in accordance with 35 U.S.C. § 112 ¶ 116. The scope of the invention is therefore defined by the following claims.

What is claimed is:

1. A flexible heating device comprising one or more flexible heating pad, the flexible heating pad comprising:

a flexible substrate layer;

a flexible heat generating layer configured to generate heat and comprising a number of perforations formed through a thickness thereof; and a lateral heat transfer layer interposed between the flexible substrate layer and the flexible heat generating layer for receiving and transferring therethrough at least part of the heat generated by the flexible heat generating layer, wherein the lateral heat transfer layer comprises a number of thermally conductive pouches, at least part of which overlays at least one of the perforations to reduce a temperature gradient between inside and around the at least one perforation.

2. The flexible heating device of claim 1, further comprising a conductivity layer in contact with the flexible heat generating layer and comprising a number of locally continuous and electrically conductive areas that are discontinuous from one another such that the conductivity layer alone does not provide electrical conductivity throughout the entirety of a two-dimensional area of the conductivity layer while providing electric conductivity within at least part of the number of locally continuous and electrically conductive areas.

3. The flexible heating device of claim 2, wherein the flexible heat generating layer and the conductivity layer in combination have a surface resistance a range between about 2 ohms/square and about 15 ohms/square.

4. The flexible heating device of claim 1, wherein the flexible heat generating layer comprises an electrically conductive material having a surface resistance sufficient to generate the heat therein.

5. The flexible heating device of claim 4, wherein the flexible heat generating layer with the perforations has a surface resistance that is substantially the same as that of the electrically conductive material without the perforations, wherein the flexible heat generating layer with the perforations has a resistance ranging between about 2 and about 50 per unit area of 10 cm2.

6. The flexible heating device of claim 4, wherein the flexible heat generating layer with the perforations has a surface resistance that is substantially higher than that of the electrically conductive material without the perforations.

7. The flexible heating device of claim 4, wherein the electrically conductive material comprises carbon black nanoparticles, carbon nanotubes, graphene pieces and a binder, which are mixed together:

such that the carbon black nanoparticles are dispersed in the electrically conductive material, such that at least part of the carbon nanotubes electrically bridge between carbon black particles, and further such that at least part of the graphene pieces electrically bridge among at least part of the carbon black particles, at least part of the carbon nanotubes and other graphene.

8. The flexible heating device of claim 1, wherein the thickness of the flexible heat generating layer is in a range between about 40 μm and about 80 μm.

9. The flexible heating device of claim 1, wherein the lateral heat transfer layer has a thickness ranging between about 0.1 μm and about 100 μm.

10. The flexible heating device of claim 1, wherein at least part of the thermally conductive pouches is aligned with at least part of the perforations such that one thermally conductive pouch is placed within one perforation.

11. The flexible heating device of claim 1, wherein the perforations have a diameter in a range between about 0.1 cm and about 1 cm.

12. The flexible heating device of claim 1, wherein the thermally conductive pouches contain a liquid metal therein and are liquid-tightly sealed.

13. The flexible heating device of claim 12, wherein the liquid metal is a eutectic metal alloy comprising gallium, indium and tin.

14. The flexible heating device of claim 1, wherein the flexible substrate layer is referred to as a first flexible substrate layer, wherein the flexible heating device further comprises a second flexible substrate layer formed over the flexible heat generating layer such that the flexible heat generating layer is interposed between the first flexible substrate layer and the second flexible substrate layer.

15. The flexible heating device of claim 14, wherein each of the first and second flexible substrate layers comprises a water-proof flexible substrate, wherein the first and second flexible substrate layers are water-tightly bonded such that the flexible heat generating layer is enclosed in a space defined between the first and second flexible substrate layers.

16. A garment comprising a garment body and the flexible heating device of claim 1, wherein the flexible heating device is attached to the garment body.

17. A method of making a flexible heating device, the method comprising:

providing a film of an electrically conductive material;

printing a metal paste on a surface of the film to form a conductive layer;

forming a number of perforations through a thickness of the film and the conductive layer to provide a perforated flexible heat generating layer;

laminating the perforated flexible heat generating layer with a lateral heat transfer layer comprising a number of thermally conductive pouches, which provide an intermediate device; and placing the intermediate device over a flexible substrate layer, wherein laminating is performed such that at least part of the thermally conductive pouches overlays at least one of the perforations to reduce a temperature gradient between inside and around the at least one perforation.

18. The method of claim 17, wherein the electrically conductive material comprises carbon black nanoparticles, carbon nanotubes, graphene pieces and a binder, which are mixed together:

such that the carbon black nanoparticles are dispersed in the electrically conductive material, such that at least part of the carbon nanotubes electrically bridge between carbon black particles, and further such that at least part of the graphene pieces electrically bridge among at least part of the carbon black particles, at least part of the carbon nanotubes and other graphene.

19. The method of claim 17, wherein the thermally conductive pouches contain a liquid metal therein and are liquid-tightly sealed, wherein the liquid metal is a eutectic metal alloy comprising gallium, indium and tin.

20. The method of claim 17, wherein the thermally conductive pouches contain a liquid metal therein and are liquid-tightly sealed, wherein at least part of the thermally conductive pouches is aligned with at least part of the perforations such that one thermally conductive pouch is placed within one perforation.

* * * * *